US006354253B1

(12) United States Patent
Katsumata et al.

(10) Patent No.: US 6,354,253 B1
(45) **Date of Patent: *Mar. 12, 2002**

(54) SOLENOID VALVE DEVICE

(75) Inventors: Shouji Katsumata, Gotenba; Yoshihiro Iwashita, Suntoh-gun; Isao Matsumoto; Masaaki Tanaka, both of Susono; Keiji Yoeda, Numazu; Hideyuki Nishida, Susono, all of (JP)

(73) Assignee: Toyota Jidosha Kabushiki Kaisha, Toyota (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/388,341

(22) Filed: Sep. 1, 1999

(30) Foreign Application Priority Data

| | | |
|---|---|---|
| Nov. 20, 1998 | (JP) | 10-331548 |
| Mar. 2, 1999 | (JP) | 11-054173 |
| Mar. 26, 1999 | (JP) | 11-084896 |
| Apr. 13, 1999 | (JP) | 11-105555 |

(51) Int. Cl.[7] ..... F01L 9/04

(52) U.S. Cl. ..... 123/90.11; 123/90.55; 251/129.15

(58) Field of Search ..... 123/90.11, 90.55, 123/90.49, 90.52; 251/129.01, 129.1, 129.15, 129.16

(56) References Cited

U.S. PATENT DOCUMENTS

| | | | | | |
|---|---|---|---|---|---|
| 4,777,915 | A | * | 10/1988 | Bonvallet | 123/90.11 |
| 5,199,392 | A | * | 4/1993 | Kreuter et al. | 123/90.11 |
| 5,327,856 | A | * | 7/1994 | Schroeder et al. | 123/90.11 |
| 5,494,007 | A | * | 2/1996 | Schroeder et al. | 123/90.11 |
| 5,762,035 | A | * | 6/1998 | Schebitz | 123/90.11 |
| 5,832,883 | A | * | 11/1998 | Bae | 123/90.11 |
| 5,887,553 | A | * | 3/1999 | Ballmann et al. | 123/90.11 |
| 6,021,749 | A | * | 2/2000 | Gaisberg | 123/90.11 |
| 6,044,813 | A | * | 4/2000 | Bulgatz et al. | 123/90.11 |
| 6,047,673 | A | * | 4/2000 | Muller | 123/90.11 |
| 6,085,704 | A | * | 7/2000 | Hara | 123/90.11 |
| 6,116,570 | A | * | 9/2000 | Bulgatz | 251/129.1 |

FOREIGN PATENT DOCUMENTS

| | | | | |
|---|---|---|---|---|
| JP | 7-332044 | | 12/1995 | |
| JP | 0722039 | A1 * | 10/1996 | F01L/9/04 |
| JP | 11-30113 | | 2/1999 | |

* cited by examiner

*Primary Examiner*—Weilun Lo
(74) *Attorney, Agent, or Firm*—Kenyon & Kenyon

(57) ABSTRACT

A solenoid valve device includes an engine valve which can move in an axial direction thereof, an armature which moves with the engine valve, an electromagnet which attracts the engine valve so that the engine valve moves in the axial direction, and a zero-lash adjuster mechanism which is interposed between the engine valve and the armature. Thus, the solenoid valve can positively actuate an engine valve between a fully closed position and a fully opened position without formation of a clearance between the engine valve and the armature. A current supplied to the electromagnet may be set in accordance with a value which is related to a relative position of the armature and the electromagnet.

9 Claims, 32 Drawing Sheets

FIG. 4A VALVE DISPLACEMENT

FIG. 4B WITHOUT ZERO-LASH ADJUSTER

FIG. 4C WITH ZERO-LASH ADJUSTER (A) WITHOUT LEAK-DOWN (ZERO-LASH STATE)

(B) WITH LEAK-DOWN (NOT ZERO-LASH STATE)

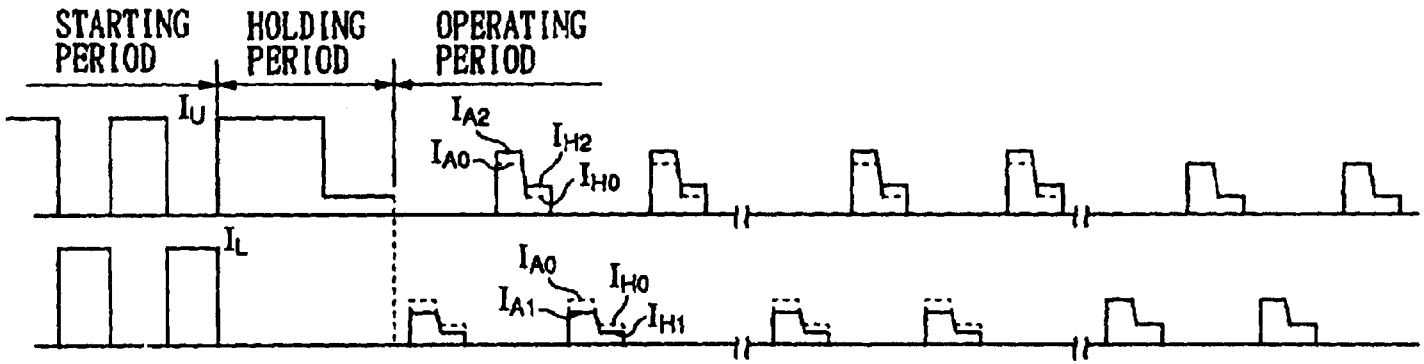
FIG. 24A UPPER COIL INSTRUCTION CURRENT
FIG. 24B LOWER COIL INSTRUCTION CURRENT

SOLENOID VALVE DEVICE

BACKGROUND OF THE INVENTION

1. Field of the Invention

The present invention relates to a solenoid valve device, and particularly to a solenoid valve which actuates an engine valve by an armature attracted by an electromagnet.

2. Description of the Related Art

Conventionally, as disclosed in Japanese Laid-Open Patent Application No. 7-332044, there is known a solenoid valve having an engine valve which functions as an intake valve or an exhaust valve of an internal combustion engine. In this solenoid valve, an armature is connected to the engine valve, and electromagnets are disposed above and below the armature, respectively. The electromagnets exert electromagnetic forces on the armature in a valve-closing direction and a valve-opening direction, respectively. The engine valve is so constructed that it is seated on a valve seat provided to a cylinder head of the engine when the armature is in contact with the electromagnet for closing. Thus, according to the above-mentioned conventional solenoid valve, the engine valve can be moved between a fully opened position and a fully closed position by alternately energizing the electromagnets.

Generally, the cylinder head of the engine is heated to a high temperature in association with combustion in a combustion chamber. Thus, the engine valve is also heated to a high temperature by heat transferred from the cylinder head. In this case, the cylinder head and the engine valve thermally expand to different extents due to a difference in a thermal capacity and a thermal expansion coefficient. If the engine valve thermally expands to a greater extent than the cylinder head, the engine valve may not be seated on the valve seat when the armature is in contact with the electromagnet for closing. In this case, a clearance is generated between the engine valve and the valve seat. Similarly, when the valve seat or the engine valve is worn away, the engine valve may not be seated on the valve seat.

SUMMARY OF THE INVENTION

It is a first object of the present invention to provide a solenoid valve device which can positively actuate an engine valve between a fully closed position and a fully opened position without formation of a clearance between the engine valve and an armature.

It is a second object of the present invention to properly control a current supplied to an electromagnet of the solenoid valve device.

The first object of the present invention can be achieved by a solenoid valve device, comprising:

- an engine valve which can move in an axial direction thereof;
- an armature which moves with the engine valve;
- an electromagnet which attracts the engine valve so that the engine valve moves in the axial direction; and
- a zero-lash adjuster mechanism which is interposed between the engine valve and the armature.

In this invention, the zero-lash adjuster mechanism is interposed between the engine valve and the armature. Thus, a change in a spacing between the engine valve and the armature can be compensated for by the zero-lash adjuster mechanism so that formation of a clearance between the engine valve can be prevented. Therefore, according to this invention, it is possible to positively actuate the engine valve while preventing formation of a clearance between the armature and the engine valve. When there is no clearance between the armature and the engine valve, the armature does not impact on the engine valve when the engine valve is actuated. Thus, according to the present invention, it is also possible to reduce an operating sound of the solenoid valve.

In this case, the zero-lash adjuster mechanism may be a displacement-compensating mechanism which can expand in accordance with an increase in a spacing between the engine valve and the armature.

In this invention, an increase in the spacing between the engine valve and the armature can be compensated for by an expansion of the zero-lash adjuster mechanism. Thus, formation of a clearance between the engine valve can be prevented irrespective of a change in the spacing therebetween. Therefore, according to this invention, it is possible to positively actuate the engine valve while reducing an operating sound of the solenoid valve device.

In this case, the displacement-compensating mechanism may be constituted so that it can expand when the engine valve is in a closed position.

In this invention, the displacement-compensating mechanism can expand when the engine valve is in a closed position. A change in a spacing between the engine valve and the armature is generated when the engine valve reaches a closed position. Thus, formation of a clearance between the engine valve and the armature can be effectively prevented by the displacement-compensating mechanism expanding when the engine valve is in a closed position.

In the solenoid valve device of the present invention, at least part of the displacement-compensating mechanism may be disposed inside the electromagnet.

In this invention, since at least a part of the displacement-compensating mechanism is disposed inside the electromagnet, a total height of the solenoid valve device need not be enlarged by a full height of the displacement-compensating mechanism. Thus, according to this invention, it is possible to reduce the total height of the solenoid valve device.

Additionally, in the solenoid valve device of the present invention, the zero-lash adjuster mechanism may comprise:

- a displacement-compensating mechanism which can expand when no compressing force is exerted thereon;
- a swing arm which is connected to one end of the displacement-compensating mechanism so that the swing arm can swing around the one end and is in contact with both the armature and the engine valve so that the armature moves in a valve-closing direction when the displacement-compensating mechanism expands.

In this invention, in a state where the engine valve is opened, the armature exerts a force on the swing arm in the valve-opening direction. Since the swing arm is in contact with both the armature and the engine valve so that the armature moves in the valve-closing direction when the displacement-compensating mechanism expands, the force exerted on the swing arm in the valve-opening direction by the armature is transmitted to the displacement-compensating mechanism as a compressing force. In this case, the displacement-compensating mechanism is not allowed.

On the other hand, in a state where the engine valve is closed, the armature does not exert a force on the swing arm in the valve-opening direction. In this case, the displacement-compensating mechanism is allowed to expand since no compressing force is exerted thereon. Thus, when a spacing between the engine valve and the armature increases, that is, when the armature shifts in the valve-closing direction relative to the engine valve, in a state where the engine valve is closed, the displacement-compensating mechanism expands so that the swing arm swings so as to maintain a state in which the swing arm is in contact with both the armature and the engine valve.

In this way, formation of a clearance between the engine valve and the armature can be prevented. Additionally, since only the swing arm moves in accordance of a movement of the engine valve and the displacement-compensating mechanism is maintained still, a mass of a movable part of the solenoid valve device can be reduced. Thus, according to this invention, it is possible to improve a response of the solenoid valve device.

Additionally, the displacement-compensating mechanism may be a hydraulic zero-lash adjuster which can expand by being supplied with an oil pressure.

In this case, the solenoid valve device may further comprise an oil pressure supplying mechanism for supplying an oil pressure to the hydraulic zero-lash adjuster when the engine valve is closed.

In this invention, in a state where the engine valve is closed, an oil pressure in the hydraulic zero-lash adjuster is maintained to be relatively low since no compressing force is exerted thereon. Thus, by supplying an oil pressure to the hydraulic zero-lash adjuster in such a state, it is possible to reduce a required oil pressure to be supplied to the hydraulic zero-lash adjuster.

The above-mentioned second object of the present invention can be achieved by the solenoid valve device further comprising:

- a current source which supplies a current to the electromagnet;
- a current setting part which sets the current supplied to the electromagnet by the current source to be a value which is different from a value used in a regular situation for a predetermined period after the hydraulic zero-lash adjuster starts being supplied with an oil pressure.

In this invention, immediately after the hydraulic zero-lash adjuster starts being supplied with an oil pressure, the hydraulic zero-lash adjuster does not sufficiently expand. In this case, a position of the armature is shifted toward the engine valve as compared to a regular state (that is, a state in which the hydraulic zero-lash adjuster has expanded so as to cancel a clearance between the engine valve and the armature). On the other hand, a current to be supplied to the electromagnet to exert a required electromagnetic force on the armature changes in accordance with a distance between the armature and the electromagnet. Thus, according to this invention, it is possible to exert a proper electromagnetic force on the armature by setting a current supplied to the electromagnet to be a value which is different from a value used in a regular situation for a predetermined period after the hydraulic zero-lash adjuster starts being supplied with an oil pressure.

The above-mentioned second object of the present invention can also be achieved by a controller for controlling the solenoid valve device comprising:

- a current source which supplies a current to the electromagnet;
- a relative position detector which detects a value which is related to a relative position of the armature and the electromagnet; and
- a current setting part which sets the current supplied to the electromagnet by the current source in accordance with the value detected by the relative position detector.

In this invention, a current to be supplied to the electromagnet is set in accordance with a distance between the armature and the electromagnet. Thus, according to this invention, since the current supplied to the electromagnet is set in accordance with a value related to a relative position of the armature and the electromagnet, a proper force can be exerted on the armature so that the engine valve can be positively actuated.

In this case, the value related to the relative position of the armature and the electromagnet may be a time which has elapsed after the hydraulic zero-lash adjuster stops being supplied with an oil pressure until the hydraulic zero-lash adjuster starts being supplied with an oil pressure.

In this invention, in a state where the hydraulic zero-lash adjuster is supplied with no oil pressure, the hydraulic zero-lash adjuster gradually contracts with a passage of time since oil leaks out from the hydraulic zero-lash adjuster. The relative position of the armature and the engine valve changes in accordance with the contraction of the hydraulic zero-lash adjuster. Thus, the time which has elapsed after the hydraulic zero-lash adjuster stops being supplied with an oil pressure until the hydraulic zero-lash adjuster starts being supplied with an oil pressure is related to the relative position of the engine valve and the armature.

Additionally, the value related to the relative position of the armature and the electromagnet may be an oil pressure which is supplied to the hydraulic zero-lash adjuster.

In this invention, an amount of expansion of the hydraulic zero-lash adjuster changes in accordance with an oil pressure supplied to the hydraulic zero-lash adjuster. The relative position of the armature and the engine valve changes in accordance with the contraction of the hydraulic zero-lash adjuster, as mentioned above. Thus, an oil pressure which is supplied to the hydraulic zero-lash adjuster is related to a relative position of the armature and the electromagnet.

The solenoid valve device may further comprise a failure detector which detects a failure in a system for supplying an oil pressure to the hydraulic zero-lash adjuster, wherein the value related to the relative position of the armature and the electromagnet is related to the failure detected by the failure detector.

In this invention, when a failure has occurred in the system for supplying an oil pressure to the hydraulic zero-lash adjuster, the oil pressure supplied to the hydraulic zero-lash adjuster decreases. An amount of expansion of the hydraulic zero-lash adjuster changes in accordance with the oil pressure supplied to the hydraulic zero-lash adjuster and a relative position of the armature and the electromagnet changes in accordance with an amount of expansion of the hydraulic zero-lash adjuster. Thus, the value related to a relative position of the armature and the electromagnet can be related to the failure in the system for supplying an oil pressure to the hydraulic zero-lash adjuster.

Other objects and further features of the present invention will be apparent from the following detailed description when read in conjunction with the accompanying drawings.

BRIEF DESCRIPTION OF THE DRAWINGS

FIGS. 24A and 24B are diagrams showing instruction currents supplied to the upper coil and the lower coil, respectively, in a sixth embodiment of the present invention;

DESCRIPTION OF THE PREFERRED EMBODIMENTS

Figure 1:
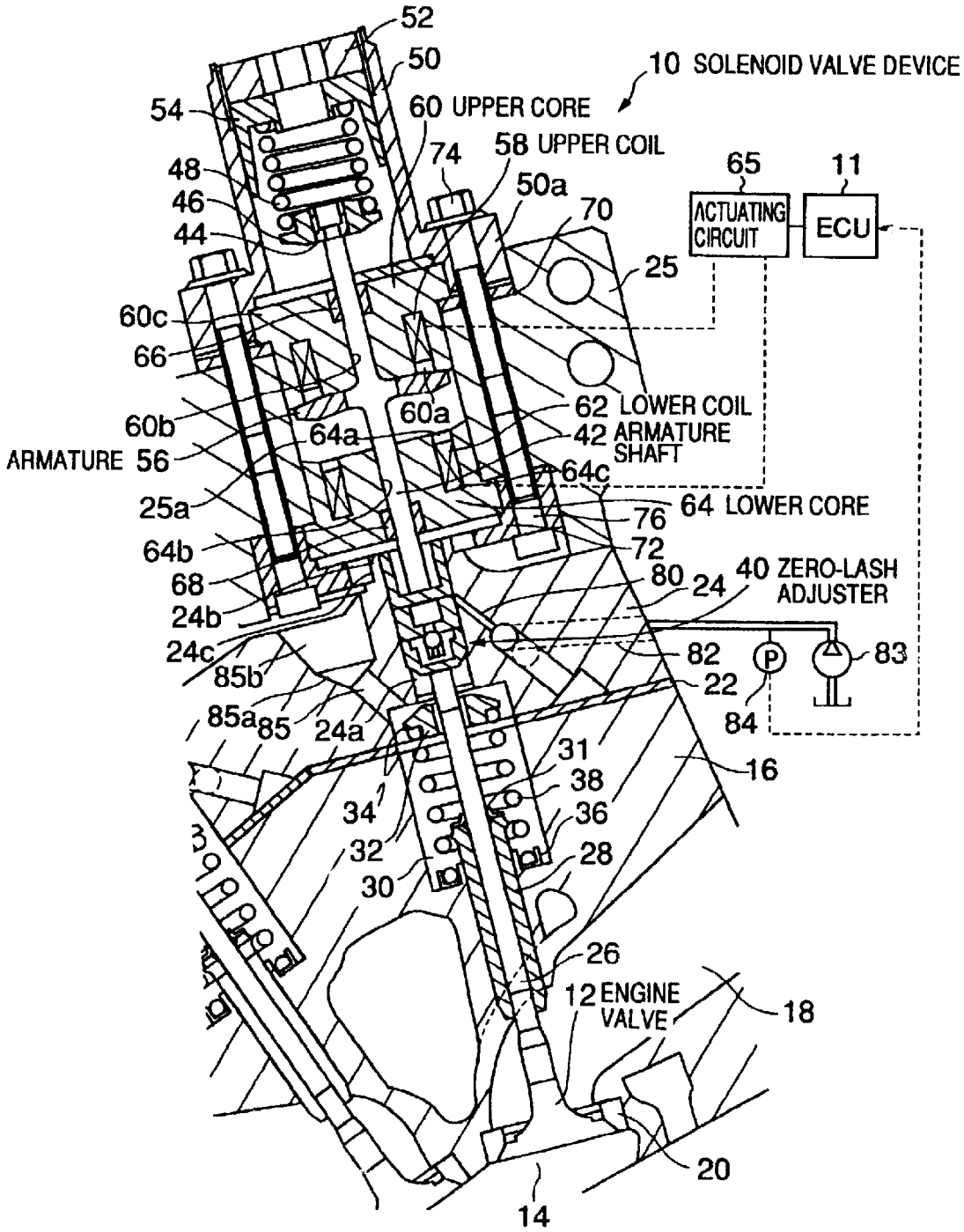
FIG. 1 is a diagram showing a cross section of a solenoid valve device according to a first embodiment of the present invention.

FIG. 1 is a diagram showing a cross section of a solenoid valve device 10 according to a first embodiment of the present invention. The solenoid valve device 10 of the present embodiment is provided to each of intake valves and exhaust valves of an internal combustion engine. The solenoid valve device 10 is controlled by an electronic control unit (hereinafter referred to as an ECU) 11.

As shown in FIG. 1, the solenoid valve device 10 has an engine valve 12 which functions as an intake valve or an exhaust valve. The engine valve 12 is disposed in a lower head 16 so that the engine valve 12 is exposed in a combustion chamber 14 of the engine. A port 18 is formed in the lower head 16. An opening part of the port 18 into the combustion chamber 14 is provided with a valve seat 20 associated with the engine valve 12. The port 18 communicates with the combustion chamber 14 when the engine valve 12 is released from the valve seat 20, and the port 16 is disconnected from the combustion chamber 14 when the engine valve 12 is seated on the valve seat 20.

A cylinder head spacer 24 is provided on a top of the lower head 16 via a thermal insulation plate 22. The thermal insulation plate 22 is a sheet-like member formed from a thermally insulating material such as Bakelite, and functions to prevent heat generated in the combustion chamber 14 from being transferred to the cylinder head spacer 24. An upper head 25 is provided on a top of the cylinder head spacer 24.

The engine valve 12 comprises a valve shaft 26 extending upwardly. The valve shaft 26 is guided by a valve guide 28 so that the valve shaft 26 can move in an axial direction. The valve guide 28 is held in the lower head 16. The lower head 16 is provided with a spring containing space 30 which is cylindrically formed and surrounds a substantially upper-half part of the valve shaft 26. An upper end part of the valve guide 28 is exposed in the spring containing space 30. A valve stem seal 31 is mounted on an upper end of the valve guide 28.

A cotter 32 is mounted on the valve shaft 26 at a position near an upper end thereof. The cotter 32 is a substantially cylindrical member having a taper-shaped outer surface whose diameter increases toward an upward direction. A projection is formed on an inner surface of the cotter 32. The projection is fitted into a recess formed on a surface of the valve shaft 26. A lower retainer 34 is fitted around the cotter 32.

A spring seat 36 is disposed on a bottom face of the spring containing space 30. A lower spring 38 is disposed between the spring seat 36 and the lower retainer 34. The lower spring 38 exerts a resilient force on the lower retainer 34 so as to push the engine valve 12 in an upward direction, that is, in a direction in which the engine valve 12 approaches the valve seat 20. In this specification, an upward direction, that is, a direction in which the engine valve 12 approaches the valve seat 20 may also be referred to as a valve-closing direction. Additionally, a downward direction, that is, a direction in which the engine valve 12 moves away from the valve seat 20 may also be referred to as a valve-closing direction.

An armature shaft 42 is disposed coaxially with the valve shaft 26. A zero-lash adjuster 40 is interposed between the armature shaft 42 and the valve shaft 26. A detailed description of the zero-lash adjuster 40 will be given later.

A cotter 44 is mounted on an upper end part of the armature shaft 42. The cotter 44 has a structure which is symmetric to the cotter 32 in the axial direction. An upper retainer 46 is fitted around the cotter 44. A lower end of an upper spring 48 abuts on a top surface of the upper retainer 46. A cylindrical upper case 50 is provided around the upper spring 48. An adjuster bolt 52 is screwed on a top part of the upper case 50. An upper end of the upper spring 48 is supported by a spring guide 54 which is interposed between the adjuster bolt 52 and the upper spring 48. The upper spring 48 pushes the armature shaft 42 via the upper retainer 48 in a downward direction.

An armature 56 is fixed to the armature shaft 42 at a substantially center position in the axial direction. The armature 56 is an annular member which is formed from a soft magnetic material. An upper coil 58 and an upper core 60 are disposed above the armature 56. Additionally, a lower coil 62 and a lower coil 64 are disposed below the armature 56. The upper coil 58 and the lower coil 62 are contained in annular recesses 60*a*, 64*a*, respectively, formed in the upper core 60 and the lower core 64*a*, respectively.

The upper coil 58 and the lower coil 62 are electrically connected to an actuating circuit 65. The actuating circuit 65 supplies instruction currents in accordance with control signals supplied from the ECU 11.

The upper core 60 and the lower core 64 have through holes 60*b* and 64*b*, respectively, which go though the center parts thereof. An upper bush 66 is disposed in an upper end part of the through hole 60*b*. Additionally, a lower bush 68 is disposed in a lower end part of the through hole 64*b*. The armature shaft 42 is guided by the upper bush 66 and the lower bush 68 so that the armature shaft 42 can move in the axial direction. The upper core 60 includes a flange 60*c* formed at an upper end part thereof.

Similarly, the lower core 64 includes a flange 64*c* formed at a lower end part thereof.

A lash-adjuster containing space 24*a* is cylindrically formed in the cylinder head spacer 24. The lash-adjuster containing space 24*a* goes through the cylinder head spacer 24 coaxially with the above-mentioned spring containing space 30. The zero-lash adjuster 40 is supported in the lash-adjuster containing space 24*a*. A raised part 24*b* which is upwardly raised is formed on an upper surface of the cylinder head spacer 24 around an opening part of the lash-adjuster containing space 24*a*. Further, a cylindrical part 24*c* is formed on a top of the raised part 24*b*.

A cylindrical core containing space 25*a* is formed in the upper head 25. The core containing space 25*a* goes through the upper head 25 coaxially with the spring containing space 30 and the lash-adjuster containing space 24*a*. The upper core 60 is inserted into the core containing space 25*a* so that the flange 60*c* abuts on an upper face of the upper head 25 via a shim 70. On the other hand, the lower core 64 is inserted into the core containing space 25*a* so that the flange 64*c* abuts on a lower face of the upper head 25. The flange 60*c* of the upper core 60 is supported between the upper head 25 and a flange 50*a* formed at a lower end of the upper case 50. Additionally, the flange 64*c* of the lower core 64 is supported between the upper head 25 and a lower bracket 72.

The upper case 50 and the lower bracket 72 are fixed to the upper head 25 by fixing bolts 74, 76 so that the upper core 60 and the lower core 64 are fixed with a predetermined spacing being formed therebetween. In such a state, a predetermined clearance is provided between the raised part 24*b* of the cylinder head spacer 24 and a lower surface of the lower core 64. A neutral position of the armature 56 is adjusted by the above-mentioned adjuster bolt 52 so as to be at a central position between the upper core 60 and the lower core 64.

Oil supply passages 80 and 82 are formed in the cylinder head spacer 24. The oil supply passages 80 and 82 are connected to each other. Pressurized oil is supplied to the oil supply passage 82 from an oil pump 83. The oil pump 83 is actuated by, for example, using a rotation of an output shaft of the engine as a power source. The oil supply passage 80 opens on an inner wall of the lash-adjuster containing space 24*a* at a predetermined position.

A pressure sensor 84 is provided to a passage connecting the oil pump 83 and the oil supply passage 82. The pressure sensor 84 delivers a signal to the ECU 11 in accordance with an oil pressure in the passage, that is, an oil pressure which is supplied to the zero-lash adjuster 40. Hereinafter, this oil pressure is referred to as a supplied oil pressure P. The ECU 11 detects the supplied oil pressure P based on the signal delivered by the pressure sensor 84. The pressure sensor 84 may be provided to the oil supply passage 82 or 80.

An oil collecting passage 85 is also formed in the cylinder head spacer 24. An upper end of the oil collecting passage 85 opens on an upper surface of the cylinder head spacer 24 at a part near the raised part 24*b*, and a lower end of the oil collecting passage 85 opens into the spring containing space 30. The upper end part of the oil collecting passage 85 is constituted by drilled holes 85*a*, 85*b* so that the oil collecting passage 85 has a large opening area on the upper surface of the cylinder head spacer 24. The oil collecting passage 85 functions to collect oil which has flown out above the zero-lash adjuster 40 and to supply the collected oil into the spring containing space 30 so as to provide lubrication of the valve shaft 26.

Next, a description will be given of an operation of the solenoid valve device 10.

When a current is supplied to the upper coil 58, an electromagnetic force is exerted on the armature 56 in a direction toward the upper core 60. Thus, the armature 56 moves upwardly against the resilient force of the upper spring 48 until the armature 56 comes into contact with the upper core 60, as shown in FIG. 1. In this state, the engine valve 12 is seated on the valve seat 20. Hereinafter, a position of the armature 56 or the engine valve 12 in the above-mentioned state where the armature is in contact with the upper core 60 is referred to as a fully closed position.

When the current to the upper coil 58 is cut off in the state where the engine valve 12 is in the fully closed position, an electromagnetic force which is required to maintain the armature 56 in the fully closed position disappears. In this case, the armature shaft 42 starts moving downwardly together with the engine valve 12 due to the resilient force of the upper spring 48. Thus, the engine valve 12 is released from the valve seat 20. When a current is supplied to the lower coil 62 at a time when the armature shaft 42 reaches a predetermined position, an electromagnetic force is generated which pushes the armature 56 toward the lower core 64.

When the above electromagnetic force is exerted on the armature 56, the armature 56 moves further downwardly against the resilient force of the lower spring 38 until the armature 56 comes into contact with the lower core 64. Hereinafter, a position of the armature 56 or the engine valve 12 in a state where the armature 56 is in contact with the lower core 64 is referred to as a fully opened position. When the current to the lower coil 62 is cut off in this state, an electromagnetic force which is required to maintain the armature 56 in the fully opened state disappears. In this case, the armature shaft 42 starts moving upwardly together with the engine valve 12 by the resilient force of the lower spring 38.

When a current is supplied to the upper coil 58 at a time when the armature shaft 42 reaches a predetermined position, the armature 56 moves upwardly by an electromagnetic force generated by the upper coil 58 until the armature 56 comes into contact with the upper core 60. In the state where the armature 56 is in contact with the upper core 60, the engine valve 12 is seated on the valve seat 20, as mentioned above.

In this way, according to the present embodiment, it is possible to actuate the engine valve 12 between the fully closed position and the fully opened position by alternately supplying currents to the upper coil 58 and the lower coil 62 at proper timings.

As mentioned above, the engine valve 12 is exposed in the combustion chamber 14 of the engine. Thus, the engine valve 12 is rapidly heated by high heat in the combustion chamber 14 being directly transferred thereto. On the other hand, since the lower head 16 has a relatively large thermal capacity, the lower head 16 is moderately heated as compared to the engine valve 12. Accordingly, a temperature of the engine valve 12 becomes higher than a temperature of the lower head 16, and as a result, the engine valve 12 thermally expands to a greater extent than the lower head 16.

In such a situation, if the engine valve 12 and the armature shaft 42 are rigidly connected to each other in the fully closed state, the engine valve 12 is prevented from expanding in the valve-closing direction by the armature shaft 42, and, thus, the engine valve 12 expands in the valve-opening direction. That is, the engine valve 12 moves in the valve-opening direction with respect to the valve seat 20, and a clearance is formed between the engine valve 12 and the valve seat 20. Similarly, when contacting surfaces of the engine valve 12 and the valve seat 20 are worn, a clearance is formed between the engine valve 12 and the valve seat 20. In this way, if the engine valve 12 and the armature shaft 42 are rigidly connected to each other, it may not be possible to fully close the engine valve 12 due to a difference in the thermal expansion between the engine valve 12 and the lower head 16 or wear of the engine valve 12 and the valve seat 20.

The above problem can be avoided by providing a clearance between the armature shaft 42 and the valve shaft 26 in a state where the armature 56 is in contact with the upper core 60 and the engine valve 12 is seated on the valve seat 20, that is, in a state where the armature 56 and the engine valve 12 are in the fully closed position. This clearance is generally called a tappet clearance. However, when the tappet clearance is provided, an operating sound of the solenoid valve device 10 becomes large for the following reason.

That is, when the engine valve 12 moves from the fully closed position to the fully opened position, a first impact sound is generated when the armature shaft 42 impacts on the valve shaft 26, and then a second impact sound is generated when armature 56 impacts on the lower core 64. On the other hand, when the engine valve 12 moves from the fully opened position to the fully closed position, a first impact sound is generated when the engine valve 12 impacts on the valve seat 20, and then a second impact sound is generated when the armature 56 impacts or on the upper core 60. In this way, impact sounds are generated twice in each case, resulting in an increased operating sound of the solenoid valve device 10.

Figure 2:
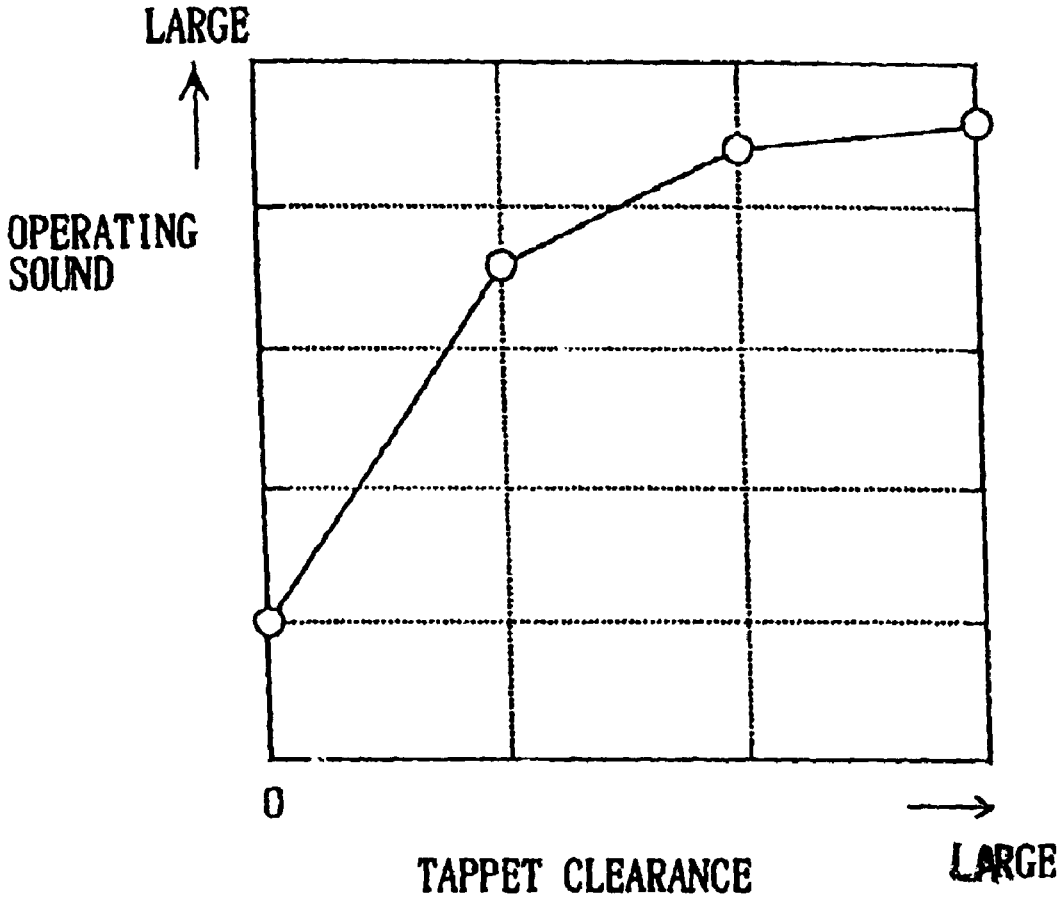
FIG. 2 is a diagram showing a relationship between a tappet clearance and an operating sound of the solenoid valve device.

FIG. 2 is a diagram showing a relationship between the tappet clearance and an operating sound of the solenoid valve device 10. As shown in FIG. 2, a larger operating sound is generated for a larger tappet clearance. This is due to a fact that, as the tappet clearance becomes larger, a speed with which the armature shaft 42 impacts on the valve shaft 26 becomes higher and thus a larger impact sound is generated. Therefore, if a larger tappet clearance is provided so as to compensate for a larger difference in the thermal expansion between the engine valve 12 and the lower head 16 or larger wear of the engine valve 12 or the valve seat 20, the operating sound of the solenoid valve device 10 becomes larger.

For the above-mentioned reason, it is not desirable to provide a tappet clearance between the valve shaft 26 and the armature shaft 42 in view of reducing the operating sound of the solenoid valve device.

In the solenoid valve device 10 of the present embodiment, the zero-lash adjuster 40 which is interposed between the armature shaft 42 and the valve shaft 26 functions to positively move the engine valve 12 to the fully closed position irrespective of the above-mentioned difference in the thermal expansion of the engine valve 12 and the lower head 16 or wear of the engine valve 12 and the valve seat 20, without causing an increase in the operating sound of the solenoid valve device 10. Now, a detailed description will be given of the zero-lash adjuster 40.

Figure 3:
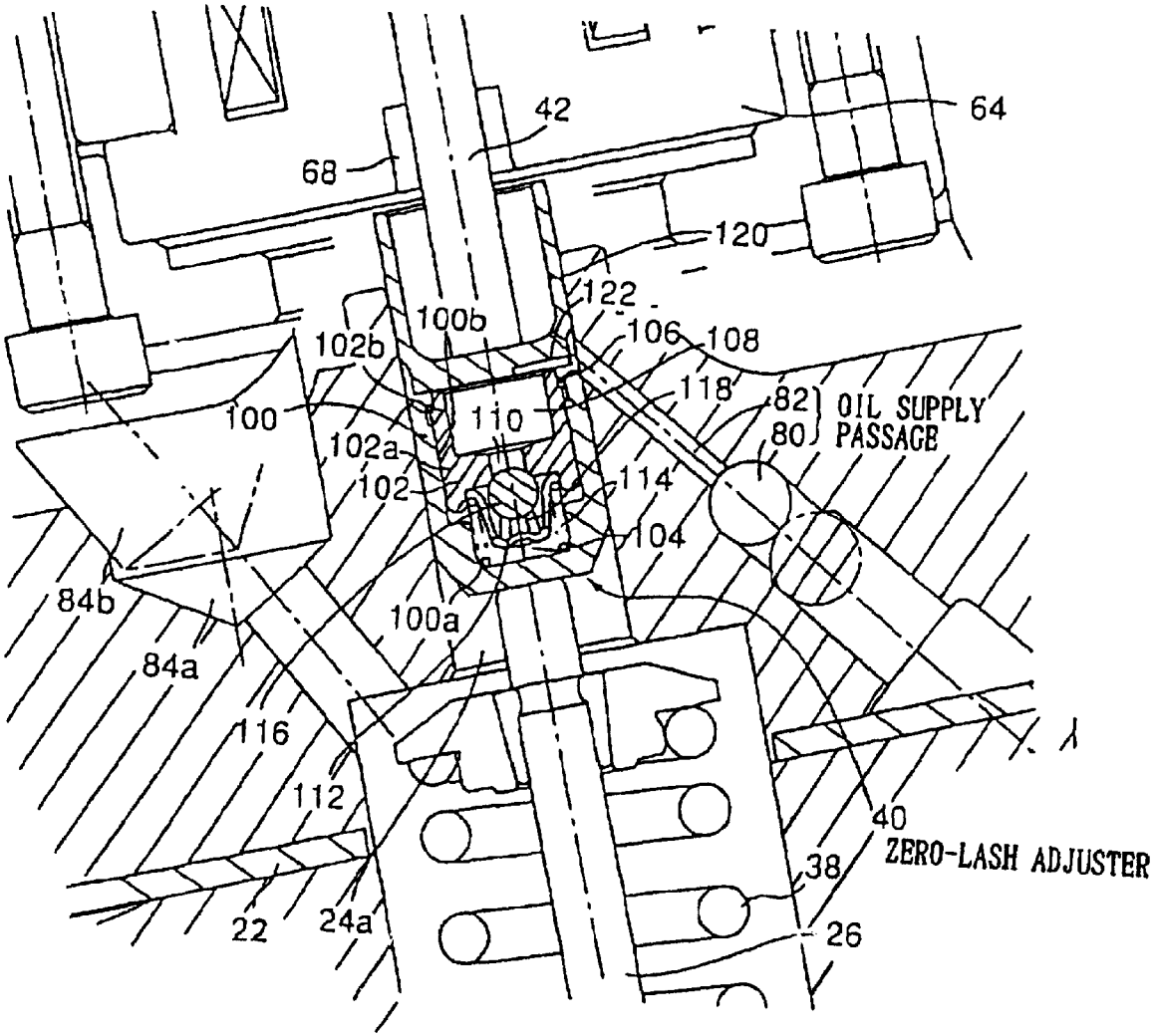
FIG. 3 is a diagram showing an enlarged cross section of a zero-lash adjuster and neighboring parts thereof.

FIG. 3 is a diagram showing an enlarged cross section of the zero-lash adjuster 40 and neighboring parts thereof. The state shown in FIG. 3 is achieved when the armature 56 is in contact with the upper core 60.

As shown in FIG. 3, the zero-lash adjuster 40 includes a plunger body 100. The plunger body 100 is a cylindrical member with a lower end thereof being closed. The plunger body 100 is supported in the lash-adjuster containing space 24*a* so that it can slide in the axial direction. A spring retaining part 100*a* is formed inside the plunger body 100 in a lower part thereof. Additionally, a plunger retaining part 100*b* having a larger diameter than that of the spring retaining part 100*a* is formed inside the plunger body 100 above the spring retaining part 100*a*.

A plunger 102 is supported in the plunger retaining part 100*b* so that it can slide in the axial direction. A hydraulic pressure chamber 104 is defined by a bottom surface of the plunger 102 and a bottom surface of the spring retaining part 100*a*.

The plunger 102 has a large-diameter part 102*a* which slides on an inner surface of the plunger retaining part 100*b*. Additionally, the plunger 102 has a small-diameter part 102*b* provided at an upper end thereof. A stopper ring 106 is pressed in an upper end of the plunger retaining space 100*b*. The stopper ring 106 has a diameter which is smaller than a diameter of the large-diameter part 102*a* of the plunger 102. Therefore, an upward movement of the plunger 102 inside the plunger body 100 is limited by the stopper ring 106 being engaged with a step between the large-diameter part 102*a* and the small-diameter part 102*b*. The plunger 102 also has a reservoir 108 which outwardly opens and a connecting passage 110 which connects the reservoir 108 and the hydraulic pressure chamber 104.

A retainer 112 and a plunger spring 114 are disposed in the hydraulic chamber 104. The plunger spring 114 pushes the plunger 102 in an upward direction via the retainer 112. A check ball 116 and a check ball spring 118 are disposed inside the retainer 112. The check ball spring 118 pushes the check ball 116 toward an opening of the connecting passage 110. The check ball 116 and the check ball spring 118 function as a check valve which opens only when a pressure in the hydraulic pressure chamber 104 is lower than a pressure in the reservoir 108 by a predetermined value.

The zero-lash adjuster 40 also includes a reservoir cap 120. The reservoir cap 120 is a substantially cylindrical member with a lower end thereof being closed. The reservoir cap 120 is disposed inside the lash-adjuster containing space 24*a* so that it can slide in the axial direction with an outer bottom face of the reservoir cap 120 being in contact with a upper end face of the plunger 102. A part of the outer bottom face of the reservoir cap 120 is cut off to form an overflow recess 122. The overflow recess 122 always communicates with the reservoir 108.

A lower end face of the armature shaft 42 is in contact with an inner bottom face of the reservoir cap 120. On the other hand, an upper end face of the valve shaft 26 is in contact with an outer bottom face of the plunger body 100. The above-mentioned oil supply passage 82 opens on an internal wall of the lash-adjuster containing space 24*a* so that the oil supply passage 82 communicates with the overflow recess 122 in a state shown in FIG. 3 (that is, a state where the armature 56 is in contact with the upper core 60).

When the upper coil 58 is de-energized in the state shown in FIG. 3, an actuating force is exerted on the armature shaft 42 in the valve-opening direction, as mentioned above. This force is transmitted to the plunger 102 via the reservoir cap 120. When the force transmitted to the plunger 102 exceeds a resilient force 114 of the plunger spring 114, oil contained in the hydraulic pressure chamber 104 is pressurized by the plunger 102 being pressed in a downward direction. Thus, a pressure in the hydraulic pressure chamber 104 becomes higher than a pressure in the reservoir 108, and, as a result, the connecting passage 110 is closed by a check ball 116. When the connecting passage 110 is thus closed, a flow of oil between the hydraulic pressure chamber 104 and the reservoir 108 is prohibited. In this case, the actuating force is transmitted to the plunger body 100 via the hydraulic pressure chamber 104, and, thus, the zero-lash adjuster 40 moves in the valve-opening direction together with the armature shaft 42 and the engine valve 12.

In a process in which the zero-lash adjuster 40 moves in the valve-opening direction, oil in the hydraulic pressure chamber 104 gradually leaks out through the sliding surface between the plunger 102 and the plunger body 100. Thus, the zero-lash adjuster 40 slightly contracts in the axial direction in accordance with the leakage of oil.

When the lower coil 62 is de-energized after the armature has come into contact with the lower core 64, the armature 56 starts moving in the valve-closing direction. After the valve 12 is seated on the valve seat 20, a resilient force of the lower spring 38 is no longer exerted on the plunger body 100, while the armature 56 moves in the valve-closing direction by a small distance corresponding to an amount of the contraction of the zero-lash adjuster 40. In this case, the plunger 102 is pushed toward the reservoir cap 120 by a resilient force of the plunger spring 114, and, as a result, a pressure in the hydraulic pressure chamber 104 is decreased. When the pressure in the hydraulic pressure chamber 104 becomes lower than a pressure in the reservoir 108, the hydraulic pressure chamber 104 and the reservoir 108 are connected to each other by the check ball 116 being released from an opening of the connecting passage 110. As mentioned above, when the engine valve 12 is seated on the valve seat 20, the overflow recess 122 communicates with the oil supply passage 82. Thus, when the hydraulic pressure chamber 104 and the reservoir 108 are connected to each other, pressured oil is supplied to the hydraulic pressure chamber 104 from the oil supply passage 82 via the reservoir 108. In this case, the plunger 102 moves in an upward direction until the armature 56 comes into contact with the upper core 60, with a state where the plunger 102 is in contact with the reservoir cap 120 being maintained.

As mentioned above, the zero-lash adjuster is a mechanism having the following function:

- in a state where the engine valve 12 is released from the valve seat 20 and thus a force is exerted on the plunger body 100 in the valve opening direction by the reservoir cap 120 as a reaction force to the resilient force of the lower spring 38, that is, in a state where an axial compressing force is exerted on the zero-lash adjuster 40, the zero-lash adjuster moves together with the armature shaft 42 and the engine valve 12 while gradually contracting; and
- in a state where the engine valve 12 is seated on the valve seat 20 and thus no compressing force is exerted on the zero-lash adjuster 40, the plunger 102 is allowed to move relative to the plunger body 100 so that the zero-lash adjuster 40 axially expands.

According to this function of the zero-lash adjuster 40, it is possible to prevent a clearance from being formed between the valve shaft 26 and the armature shaft 42 when the engine valve 12 is in the fully closed position.

It should be noted that a change in a distance between the valve shaft 26 and the armature shaft 42 due to a difference in the thermal expansion between the engine valve 12 and the lower head 16 or wear of the engine valve 12 and the valve seat 20 occurs slowly. Therefore, an amount of the change in the distance between the valve shaft 26 and the armature shaft 42 is quite small during a period in which the engine valve 12 moves back and forth between the fully closed position and the fully opened position. Such a small change in the distance can be compensated for by the zero-lash adjuster 40, which has been slightly contracted when the engine valve 12 is opened, expanding when the engine valve 12 has returned to the fully-closed position.

Thus, according to the solenoid valve device 10 of the present embodiment, it is possible to positively actuate the engine valve 12 between the fully closed position and the fully opened position without formation of a clearance between the armature shaft 42 and the valve shaft 26.

Figure 4:
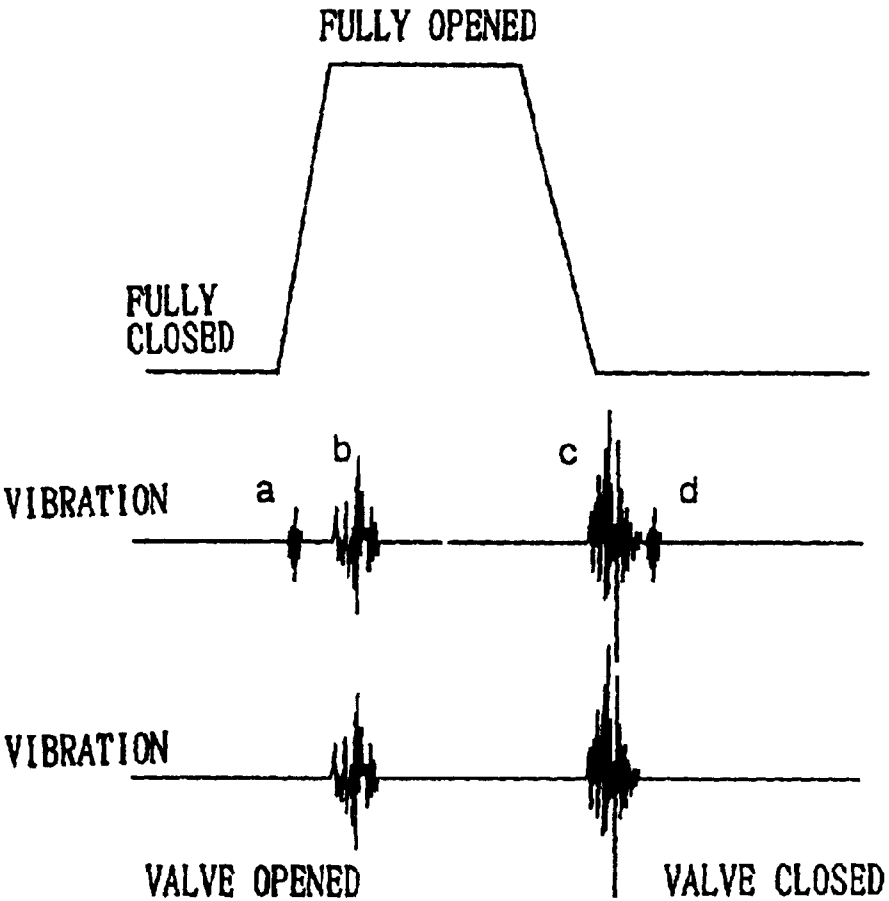
FIG. 4A is a diagram showing a displacement of the engine valve moving between a fully closed position and a fully opened position.
FIGS. 4B and 4C are diagrams showing waveforms of vibrations generated in association with the movement of the engine valve in a case where the zero-lash adjuster is not provided and in a case where the zero-lash adjuster is provided, respectively.

FIG. 4A is a diagram showing a displacement of the engine valve moving between a fully closed position and a fully opened position, and FIGS. 4B and 4C are diagrams showing waveforms of vibrations generated in association with the movement of the engine valve 12 in a case where the zero-lash adjuster 40 is not provided (that is, in a case where a tappet clearance is provided) and in a case where the zero- lash adjuster 40 is provided (that is, in a case of the solenoid valve device 10 of the present embodiment), respectively.

As shown in FIG. 4B, in a case where the zero-lash adjuster 40 is not provided, a vibration due to an impact between the armature shaft 42 and the valve shaft 26 (marked with "a") and a vibration due to an impact between the armature 56 and the lower core 64 (marked with "b") occur when the engine valve 12 moves in the valve-opening direction. Additionally, a vibration due to an impact between the engine valve 12 and the valve seat 20 (marked with "c") and a vibration due to an impact between the armature 56 and the upper core 60 (marked with "d") occur when the engine valve 12 moves in the valve-closing direction.

On the contrary, according to the solenoid valve device 10 of the present embodiment, since no clearance exists between the armature shaft 42 and the valve shaft 26, no impact occurs therebetween when the engine valve 12 moves in the valve-opening direction. Additionally, the zero-lashadjuster 40 is designed so that the amount of the contraction due to the leakage of oil when the engine valve 12 is opened is as small as approximately one tenth of a typical value, which is 0.2 to 0.3 mm, for example, of the tappet clearance. Thus, the impact between the engine valve 12 and the valve seat 20 and the impact between the armature 56 and the upper core 60 occur substantially at the same time. For these reasons, a vibration occurs only once in each of the cases where the engine valve 12 is moving in the valve-opening direction and where the engine valve 12 is moving in the valve-closing direction, as shown in FIG. 4C. Thus, according to the present embodiment, it is possible to reduce the operating sound of the solenoid valve device 10 as compared to a case where a tappet clearance is provided.

Additionally, in the present embodiment, oil is supplied to the reservoir 108 and the hydraulic pressure chamber 104 when the armature 56 is in contact with the upper core 60, that is, when the engine valve 12 is in the fully-closed position. When the armature 56 is in contact with the upper core 60, a pressure in the hydraulic pressure chamber 104 becomes low since no force is exerted on the reservoir cap 120 in the valve-opening direction. According to the present embodiment, since oil is supplied to the hydraulic pressure chamber 104 in such a state, it is possible to reduce an oil pressure required to be supplied to the oil supply passages 80, 82 and thus to miniaturize the oil pump 83.

Additionally, in the present embodiment, a clearance between an inner wall of the lash-adjuster containing space 24*a* and the zero-lash adjuster 40 is selected so that the clearance becomes zero in a possible coldest condition. Thus, under a normal temperature, a clearance is formed around the zero-lash adjuster 40 and oil can leak out through the clearance above and below the zero-lash adjuster 40. In the present embodiment, oil which has leaked out above the zero-lash adjuster 40 and accumulated in the reservoir cap 120 provides lubrication between the armature shaft 42 and the lower bush 68. Additionally, oil which has leaked out above the zero-lash adjuster 40 and flown into the spring containing space 30 via the oil collecting passage 85 and oil which has leaked out below the zero-lash adjuster 40 and directly flown into the spring containing space 30 provide lubrication between the valve shaft 26 and the valve guide 28. In this way, it is possible to effectively utilize the oil which has leaked out from the zero-lash adjuster 40 as a lubricant of the armature shaft 42 and the valve shaft 26.

In this connection, since an oil pressure supplied to the zero-lash adjuster 40 can be set to be low as mentioned above, it is possible to reduce an amount of the oil leakage.

In the solenoid valve device 10, if air is mixed into oil in the hydraulic pressure chamber 104, the zero-lash adjuster 40 becomes less rigid by the mixed air being compressed when the hydraulic pressure chamber 104 is pressurized. In order to avoid such a problem, it is necessary to prevent air from being mixed into oil when the solenoid valve device 10 is assembled.

Figure 5:
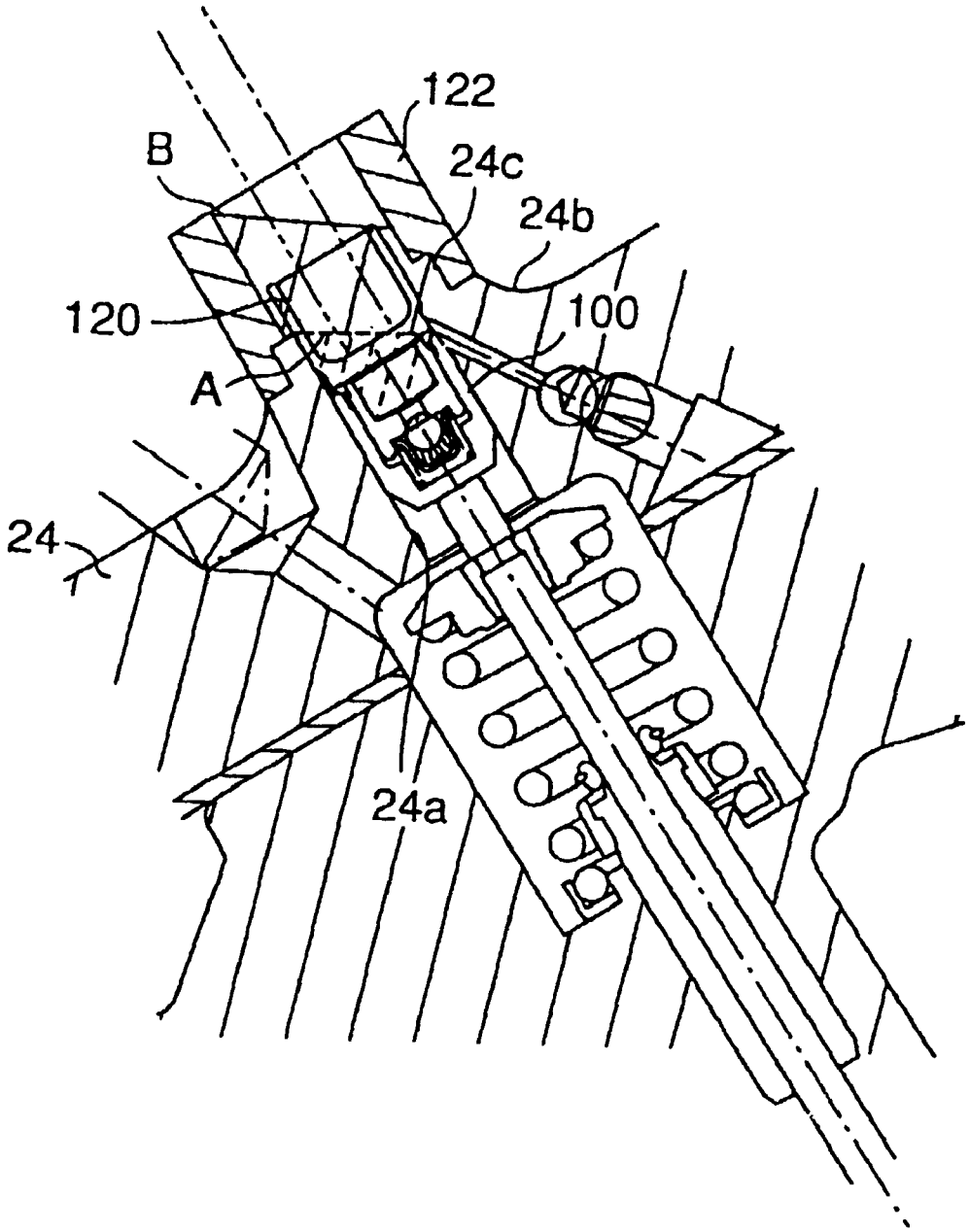
FIG. 5 is a cross-sectional view showing a process of assembling the zero-lash adjuster.

FIG. 5 is a cross-sectional view showing a process of assembling the zero-lash adjuster 40. As shown in FIG. 5, the zero-lash adjuster 40 is assembled by inserting the reservoir cap 120 into the zero-lash-adjuster containing space 24*a* after fitting a cylindrical cap 122 around the cylindrical part 24*c* of the cylinder head spacer 24, inserting the plunger body 100 into the lash-adjuster containing space 24*a*, and filling the lash-adjuster containing space 24*a* with oil.

In this process, since the solenoid valve device 10 is mounted to the engine with the axial direction of the solenoid valve device 10 being inclined with respect to a vertical direction, a surface of the oil filled in the lash-adjuster containing space 24*a* is inclined with respect to a top surface of the cylindrical part 24*c*. Therefore, if the cap 122 is not provided, an opening part of the lash-adjuster containing space 24*a* is exposed to air above a surface of the oil in the lash-adjuster containing space 24*a* which is indicated by a dotted line A in FIG. 5. If the reservoir cap 120 is inserted into the lash-adjuster containing space 24*a* in such a state, air is mixed into the oil via the exposed part.

According to the process shown in FIG. 5, since the cap 122 is provided, the lash-adjuster containing space 24*a* is completely submerged below the surface of the oil which is indicated by a solid line B in FIG. 5. Thus, by inserting the reservoir cap 122 into the lash-adjuster containing space 24*a* in such a state, it is possible to prevent air from being mixed into oil.

Figure 6:
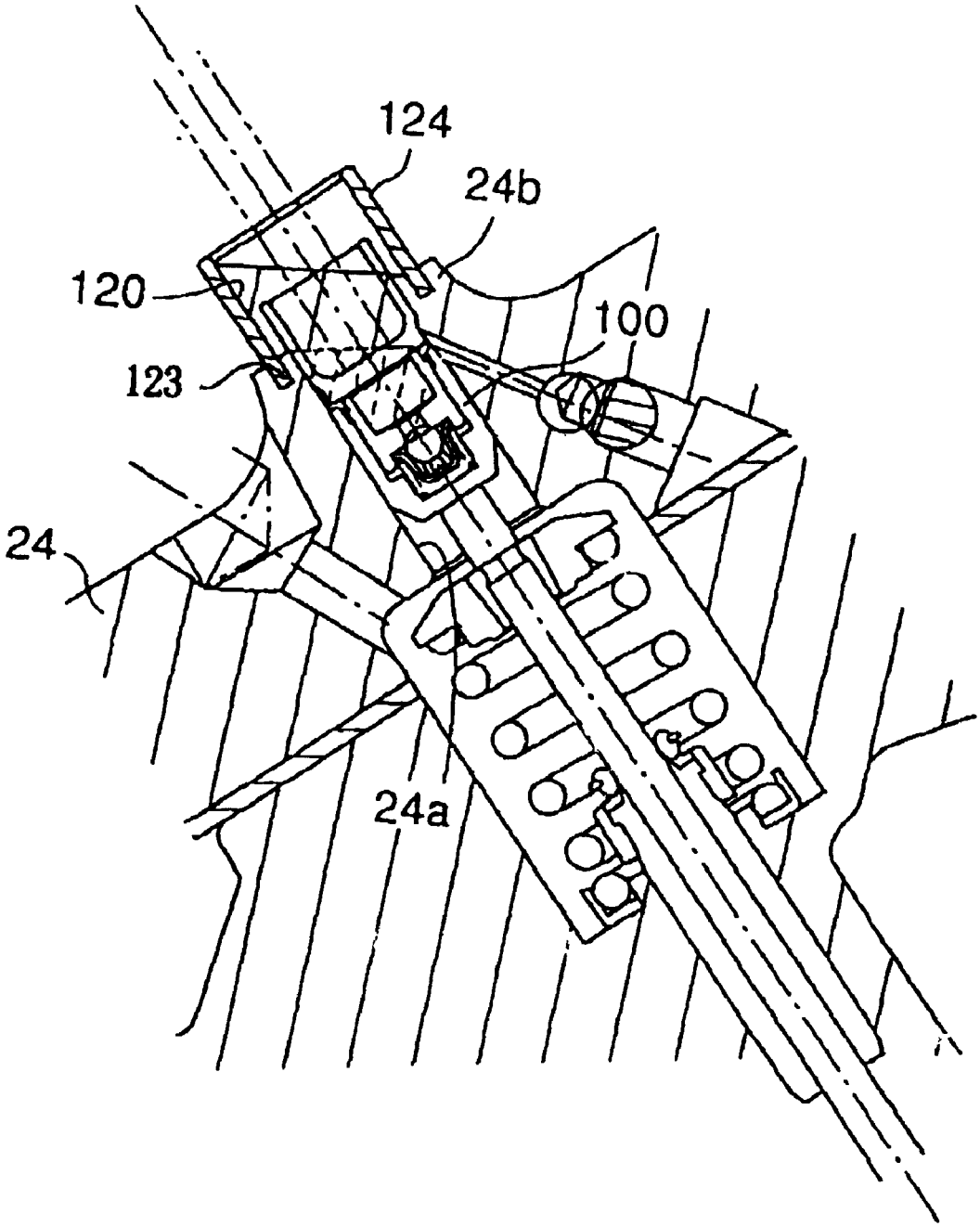
FIG. 6 is a cross-sectional view showing another process of assembling the zero-lash adjuster.

FIG. 6 is a cross-sectional view showing another process of assembling the zero-lash adjuster 40. In the process shown in FIG. 6, an annual recess 123 is formed on a top surface of the raised part 24*b* instead of providing the cylindrical part 24*c*, and a pin ring 124 is fitted into the annual recess 123. According to this process, the reservoir cap 120 can be inserted into the lash-adjuster containing space 24*a* in a state where an opening part of the lash-adjuster containing space 24*a* is submerged below a surface of oil, as a case of the process shown in FIG. 5. Thus, it is possible to prevent air from being mixed into oil.

It should be noted that the cap 122 or the pin ring 124 is removed after the zero-lash adjuster 40 has been assembled by the process shown in FIG. 5 or FIG. 6. Thus, it is possible to prevent an increase in a total height of the cylinder head spacer 24 due to the provision of the cap 122 or the pin ring 124.

As mentioned above, according to the processes shown in FIGS. 5 and 6, it is possible to prevent air from being mixed into oil in the process of assembling the zero-lash adjuster 40. However, when oil supplied to the zero-lash adjuster is heated, air which has been dissolved in the oil may become bubbles and the rigidity of the zero-lash adjuster 40 may be lowered due to the bubbles.

In the present embodiment, since the heat insulating plate 22 is interposed between the lower head 16 and the cylinder head spacer 24, heat in the combustion chamber 16 is not easily transferred to the cylinder head spacer 24. Thus, according to the present embodiment, it is possible to suppress an increase in the temperature of oil in the oil supply passages 80 and 82 and the zero-lash adjuster 40, thereby preventing generation of bubbles in the oil.

Next, a description will be given of a second embodiment of the present invention.

Figure 7:
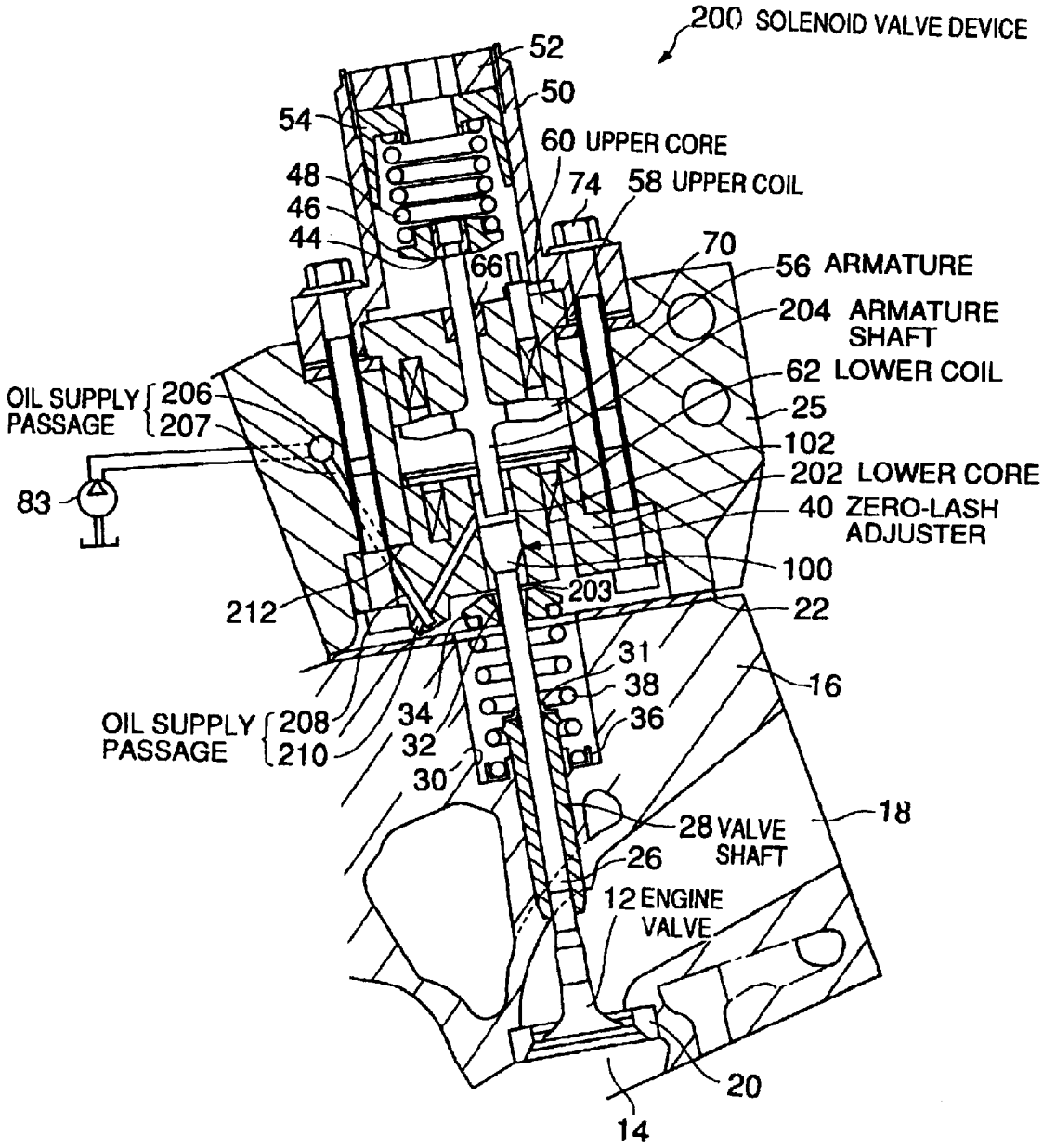
FIG. 7 is a diagram showing cross section of a solenoid valve device of a second embodiment according to the present invention.

FIG. 7 is a diagram showing a cross section of a solenoid valve device 200 of the present embodiment. In FIG. 7, parts that are the same as the parts shown in FIG. 1 are given the same reference numerals, and descriptions thereof will be omitted. As shown in FIG. 7, in the present embodiment, the cylinder head spacer 24 of the first embodiment is omitted and the upper head 25 is mounted on the lower head 16 via the heat insulating plate 22. Additionally, in the present embodiment, the lower core 64 of the first embodiment is replaced by a lower core 202.

The lower core 202 has a lash-adjuster containing hole 203 which axially goes through a center of the lower core 202. The zero-lash adjuster 40 is supported in the lash-adjuster containing hole 203 so that it can slide in the axial direction.

An outer bottom face of the plunger body 100 is in contact with an upper end face of the valve shaft 26. Additionally, an inner bottom face of the reservoir cap 120 is in contact with a lower end face of an armature shaft 204. Since the zero-lash adjuster 40 is disposed inside the lower core 202, the armature shaft 204 has a structure achieved by cutting off a lower end part of the armature shaft 42 of the first embodiment by a length corresponding to an axial length of the zero-lash adjuster 40.

An oil supply passage 206 is provided in the upper head 25 corresponding to each cylinder of the engine. An oil supply passage 207 corresponding to each zero-lash adjuster 40 is connected to the oil supply passage. Oil is supplied to the oil supply passage 206 by the oil pump 83.

Oil supply passages 208 and 210 which are connected to each other are provided in the lower core 202. The oil supply passage 208 is connected to the oil supply passage 207. On the other hand, the oil supply passage 210 opens on an inner wall of the lash-adjuster containing hole 203 so as to be connected to the overflow recess 122 when the engine valve 12 is in the fully closed position. Thus, the zero-lash adjuster 40 is supplied with an oil pressure via the oil supply passages 206, 207, 208, and 210.

An O ring 212 is provided between an upper surface of a flange of the lower core 202 and a lower surface of the upper head 25 so as to surround a connecting portion of the oil supply passages 207 and 208. The O ring 212 functions to prevent oil flowing through the oil supply passages 206, 208 from leaking out.

In the solenoid valve device 200 of the present embodiment, when the engine valve 12 is opened, the zero-lash adjuster 40 slightly contracts with oil leaking out through a sliding surface between the plunger body 100 and the plunger 102, as in the case of the solenoid valve device 10 of the first embodiment. When the engine valve 12 is seated on the valve seat 20, the zero-lash adjuster 40 expands until the armature 56 comes into contact with the upper core 60, being supplied with an oil pressure. Thus, according to the present embodiment, it is possible to positively actuate the engine valve 12 between the fully closed position and the fully opened position without forming a clearance between the engine valve 12 and the armature shaft 204, as in a case of the solenoid valve device 10 of the first embodiment.

Additionally, in the present embodiment, since the zero-lash adjuster 40 is contained inside the lower core 202, a full length of the solenoid valve device 200 is smaller than that of the solenoid valve device 10 of the first embodiment by an axial length of the zero-lash adjuster 40. Thus, according to the present embodiment, it is possible to reduce a total height of the engine while obtaining the above-mentioned effect by the zero-lash adjuster 40.

Further, in the present embodiment, part of oil which has leaked out above the zero-lash adjuster 40 stays on a top surface of the lower core 202 and intervenes between the armature 56 and the lower core 202 when the armature 56 impacts on the lower core 202. Thus, according to the present embodiment, it is possible to damp the impact between the armature 56 and the lower core 202 by viscosity of oil so that an operating sound of the solenoid valve device 200 can be reduced. It should be noted that oil which has leaked out below the zero-lash adjuster 40 flows into the spring containing space 30 and provides lubrication between the valve shaft 26 and the valve guide 28.

Additionally, in the present embodiment, since the oil supply passages 208, 210 are provided inside the lower core 202, the lower core 202 can be cooled by oil flowing through the oil supply passages 208, 210. In particular, when the engine valve 12 constitutes an exhaust valve, it is necessary to supply a large current to the lower coil 62 to actuate the engine valve 12 in the valve-opening direction against a high pressure in the combustion chamber 14. In this case, high heat is generated in the lower core 202. Thus, according to the present embodiment, since the lower core 202 can be cooled by oil flowing through the oil supply passages 208, 210 as mentioned above, an increase in a temperature of the lower core 202 can be suppressed, and therefore the solenoid valve device 200 can be applied to an engine which operates with a high revolution and a high load.

Figure 8:
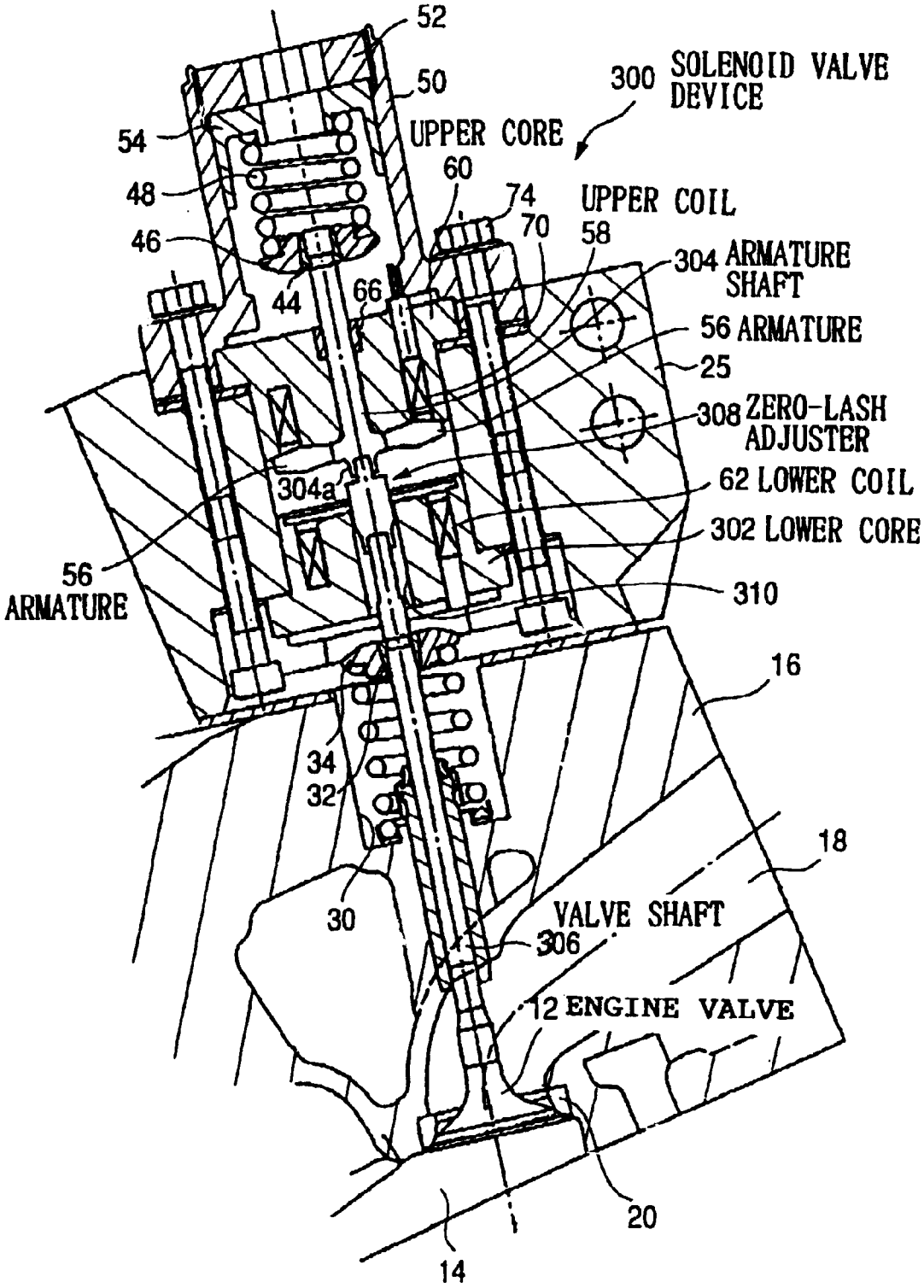
FIG. 8 is a diagram showing a cross section of a solenoid valve device of a third embodiment according to the present invention.

Next, a description will be given of a solenoid valve device 300 of a third embodiment of the present invention. FIG. 8 is a diagram showing a structure of the solenoid valve device 300. The solenoid valve device 300 is achieved by providing a lower core 302, an armature shaft 304, a valve shaft 306 and a zero-lash adjuster 308 instead of the lower core 64, the armature shaft 42, the valve shaft 28 and the zero-lash adjuster 40, respectively, of the solenoid valve device 10 of the first embodiment.

The lower core 302 has a lash-adjuster containing hole 310 which axially goes through a center thereof. A part of the zero-lash adjuster 308 is contained in the lash-adjuster containing hole 310.

The armature shaft 304 has a structure achieved by removing a part of the armature shaft 42 below the armature 56, and the zero-lash adjuster 308 is disposed immediately below the armature 56. Thus, the valve shaft 306 is upwardly extended into the lash adjuster-containing hole 310 of the lower core 302, as compared to the valve shaft 28 of the first embodiment. A cylindrical part 304*a* is provided on a lower end face of the armature shaft 304. An upper end part 308 of the zero-lash adjuster 308 is fitted into the cylindrical part 304*a*.

Figure 9:
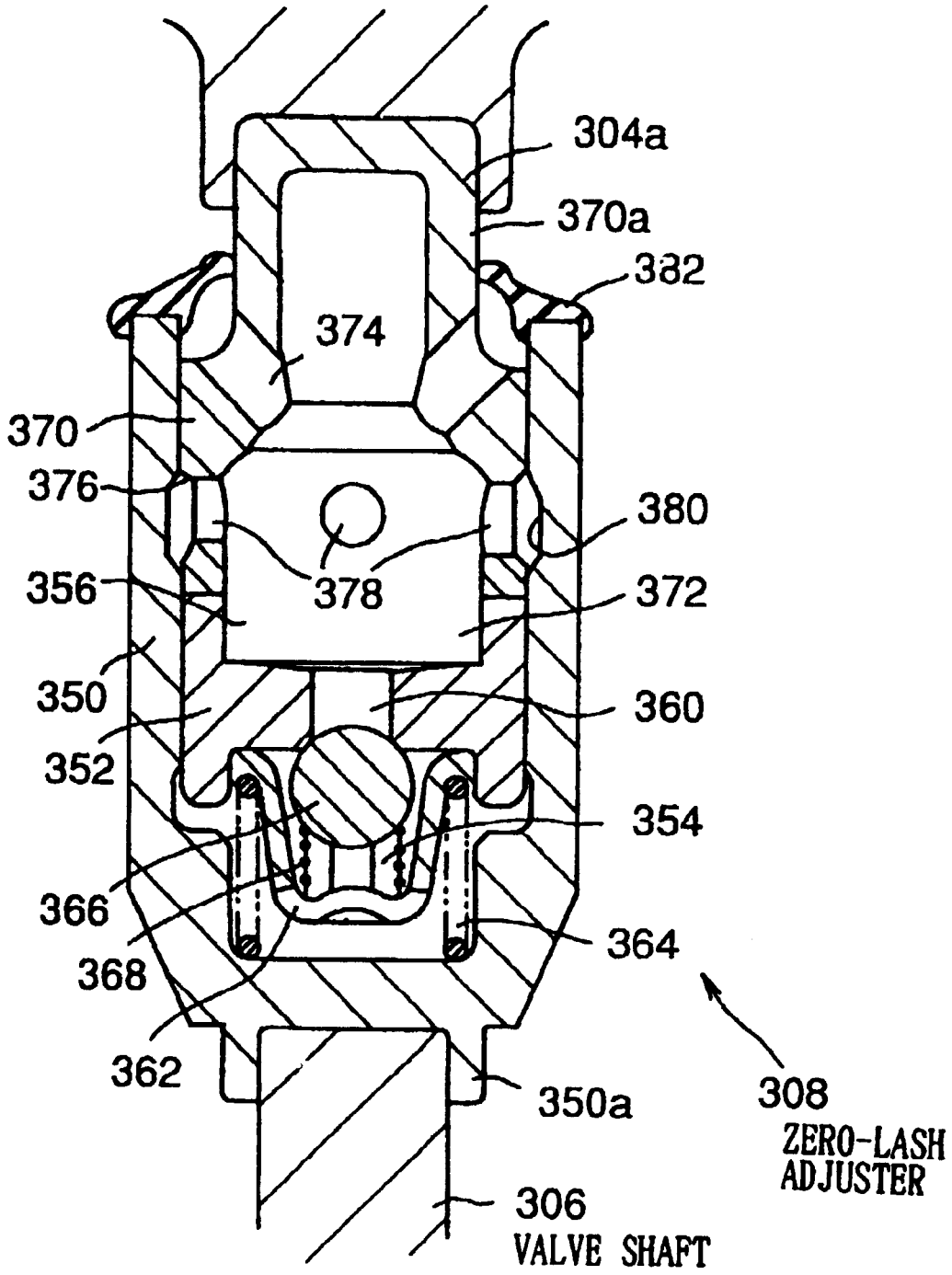
FIG. 9 is a diagram showing an enlarged axial cross section of the zero-lash adjuster.

The zero-lash adjuster 308 which is provided to the solenoid valve device 300 of the present embodiment has a sealed structure. FIG. 9 is a diagram showing an enlarged axial cross section of the zero-lash adjuster 308.

As shown in FIG. 9, the zero-lash adjuster 308 has a plunger body 350. The plunge body 350 is a substantially cylindrical member with a lower end thereof being closed. A cylindrical part 350*a* is provided on an outer bottom face of the plunger body 350. An upper end part of the valve shaft 306 is fitted into the cylindrical part 350*a*.

A plunger 352 is supported inside the plunger body 350 so that it can slide in the axial direction. A hydraulic pressure chamber 354 is defined between an outer bottom face of the plunger 352 and an inner bottom face of the plunger body 350. The plunger 352 is provided with a reservoir 356 which upwardly opens and a connecting passage 360 which connects the reservoir 356 and the hydraulic pressure chamber 354.

A retainer 362 and a plunger spring 364 are disposed in the hydraulic pressure chamber 354. The plunger spring 364 upwardly presses the plunger 352 via the retainer 362. A check ball 366 and a check ball spring 368 are disposed inside the retainer 362. The check ball spring 368 presses the check ball 366 toward an opening of the connecting passage 360. The check ball 366 and the check ball spring 368 function as a check valve which opens only when a pressure in the hydraulic pressure chamber 364 is lower than a pressure in the reservoir 356.

The zero-lash adjuster 308 also includes a reservoir cap 370. The reservoir cap 370 is a substantially cylindrical member with an upper end thereof being closed. The reservoir cap 370 is supported inside the plunger body 350 so that it can slide in the axial direction with a lower end face of the reservoir cap 370 being in contact with an upper end face of the plunger 352. The reservoir 356 of the plunger 352 and an inner space of the reservoir cap 370 constitute a reservoir chamber 372. The zero-lash adjuster 308 contains oil to a predetermined level in the reservoir chamber 372.

A small diameter part 370*a* is provided on an upper end part of the reservoir cap 370. The small diameter part 370*a* upwardly projects from the plunger body 350 and is fitted into the cylindrical part 304*a* of the armature shaft 304. Connecting holes 374 are provided on a bottom part of the small diameter part 370*a*. The connecting holes 374 connect the reservoir chamber 372 and a space outside the reservoir cap 370.

An annular recess 376 is formed on an outer circumferential surface of the reservoir cap 370. The annular recess 376 is connected to the reservoir chamber 372 via connecting holes 378 which open on a bottom of the annular recess 376. On the other hand, an annular recess 380 is formed on an internal circumferential surface of the plunger body 350. The annular recess 376 and the annular recess 380 are positioned so that they communicate with each other in a normal operating state of the solenoid valve device 300.

An annular seal member 382 is provided on an upper end of the plunger body 350. An inner circumferential face of the seal member 382 is engaged with an outer circumferential surface of the small diameter part 370*a* of the reservoir cap 370. As will be described below, the seal member 382 functions to prevent oil which has upwardly leaked out through the sliding surface between the reservoir cap 370 and the plunger body 350 from leaking out to the outside of the zero-lash adjuster 308.

According to the above-mentioned structure of the zero-lash adjuster 308, when the engine valve 12 is actuated in the valve-opening direction, oil in the hydraulic pressure chamber 354 is pressurized by a force acting on the plunger 370 in the valve-opening direction. In this case, a flow of oil between the hydraulic pressure chamber 354 and the reservoir chamber 372 is prohibited by the check ball 366 closing the connecting passage 360. Thus, the zero-lash adjuster 308 moves in the valve-opening direction together with the armature shaft 304 and the engine valve 12 while allowing oil to gradually leak out through the sliding surface between the plunger 352 and the plunger body 350. In this process, the zero-lash adjuster 308 contracts by a slight extent corresponding to an amount of oil which has leaked out.

Oil which has leaked out downwardly through the sliding surface between the plunger 352 and the plunger body 350 is collected to the reservoir chamber 372 via the connecting holes 378. Additionally, oil which has leaked out upwardly through the sliding surface between the reservoir cap 370 and the plunger body 350 is prevented from flowing out by the seal member 382 and collected to the reservoir chamber 372 via the connecting holes 374.

When the valve 12 returns to be seated on the valve seat 20, a resilient force of the lower spring 38 is no longer exerted on the plunger body 350. On the other hand, the armature 56 continues to move in the valve-closing direction by a slight distance corresponding to an extent of the contraction of the zero-lash adjuster 308 after the valve 12 is seated on the valve seat 20. In this case, since the plunger 350 and the reservoir cap 370 are upwardly pressed toward the armature shaft 304 by a resilient force of the plunger spring 364, an oil pressure in the hydraulic pressure chamber 354 is decreased. Due to this pressure decrease, the check ball 366 is released from the opening of the connecting passage 360, and thus the hydraulic pressure chamber 354 and the reservoir chamber 372 are connected to each other. In such a situation, since oil is allowed to flow from the reservoir chamber 372 into the hydraulic pressure chamber 354, the zero-lash adjuster 308 expands until the armature 56 comes into contact with the upper core 60. Thus, it is possible to maintain a state in which the armature shaft 304 and the reservoir cap 370 are in contact with each other and the plunger 352 and the valve shaft 306 are in contact with each other.

Additionally, a change in a distance between the valve shaft 26 and the armature shaft 304 due to a difference in the thermal expansion between the engine valve 12 and the lower head 16 or wear of the engine valve 12 and the valve seat 20 can be compensated for by the zero-lash adjuster 308, which has been slightly contracted when the engine valve 12 is opened, expanding when the engine valve 12 is closed, as in the case of the zero-lash adjuster 40.

Thus, according to the zero-lash adjuster 308, it is possible to positively actuate the engine valve 12 between the fully closed position and the fully opened position while preventing formation of a clearance between the armature shaft 304 and the engine valve 12.

Additionally, since the zero-lash adjuster 308 is of a sealed type in which all of oil which has leaked out from the hydraulic pressure chamber 354 is collected to the reservoir chamber 372 via the connecting holes 378 or 374, it is unnecessary to supply oil to the zero-lash adjuster 308. Thus, contrary to the solenoid valve devices 10, 200 of the first and second embodiments, oil supply passages and an oil pump for supplying oil to the zero-lash adjuster 308 need not be provided and thus a cost of the solenoid valve device 300 can be reduced.

Further, since the zero-lash adjuster need not slide on an inner wall of the lash-adjuster containing hole 310, an energy loss caused by a sliding resistance can be avoided.

Additionally, due to the sealed structure of the zero-lash adjuster 308, the zero-lash adjuster 308 may project from the lower core 308 when the engine valve 12 is in the fully closed position, as shown in FIG. 8.

Figure 10:
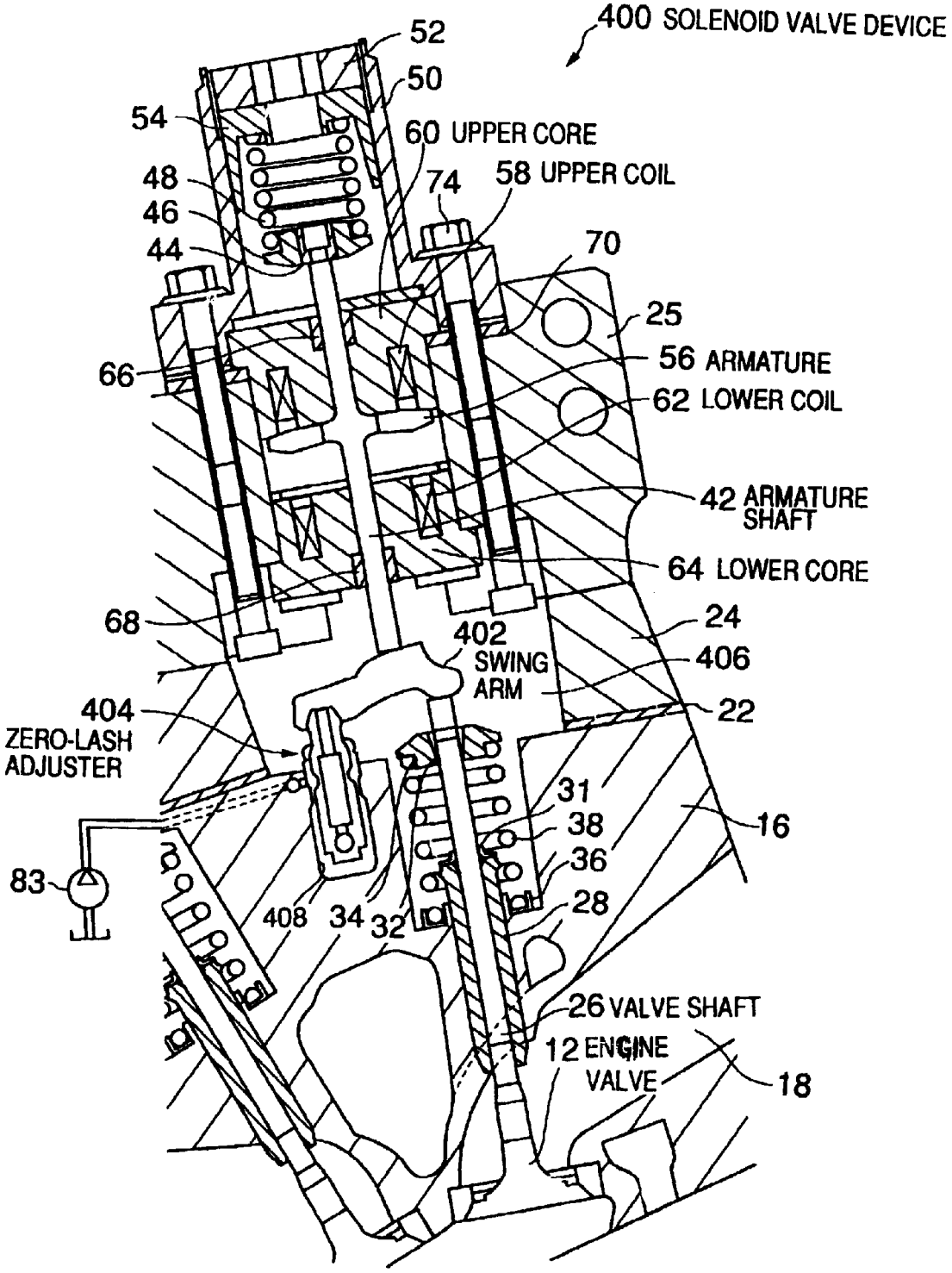
FIG. 10 is a diagram showing a cross section of a solenoid valve device of a fourth embodiment according to the present invention.

Next, a description will be given of a fourth embodiment of the present invention. FIG. 10 is a diagram showing a cross section of solenoid valve device 400 of the fourth embodiment according to the present invention. In FIG. 10, parts that are the same as the parts shown in FIG. 1 are given the same reference numerals, and descriptions thereof will be omitted. The solenoid valve device 400 of the present embodiment is achieved by offsetting center axes of the armature shaft 42 and the valve shaft 26 to each other and replacing the zero-lash adjuster 40 of the first embodiment with a swing arm 402 and a zero-lash adjuster 404.

As shown in FIG. 10, a lash-adjuster containing space 406 is formed in the cylinder head spacer 24. The swing arm 402 is contained in the lash-adjuster containing space 406. Additionally, a lash-adjuster supporting hole 408 is formed on an upper surface of the lower head 16. The zero-lash adjuster 404 is supported in the lash-adjuster supporting hole 408.

Figure 11:
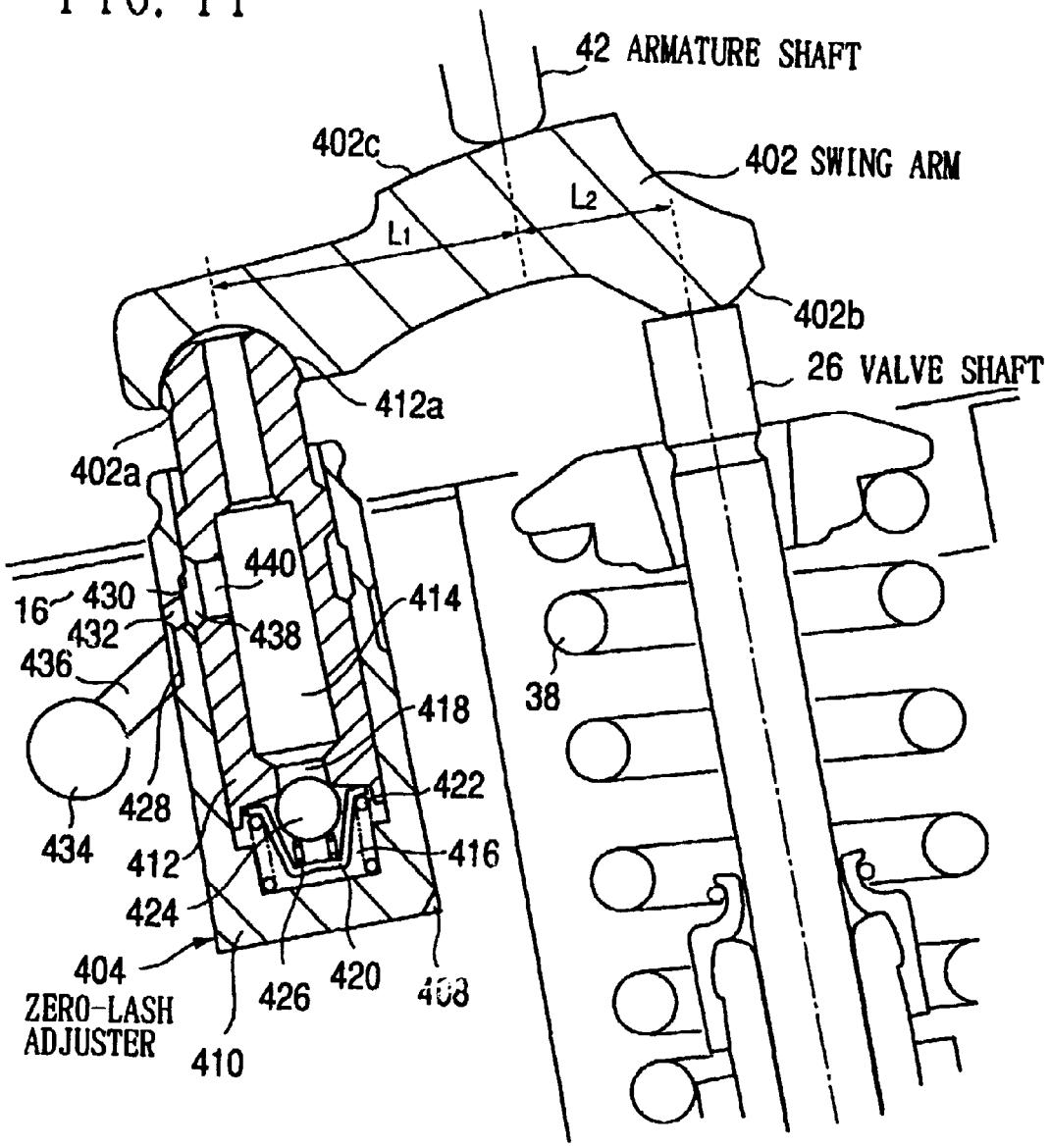
FIG. 11 is a diagram showing an enlarged cross section of a zero lash adjuster and neighboring parts thereof in the present embodiment.

FIG. 11 is a diagram showing an enlarged cross section of the zero lash adjuster 404 and neighboring parts thereof. As shown in FIG. 11, the zero-lash adjuster 404 has a plunger body 410. The plunger body 410 is a substantially cylindrical member with one end (lower end in FIG. 11) being closed. The plunger body 410 is fitted into the lash-adjuster containing hole 408 so that an upper end part of the plunger body 410 upwardly projects from the lash-adjuster containing hole 408. A plunger 412 is disposed inside the plunger body 410 so that it can slide in the axial direction. The plunger 412 is a substantially cylindrical member which includes a reservoir space 414 therein. A pivot part 412*a* having a hemispheric shape is provided on an upper end of the plunger 412.

A space inside the plunger body 410 below the plunger 412 constitutes a hydraulic pressure chamber 416. The plunger 412 is provided with a connecting passage 418 which connects the reservoir space 414 and the hydraulic pressure chamber 416.

A retainer 420 and a plunger spring 422 are disposed in the hydraulic chamber 416. The plunger spring 422 upwardly presses the plunger 412 via the retainer 420. A check ball 424 and a check ball spring 426 are disposed inside the retainer 420. The check ball spring 426 presses the check ball 424 toward an opening of the connecting passage 424.

Annular recesses 428 and 430 are provided on an outer circumferential surface and an inner circumferential surface, respectively, of the plunger body 410. The annular recesses 428 and 430 are connected to each other by a connecting hole 432.

An oil supply passage 434 is formed in the lower head 16 corresponding to each cylinder of the engine. An oil supply passage 436 corresponding to each zero-lash adjuster 404 is connected to the oil supply passage 434. The oil supply passage 436 opens on a inner wall of the lash-adjuster containing hole 408 so as to be connected to the annular recess 428. The oil supply passage 434 is supplied with oil from the oil pump 83 not shown in FIG. 11.

An annular recess 438 is provided on an outer circumferential surface of the plunger 412. The annular recess 438 is positioned so as to communicate with the annular recess 430 of the plunger body 410 in a normal operating state of the solenoid valve device 400. Additionally, the annular recess 438 is connected to the reservoir space 414 via connecting holes 440 which open on a bottom of the annular recess 438.

An adjuster connecting part 402*a* is provided on a bottom surface of the swing arm 402 near a left end thereof in FIG. 11. The adjuster connecting part 402*a* is a recessed part having a substantially hemispheric shape corresponding to a shape of the pivot part 412*a* of the plunger 412. Additionally, a valve-shaft contacting part 402*b* is provided on a bottom face of the swing arm 402 near a right end thereof in FIG. 11. The valve-shaft contacting part 402*b* is a raised part having a curved surface (a spherically shaped surface, for example). Further, an armature contacting part 402*c* is provided on an upper surface of the swing arm 402 at a position corresponding to an intermediate position between the adjuster connecting part 402*a* and the valve-shaft contacting part 402*b*. The armature contacting part 402*c* is a part having a moderately curved (or planer) surface.

The pivot part 412*a* of the plunger 412 is fitted in the adjuster connecting part 402*s* of the swing arm 402. Thus, the swing arm 402 can swing relative to the zero-lash adjuster 404 around an apex of the pivot part 402*a*. On the other hand, an upper end face of the valve shaft 26 is in contact with the valve-shaft contacting part 402*b*. Additionally, a lower end face of the armature shaft 42, which end face has a raised and curved (spherical, for example) surface, is in contact with the armature-shaft contacting part 402*c*. Thus, the swing arm 402 can smoothly swing while maintaining a state in which the swing arm 402 is in contact with the armature shaft 42 and the valve shaft 26.

Hereinafter, a distance between a contact point of the armature contacting part 402*c* and armature shaft 42 and an apex of the pivot part 412*a* is indicated by L1, and a distance between a contact point of the armature contacting part 402*c* and the armature shaft 42 and a contact point of the valve-shaft shaft contacting part 402*b* and the valve shaft 28 is indicated by L2.

According to the above-mentioned structure, when the upper coil 58 is de-energized in a state where the armature 56 and the engine valve 12 are maintained in the fully closed position, a resilient force of the upper spring 48 is transmitted to the armature 56 as a force in the valve-opening direction. This force is in turn transmitted to the plunger 412 of the zero-lash adjuster 404 as a downward force by leverage of the swing arm 402 with the contact point of the valve-contacting point 402*b* and the valve shaft 26 being a fulcrum. When a downward force is transmitted to the plunger 412, the connecting passage 418 is closed by the check ball 424 since the hydraulic pressure chamber 416 is pressurized. In this case, a flow of oil between the reservoir chamber 414 and the hydraulic pressure chamber 416 is prohibited. Thus, the zero-lash adjuster 404 contracts to a slight extent corresponding to an amount of oil which leaks out through a sliding surface between the plunger 412 and the plunger body 410.

Therefore, when a force is transmitted to the armature 56 in the valve-opening direction, the swing arm 402 downwardly swings around the pivot part 412*a* of the plunger 412. In this case, a force transmitted to the armature 56 in the valve-opening direction (that is, a force transmitted to the armature contacting part 402*c* of the swing arm 402 from the armature shaft 42) divided by a lever ratio R=(L1+L2)/L1 is transmitted to the valve shaft 26 from the valve-shaft contacting part 402*b*, and thus the engine valve 12 is actuated in the valve-opening direction.

When the engine valve 12 is actuated in the valve-closing direction, a resilient force of the lower spring 38 is transmitted to the valve-contacting part 402*b* of the swing arm 402 from the valve shaft 26 as an upward force. In this case, a downward force is transmitted to the plunger 412 of the zero-lash adjuster 404 from the adjuster connecting part 402*a* by a leverage of the swing arm 402 with the contact point of the armature shaft 42 and the armature contacting part 402*c* being a fulcrum. Thus, the swing arm 402 upwardly swings around the pivot part 412*a* with the zero-lash adjuster 404 slightly contracting, as in the above-mentioned case where the engine valve 12 is opened. The force transmitted to the valve-shaft contacting part 402*b* multiplied by the above-mentioned lever ratio R is transmitted to the armature shaft 42 and thus the armature shaft 42 and the engine valve 12 are actuated together in the valve-closing direction.

When the engine valve 12 is seated on the valve seat 20, the downward force is no longer exerted on the plunger 412 of the zero-lash adjuster 402 since the resilient force of the lower spring 38 is not transmitted to the valve-shaft contacting part 402*b* of the swing arm 402. In this state, the swing arm 402 is downwardly inclined around the valve-shaft contacting part 402*b* to a slight extent corresponding to an extent of the contraction of the zero-lash adjuster 404 as compared to a state at a time when the engine valve 12 started moving in the valve-opening direction from the fully closed position. Thus, the armature 56 further moves in the valve-closing direction by a distance corresponding to the extent of the inclination of the swing arm 402 until the armature 56 comes into contact with the upper core 60.

In this case, since the plunger 412 is upwardly pushed by a resilient force of the plunger spring 422, an oil pressure in the hydraulic chamber 416 is decreased. Thus, the check ball 424 is released from the opening of the connecting passage 418 allowing a flow of oil from the reservoir space 414 into the hydraulic pressure chamber 416, and the plunger 412 moves in an upward direction. As a result, the swing arm 402 upwardly swings around the valve-shaft contacting part 402*b* while maintaining a state in which the armature shaft 42 is in contact with the armature-shaft contacting part 402*c*.

Thus, according to the solenoid valve device 400 of the present embodiment, clearances are prevented from being formed between the swing arm 402 and the armature shaft 42 by the swing arm 402 swinging in association with the expansion of the zero-lash adjuster 404 when the engine valve 12 is seated on the valve seat 20. Additionally, a change in a distance between the valve shaft 26 and the armature shaft 42 due to a difference in the thermal expansion between the engine valve 12 and the lower head 16 or wear of the engine valve 12 and the valve seat 20 can be compensated for by the zero-lash adjuster 404, which has been slightly contracted when the engine valve 12 is opened, expanding when the engine valve 12 is seated on the valve seat 20, as in the case of the zero-lash adjuster 40.

In this way, it is possible to positively actuate the engine valve 12 between the fully closed position and the fully opened position while preventing formation of a clearance between the engine valve 12 and the armature shaft 42, that is, while maintaining a state in which both the engine valve 12 and the armature shaft 42 are in contact with the swing arm 402.

Additionally, only the swing arm 402, which has a sufficiently small height as compared to a height of the zero-lash adjuster 404, is interposed between the engine valve 12 and the armature shaft 42. Thus, according to the present embodiment, it is possible to reduce a total length of the solenoid valve device 400 and thus to suppress an increase in a height of the engine, as compared to a structure in which a zero-lash adjuster is interposed between the engine valve 12 and the armature shaft 42.

Further, in the present embodiment, the swing arm 402 swings in association with the movement of the engine valve 12 while the zero-lash adjuster 404 is maintained still. That is, a mass of the zero-lash adjuster 404 is not included in a mass of a movable part of the solenoid valve device 400 but only an equivalent inertial mass of the swing arm 402 swinging around the pivot part 412*a* is included in the mass of the movable part. Thus, according to the present embodiment, it is possible to reduce an inertial mass of the movable part of the solenoid valve device 400 thereby improving a response of the solenoid valve device 400.

Additionally, due to the arrangement in which center axes of the zero-lash adjuster 404, the armature shaft 42 and the valve shaft 26 are offset with respect to each other, the solenoid valve device 400 can be mounted to the engine with a higher degree of freedom. That is, the offset directions of the armature shaft 42 and the zero-lash adjuster 404 with respect to the engine valve 12 can be arbitrarily changed in accordance with a structure of the engine.

Figure 12:
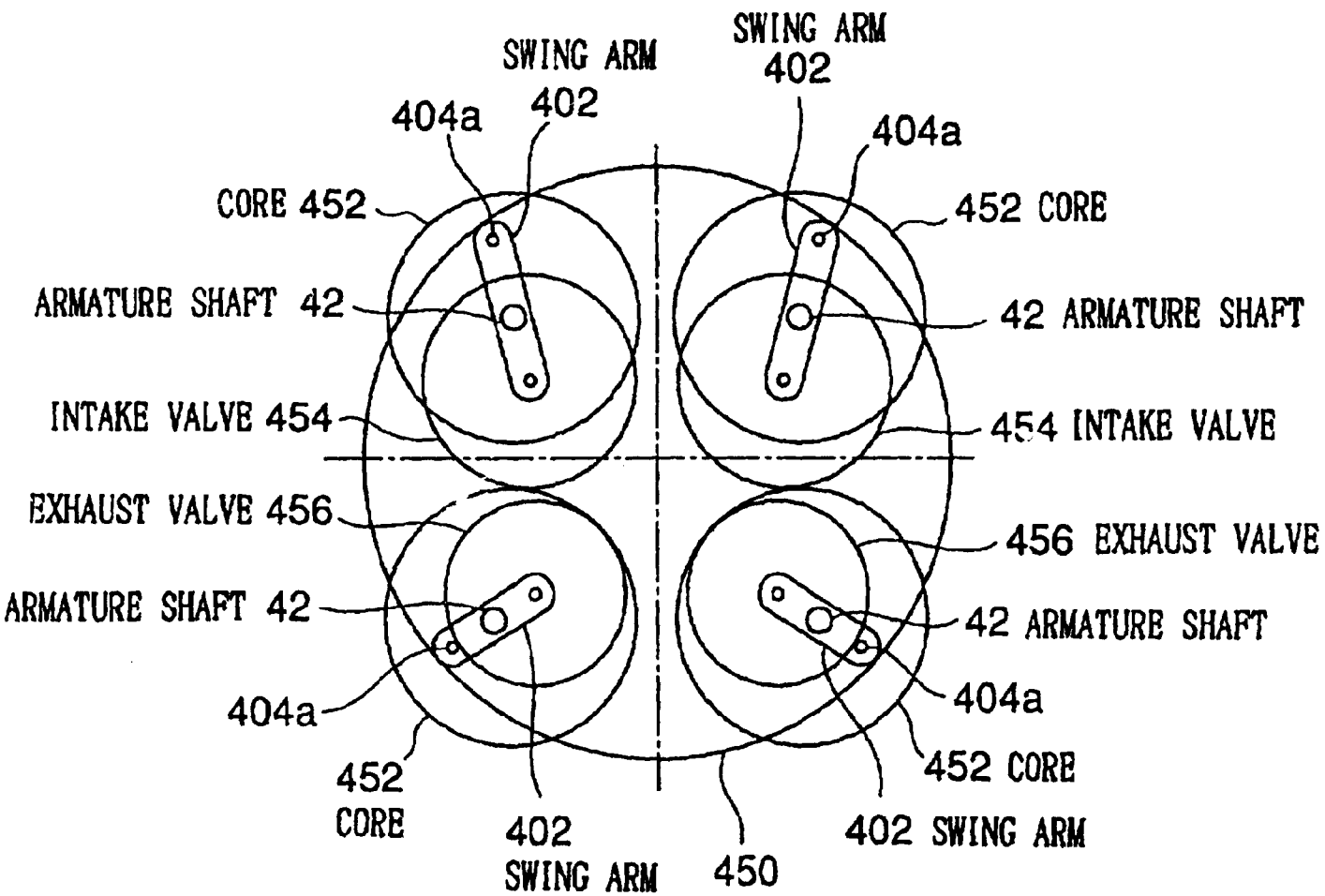
FIG. 12 is a diagram schematically showing a top view of an arrangement in which an armature shaft and the zero-lash adjuster are offset with respect to the engine valve in an outwardly radial direction of a cylinder bore of an engine.

FIG. 12 is a diagram schematically showing a top view of an arrangement in which the armature shaft 42 and the zero-lash adjuster 404 are offset with respect to the engine valve 12 in an outwardly radial direction of a cylinder bore 450 of the engine. FIG. 12 shows a positional relationship between the armature shafts 42, the upper and lower cores 60, 64 (generally referred to as cores 452), center axes 404*a* of the zero-lash adjusters 404, the swing arms 402, intake valves 454 constituted by the engine valves 12, and exhaust valves 456 constituted by the engine valves 12. In the arrangement shown in FIG. 12, since the armature shafts 42 and the zero-lash adjusters 404 are disposed in radially outward positions with respect to the engine valves 12, relatively large spacings are provided between the cores 452, and thus solenoid valve devices having a larger size can be mounted to the engine.

In the present embodiment, the zero-lash adjuster 404 has a structure in which oil is supplied from an external oil-pressure source. However, a zero-lash adjuster of a sealed type as the zero-lash adjuster 308 of the third embodiment can be used instead of the zero-lash adjuster 404.

Additionally, although hydraulic zero-lash adjusters are used in the first to the fourth embodiments, a mechanical zero-lash adjuster can be used instead. The mechanical zero-lash adjuster has a first member connected to an actuating mechanism (corresponding to the armature shaft 42 in the first embodiment) and a second member connected to an engine valve. Screw threads are provided to the respective first and second members. The first and second members are connected to each other by the screw threads being engaged with each other with an axial spacing being provided therebetween. The screw threads are constructed so as to prohibit a relative rotation of the first and second members when a force is exerted on the first member in the valve-opening direction and to allow a relative rotation of the first and second members when a force is not exerted on the first member in the valve-opening direction. Thus, when the engine valve is actuated in the valve-opening direction, the first and second members move with the engine valve as a rigid body without a relative axial movement between the two members. On the other hand, when the engine valve is actuated in the valve-closing direction or is in the fully closed or fully opened position, the first and second members move relative to each other by a relative rotation so that a clearance between the engine valve and the actuating mechanism is adjusted to be zero. According to such a mechanical zero-lash adjuster, it is possible to reduce weight of the zero-lash adjuster since components such as a hydraulic chamber and a check valve are not required. Thus, it is possible to improve a response of a solenoid and thus to apply the solenoid valve device to high-speed engines.

Additionally, in the above-mentioned embodiments, the solenoid valve devices 10, 200, 300, 400 are constructed as intake valves or exhaust valves. However, the present invention can be constructed as other valve devices which actuate an engine valve by an electromagnetic force.

Next, a description will be given of a fifth embodiment of the present invention. In the present embodiment and in the following embodiments, current control of the upper coil 58 and the lower coil 62 will be described with reference to the solenoid valve device 10 of the first embodiment.

When an ignition switch of a vehicle in which the engine is mounted is turned off, neither the upper coil 58 nor the lower coil 62 can be energized. Thus, at a time when the ignition switch is turned on, the engine valve 12 is supported by the upper spring 48 and the lower spring 38 at a neutral position between the fully closed position and the fully opened position. When the engine valve 12 is at the neutral position, the armature 56 is spaced away from both the upper coil 58 and the lower coil 62. In this state, resilient forces of the upper spring 48 and the lower spring 38 exerted on the armature 56 are balanced. Thus, in order to start actuating the engine valve 12 situated in the neutral position, it is necessary to attract the armature 56 spaced away from the upper coil 58 and the lower coil 62 without using the resilient forces of the springs. In this case, it is difficult to effectively actuate the engine valve 12 at desired timings. Thus, in order to smoothly start the engine, it is necessary to move the engine valve to the fully closed position or the fully opened position immediately after the ignition switch is turned on.

Figures 13A, 13B, 13C:
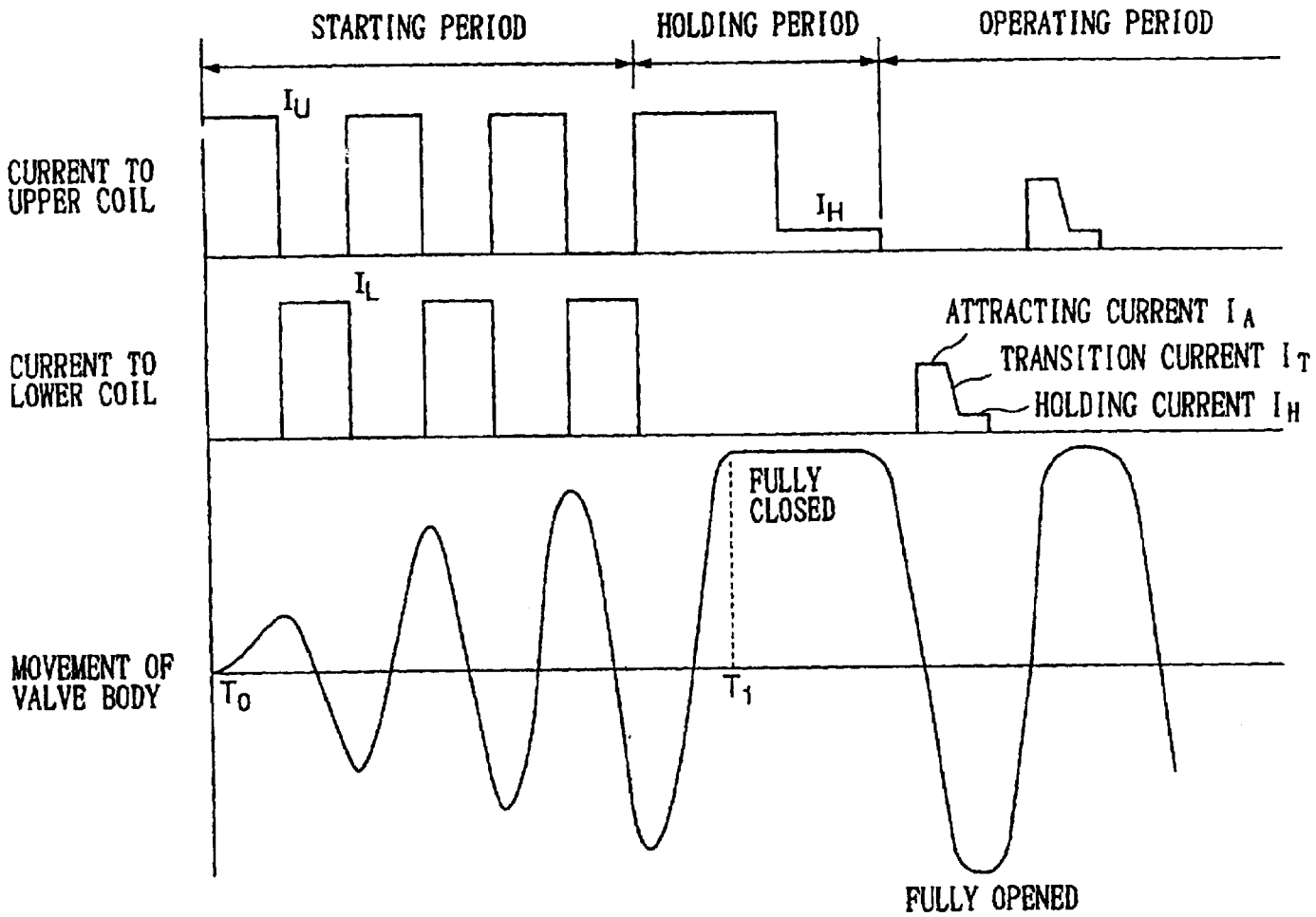
FIGS. 13A and 13B are diagrams showing instruction currents supplied to an upper coil and a lower coil, respectively, after an ignition switch is turned on until the engine valve starts being actuated between the fully closed position and the fully opened position in a fifth embodiment of the present embodiment.
FIG. 13C is a diagram showing a displacement of the engine valve when the instruction currents shown in FIGS. 13A and 13B are supplied to the respective coils.

FIGS. 13A and 13B are diagrams showing instruction currents supplied to the upper coil 58 and the lower coil 62, respectively, after the ignition switch is turned on until the engine valve 12 starts being actuated between the fully closed position and the fully opened position in the present embodiment. FIG. 13C is a diagram showing a displacement of the engine valve when the above instruction currents are supplied to the respective coils.

As shown in FIGS. 13A to 13C, actuation of the engine valve 12 is performed in three period, namely, a starting period, a holding period, and an operating period. In the starting period, the upper coil 58 is supplied with an instruction current having a pulse waveform which changes between "0" and a predetermined value $I_U$ with a predetermined period T, and the lower coil 62 is supplied with an instruction current having a pulse waveform which changes between "0" and a predetermined value $I_L$ with the predetermined period T delayed 180° in phase with respect to the instruction current supplied to the upper coil 58, as shown in FIGS. 13A and 13B. The predetermined period T is set to be equal to a natural vibration period of a spring-mass system defined by a mass of a movable part of the solenoid valve device 10 (that is, the armature 56 and parts moving with the armature 56), the upper spring 48, and the lower spring 38.

Thus, in the starting period, electromagnetic forces are alternately exerted on the armature 56 in the valve-opening direction and the valve-closing direction with a period equal to the natural vibration period of the movable part so that a natural vibration of the movable part is excited. As a result, the amplitude of vibration of the engine valve 12 gradually increases in the starting period, and the engine valve 12 ultimately reaches the fully closed position, as shown in FIG. 13C. Hereinafter, the above-mentioned process performed in the starting period to move the engine valve 12 to the fully closed position by exciting a natural vibration of the movable part is referred to as an initial actuation.

In the next holding period, the instruction current to the lower coil 62 is set to be "0" and the instruction current to the upper coil 58 is set to be a predetermined holding current $I_H$. Thus, the armature 56 and the engine valve 12 are held in the fully closed position.

When the operating period is started following the holding period, the instruction current to the upper coil 58 is set to be "0" so that the engine valve 12 starts moving in the valve-opening direction. Then, an instruction current having a pattern comprising an attracting current $I_A$, a transition current $I_T$ and the holding current $I_H$ is supplied to the lower coil 62 at a proper timing. According to the instruction current having such a pattern, after the armature 56 is actuated to come close to the lower core 64 by the attracting current $I_A$, the armature 56 is attracted to come into contact with the lower core 64 while being decelerated by the transition current $I_T$, and ultimately, the armature 56 is held in contact with the lower core 64 by the holding current $I^H$. Thereafter, the engine valve 12 is actuated between the fully opened position and the fully closed position by alternately supplying the instruction current having the above-mentioned pattern to the upper coil 58 and the lower coil 62.

As mentioned in the first embodiment, the zero-lash adjuster 40 has a function to expand by being supplied with an oil pressure from the oil supply passage 80 when the engine valve 12 reaches near the fully closed position so as to prevent formation of a clearance (that is, a tappet clearance) between the engine valve 12 and the armature shaft 42 in a state where the armature 56 and the engine valve 12 are in the fully closed position. Hereinafter, a state where the tappet clearance is cancelled by the above-mentioned function of the zero-lash adjuster 40 is referred to as a zero-lash state. Additionally, a position of the armature 56 in a state where both the upper coil 58 and the lower coil 62 are de-energized in the zero-lash lash state is referred to as a reference neutral position.

When the ignition switch is turned off, the zero-lash adjuster 40 cannot be supplied with an oil pressure, since neither the upper coil 58 nor the lower coil 62 is supplied with a current and the armature 56 is held near the reference neutral position. In the state where the armature 56 is held near the reference neutral position, a compressing force is exerted on the zero-lash adjuster 40 by the upper spring 48 and the lower spring 38. Thus, the zero-lash adjuster 40 gradually contracts since oil leaks out from the hydraulic pressure chamber 104 while the ignition switch is turned off. Hereinafter, the phenomenon in which the zero-lash adjuster 40 contracts due to leakage of oil from the hydraulic pressure chamber 104 is referred to as a leak-down of the zero-lash adjuster 40. When the leak-down has occurred, a position of the armature 56 shifts toward the lower core 64 from the reference neutral position in accordance with an extent of the leak-down. Thus, distances from the armature 56 to the upper core 60 and the lower core 64 at a time when the ignition switch is turned on change in accordance with an extent of the leak-down of the zero-lash adjuster 40.

Figure 14:
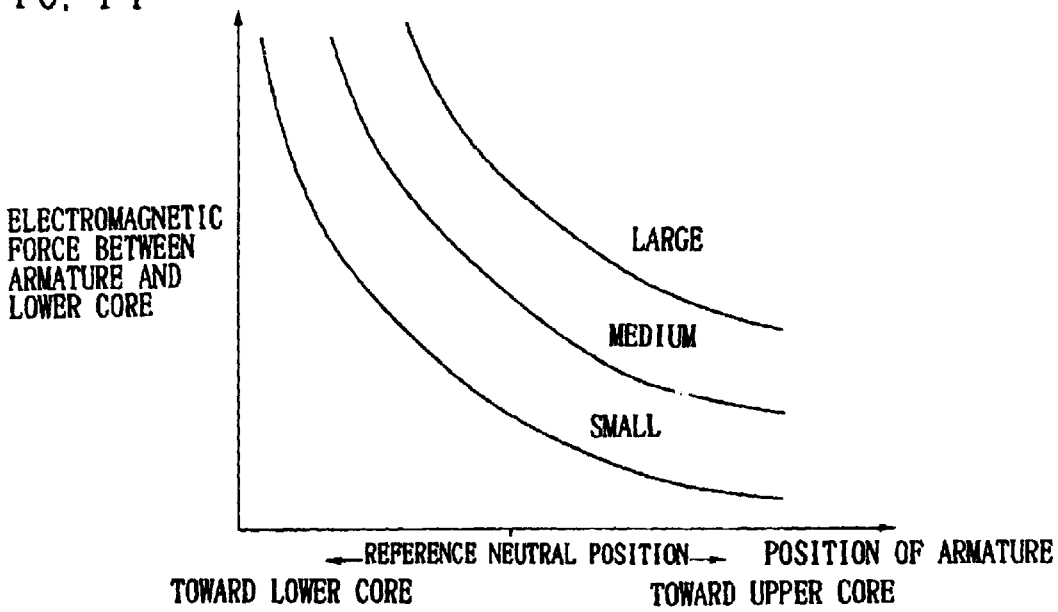
FIG. 14 is a diagram showing a relationship between a position of the armature and an electromagnetic force acting between the armature and a lower core when a current supplied to the lower coil is changed in three steps.

FIG. 14 is a diagram showing a relationship between a position of the armature 56 and an electromagnetic force acting between the armature 56 and the lower core 64 when a current supplied to the lower coil 62 is changed in three steps, namely, large, medium, and small. As shown in FIG. 14, when a current supplied to the lower coil 62 is constant, the electromagnetic force acting between the armature 56 and the lower core 64 becomes smaller as the armature 56 shifts toward the upper core 60. Additionally, when a position of the armature 56 is constant, the electromagnetic force acting between the armature 56 and the lower core 64 becomes larger as a larger current is supplied to the lower coil 62.

Due to such characteristics, a current to be supplied to the lower coil 62 to exert a required force on the armature 56 in the valve-opening direction becomes smaller as the armature 56 shifts toward the lower core 58. Similarly, a current to be supplied to the upper coil 58 to exert a required force on the armature 56 in the valve-closing direction becomes larger as the armature 56 shifts toward the lower core 58.

For this reason, if constant currents are used as the instruction currents $I_U$ and $I_L$ to the upper coil 58 and the lower coil 62, respectively, in the initial actuation irrespective of a position of the armature 56, the following problems occur. First, since the armature 56 has shifted toward the lower core 64 in accordance with the leak-down of the zero-lash adjuster 40 when the ignition switch is turned on, the initial actuation may not be properly performed due to an insufficient electromagnetic force to actuate the armature 56 toward the upper core 60. Second, since the lower coil 62 is supplied with a current which is larger than a required value, power consumption of the solenoid valve device 10 is unnecessarily increased.

In order to avoid these problems, the instruction currents $I_U$ and $I_L$ in the initial actuation are changed in accordance with a position of the armature 56 in the present embodiment.

Figure 15:
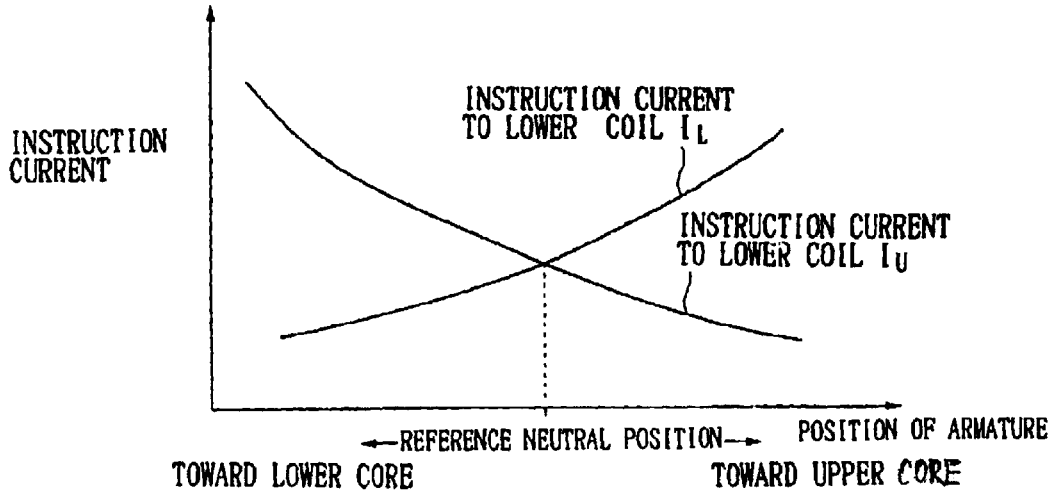
FIG. 15 is a diagram showing a map which is referred to so as to determine the instruction currents $I_L$ and $I_U$ in an initial actuation in accordance with a position of the armature.

FIG. 15 is a diagram showing a map which is referred to so as to determine the instruction currents $I_L$ and $I_U$ in the initial actuation in accordance with a position of the armature 56. As shown in FIG. 15, since the instruction current $I_L$ to the lower coil 62 is set to be larger as the armature 56 shifts toward the upper core 60, a sufficient force can be generated to actuate the armature 56 toward the lower core 64. Additionally, since the instruction current $I_U$ to the upper coil 58 is set to be smaller as the armature 56 shifts toward the upper core 60, the upper coil 58 can be prevented from being supplied with an unnecessarily large current and thus power consumption of the solenoid valve device 10 can be reduced.

Figure 16:
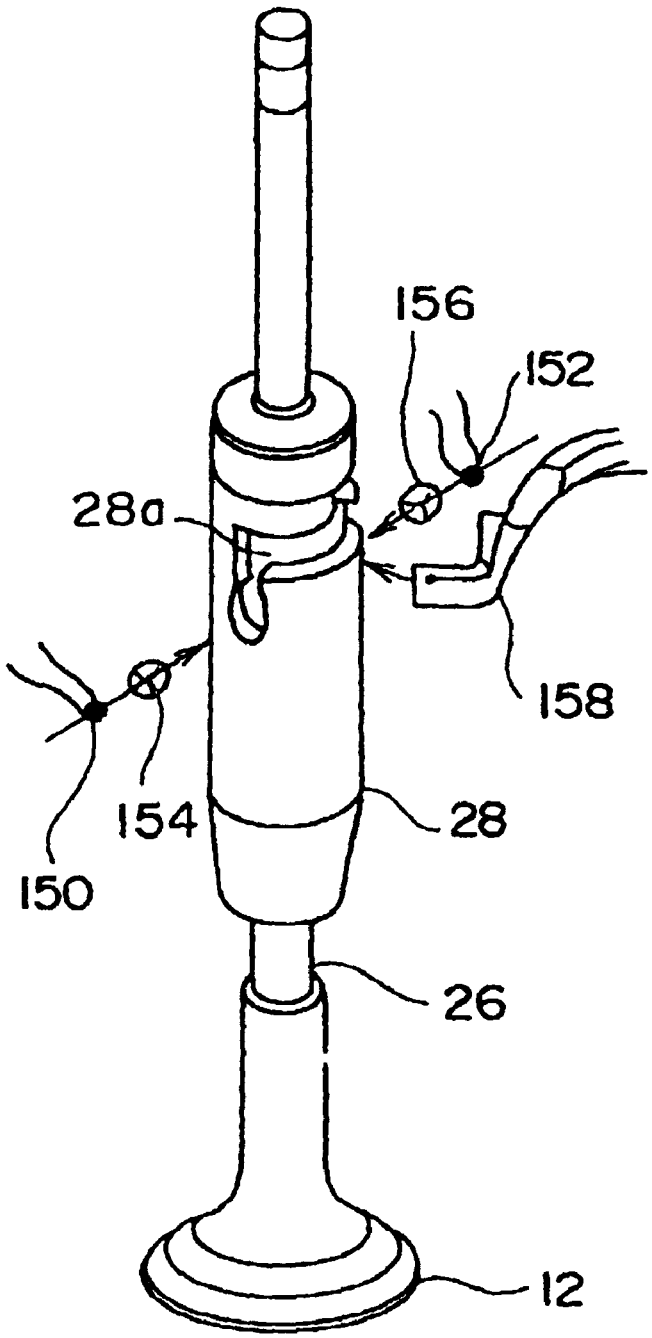
FIG. 16 is a diagram showing a perspective view of an arrangement for detecting a position of the armature.

FIG. 16 is a diagram showing a perspective view of an arrangement for detecting a position of the armature 56. As mentioned above, the armature 56 shifts toward the lower core 64 due to the leak-down of the zero-lash adjuster 40. When the leak-down of the zero-lash adjuster 40 has occurred, the armature shaft 42 and the engine valve 12 shift downwardly and upwardly, respectively, to the same extent from both sides of the zero-lash adjuster 40. Thus, in the present embodiment, a position of the armature 56 is indirectly detected by detecting a position of the valve shaft 26.

As shown in FIG. 16, a cut-out part 28*a* is formed in the valve guide 28. A pair of gap sensors 150, 152 are mounted in the cut-out part 28*a* via sensor holders 154, 156, respectively, so as to be positioned to face to each other from both sides of the valve shaft 26 in the radial direction. Additionally, a terminal film 158 for delivering output signals of the gap sensors 150, 152 is mounted in the cut-out part 28*a*. FIG. 16 shows a state in which the gap sensors 150, 152, the sensor holders 154, 156, and the terminal film 158 are taken away from the cut-out part 28*a*. The gap sensors 150, 152 are eddy-current gap sensors, for example, and deliver electric signals to the ECU 11 in accordance with distances to the circumferential surface of the valve shaft 26. It should be noted that other types of gap sensors such as electrostatic gap sensors can be used as the gap sensors 150, 152.

Figure 17:
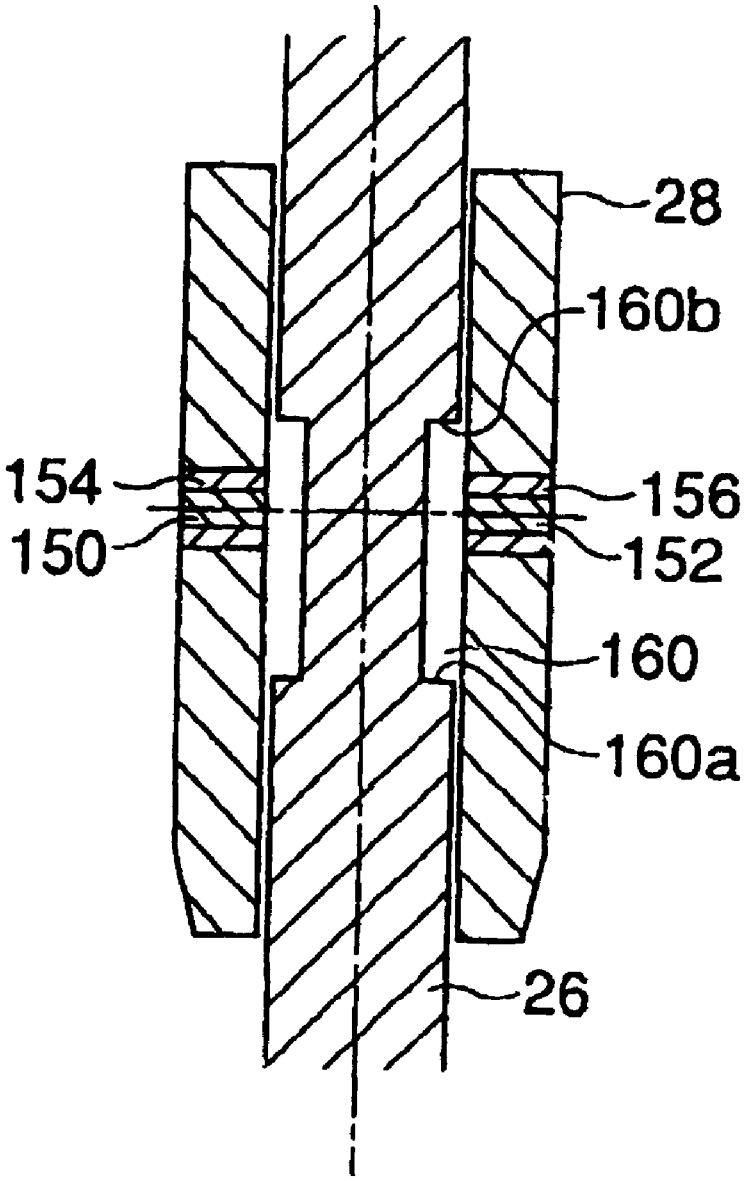
FIG. 17 is a diagram showing an axial cross section of a valve guide and a valve shaft in the present embodiment.

FIG. 17 is a diagram showing an axial cross section of the valve guide 28 and the valve shaft 26. As shown in FIG. 17, a recessed part 160 having a rectanglar cross section is formed on a circumference of the valve shaft 26. The gap sensors 150, 152 and the recessed part 160 are positioned so that center parts of the gap sensors 150, 152 face a lower step 160*a* of the recessed part 160 when the engine valve 12 is in the fully closed position and the center parts of the gap sensors 150, 152 face an upper step 160*b* of the recessed part 160 when the engine valve 12 is in the neutral position. Thus, an axial length of the recessed part 160 substantially corresponds to a half of a displacement of the engine valve 12 between the fully closed position and the fully opened position.

The output voltage V of the gap sensors 150, 152 becomes a minimum value $V_{min}$ when the whole surfaces of the gap sensors 150, 152 face a circumferential part of the valve shaft 28 other than the recessed part 160 (hereinafter referred to as a general part of the valve shaft 28) and becomes a maximum value $V_{max}$ when the whole surfaces of the gap sensor a 150, 152 face to recessed part 160. It should be noted that the output voltage V of the gap sensors 150, 152 is defined as a mean value of the output voltages of the respective sensors.

Figure 18:
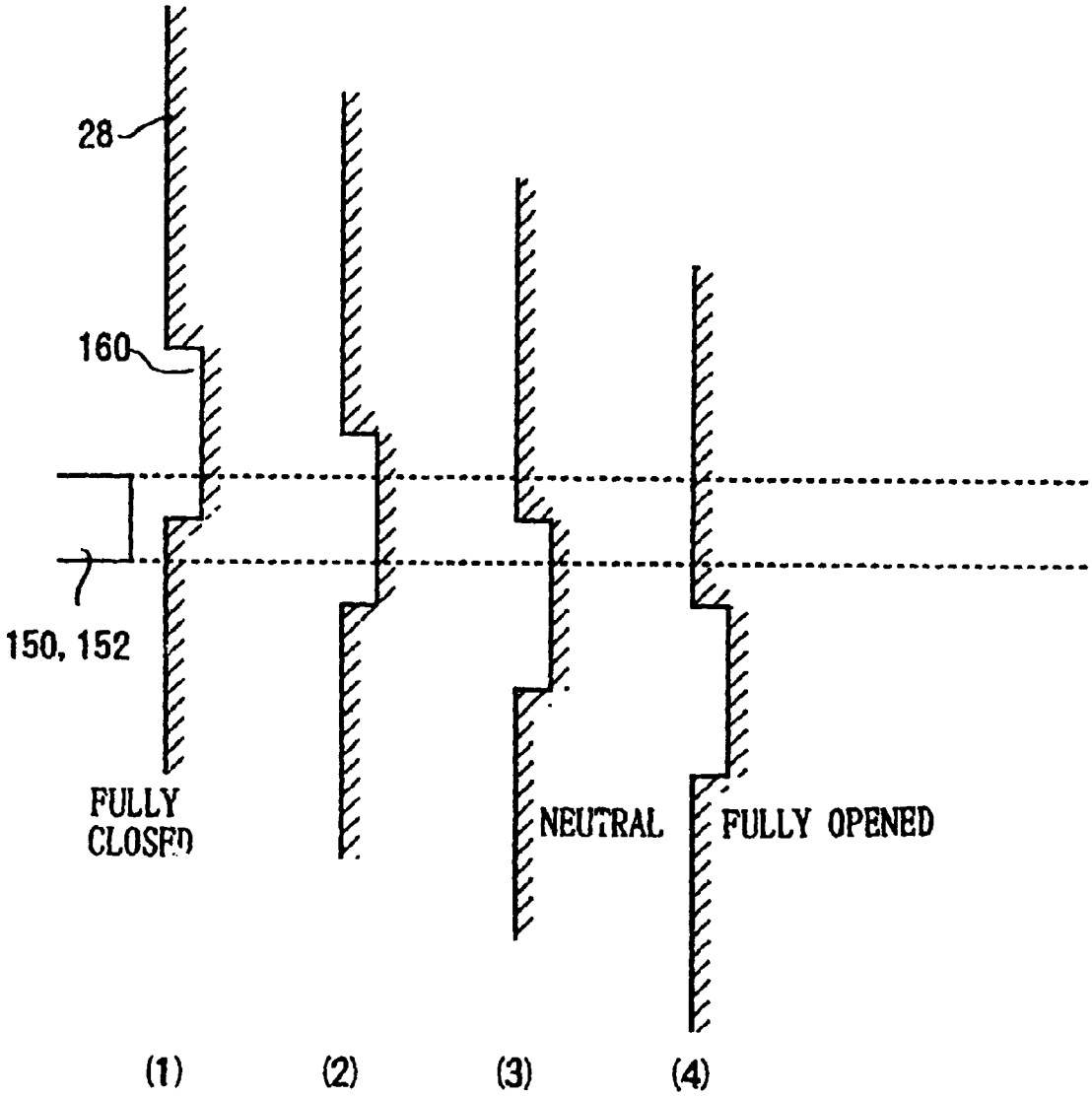
FIG. 18 is a diagram showing changes in a relative position of gap sensors and a recessed part provided on a valve shaft when the engine valve moves from the fully closed position to the fully opened position.
Figure 19:
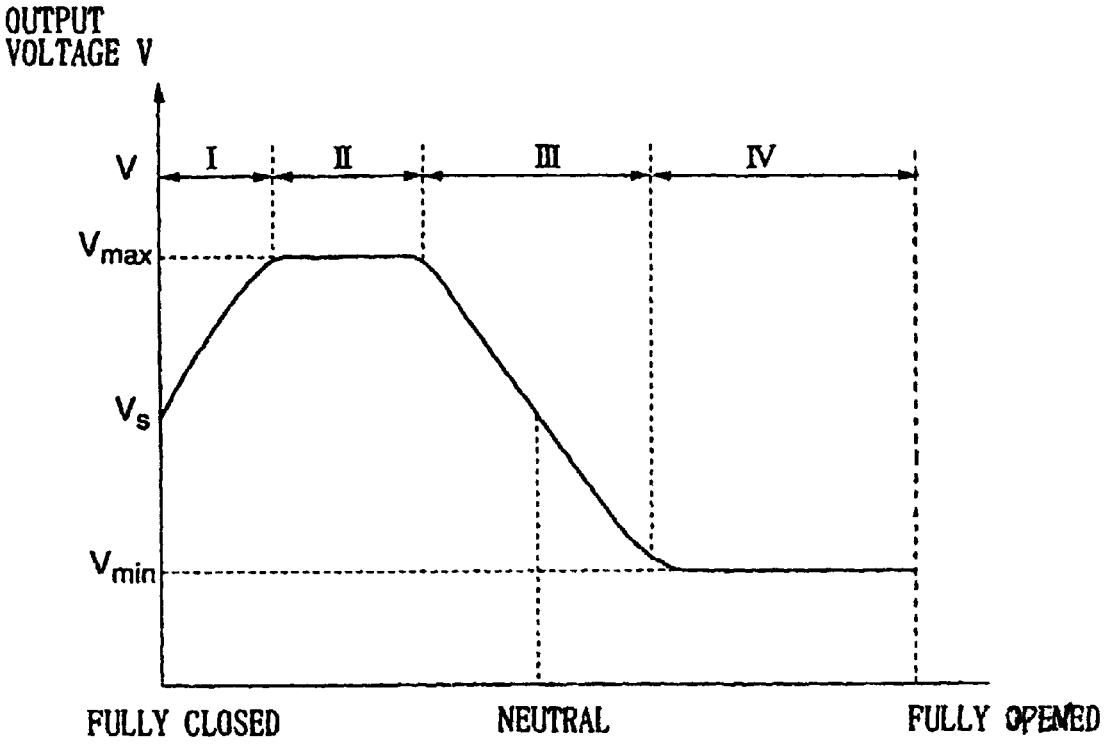
FIG. 19 is a diagram showing a change in the output voltage V when the engine valve moves from the fully closed position to the fully opened position.

FIG. 18 is a diagram showing changes in a relative position of the gap sensors 150, 152 and the recessed part 160 when the engine valve 12 moves from the fully closed position to the fully opened position. FIG. 19 is a diagram showing a change in the output voltage V when the engine valve 12 moves from the fully closed position to the fully opened position.

As shown in a state (1) of the FIG. 18, when the engine valve 12 is in the fully closed position, substantially half surfaces of the gap sensors 150, 152 face the general part of the valve shaft 28 and the other half surfaces face the recessed part 160. In this state, the output voltage V is an intermediate value $V_s$ ($\approx(V_{max}+V_{min})/2$).

After the engine valve 12 has started moving from the fully closed position in the valve-opening direction, the output voltage V increases as shown in a period I of FIG. 19 since areas of the gap sensors 150, 152 facing the recessed part 160 increases. After the engine valve 12 has moved until the whole surfaces of the gap sensors 150, 152 face the recessed part 160 as shown in a state (2) of the FIG. 18, the output voltage V is maintained to be the maximum voltage $V_{max}$ as shown in a period II of FIG. 19.

When the engine valve 12 has reached near the neutral position, the gap sensors 150, 152 face the upper step 160*b* of the recessed part 160 as shown in a state (3) of FIG. 18. In this state, the output voltage V decreases as the engine valve 12 moves in the valve-opening direction as shown in a period III of FIG. 19. After the engine valve 12 has further moved in the valve-opening direction until the whole surfaces of the gap sensors 150, 152 face the general part of the valve shaft 28, the output voltage V is maintained to be the minimum voltage $V_{min}$ until the engine valve 12 reaches the fully opened position as shown in a period IV of FIG. 19.

As mentioned above, when the engine valve 12 is moving near the neutral position as shown in the period III of FIG. 19, the output voltage V changes in accordance with a position of the engine valve 12. That is, as the engine valve 12 moves in an upward direction in association with the leak-down of the zero-lash adjuster 40, the output voltage V becomes larger as compared to a value of the output voltage V in the zero-lash state. Accordingly, the ECU 11 can detect a position of the engine valve 12 at a time when the ignition switch is turned on based on the output voltage V at that time and thus can indirectly detect a displacement of the armature 56 from the reference neutral position toward the lower core 64 based on the detected position of the engine valve 12.

It should be noted that the value $V_s$ of the output voltage V in a state where the engine valve 12 is in the fully closed position changes in accordance with a relative position of the armature 56 and the engine valve 12. Thus, it can be determined whether or not the zero-lash state is achieved based on the value $V_s$ of the output voltage V at a time when the initial actuation is completed. If it is determined that the zero-lash state is not yet achieved after the initial actuation is completed, instruction currents supplied to the upper coil 58 may be increased as compared to a regular situation for a certain period after the operating period has started so that the engine valve 12 can be positively actuated between the fully closed position and the fully opened position.

Additionally, a position of the recessed part 160 of the valve shaft 28 changes in accordance with thermal expansion of the engine valve 12. Thus, thermal expansion of the engine valve 12 can be detected based on the value $V_s$ of the output voltage V when the engine valve 12 is in the fully closed position.

Further, since the mean value of the outputs voltages of the gap sensors 150, 152 is used as the output voltage V, it is possible to compensate for a change in the output voltages of the respective sensors due to a radial displacement of the engine valve 28. Thus, it is possible to precisely detect a position of the engine valve 12.

Figure 20:
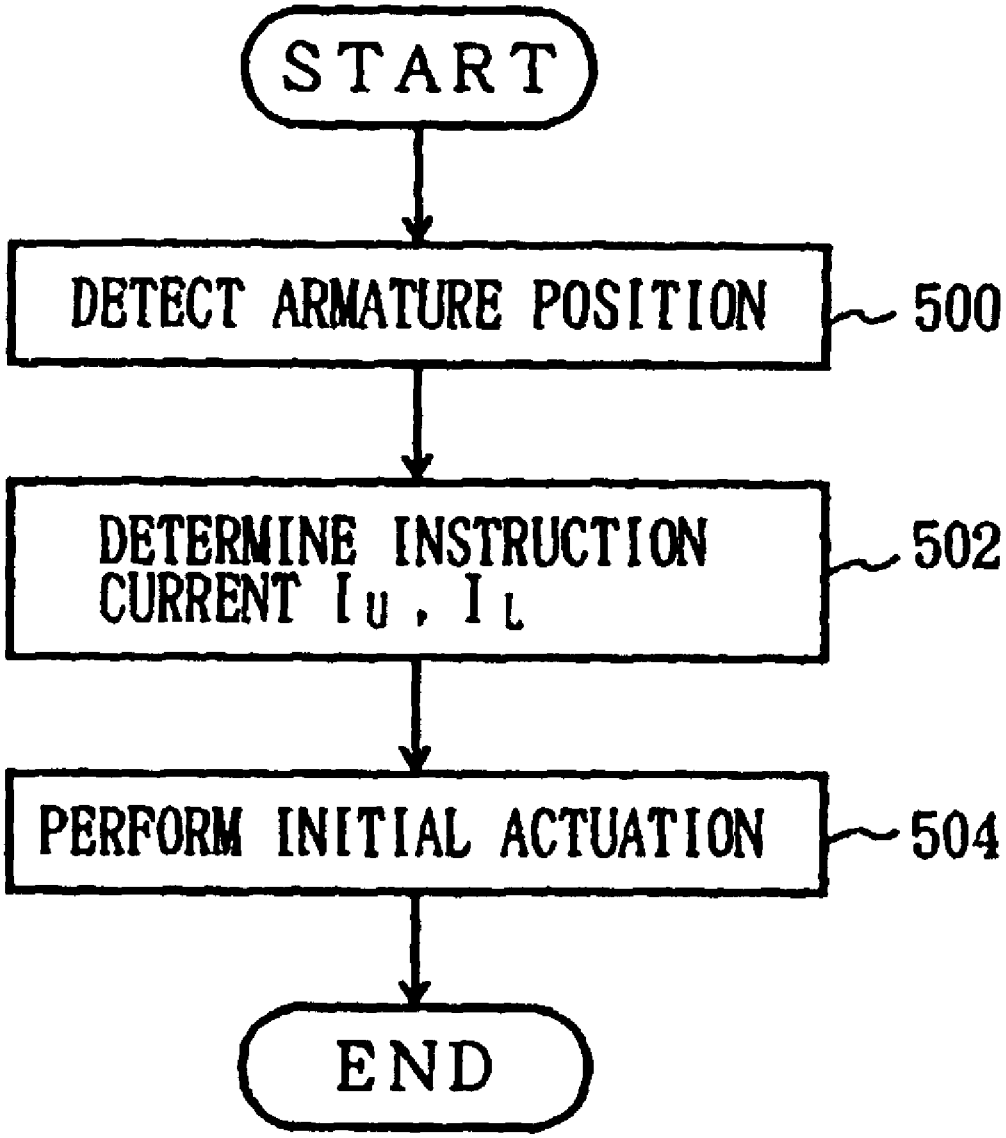
FIG. 20 is a flowchart performed by an ECU in the present embodiment.

FIG. 20 is a flowchart performed by the ECU 11 so as to determine the instruction currents $I_L$ and $I_U$ in the initial actuation. The routine shown in FIG. 20 is performed once immediately after the ignition switch is turned on. When the routine shown in FIG. 20 is started, the process of step 500 is performed first.

In step 500, a position of the armature 56 is detected based on the output voltage V, as mentioned above.

In step 502, the instruction currents $I_L$ and $I_U$ in the initial actuation are determined based on the detected position of the armature 56 by referring to the map shown in FIG. 15.

In step 504, a process is performed for starting the initial actuation using the instruction currents $I_L$ and $I_U$ determined in step 502. When the process of step 504 is finished, the present routine is ended.

As mentioned above, the instruction currents $I_L$, $I_U$ in the initial actuation are determined in accordance with a position of the armature 56 before the initial actuation is started. Thus, according to the present embodiment, it is possible to properly perform the initial actuation while suppressing the power consumption in the initial actuation, irrespective of a change in a position of the armature 56 due to the leak-down of the zero-lash adjuster 40.

In the present embodiment, a position of the armature 56 is indirectly detected by detecting a position of the valve shaft 28 based on a fact that the valve shaft 28 and the armature 56 shift by substantially the same distance in association with the leak-down of the zero-lash adjuster 40. However, a position of the armature 56 may also be directly detected.

Figure 21:
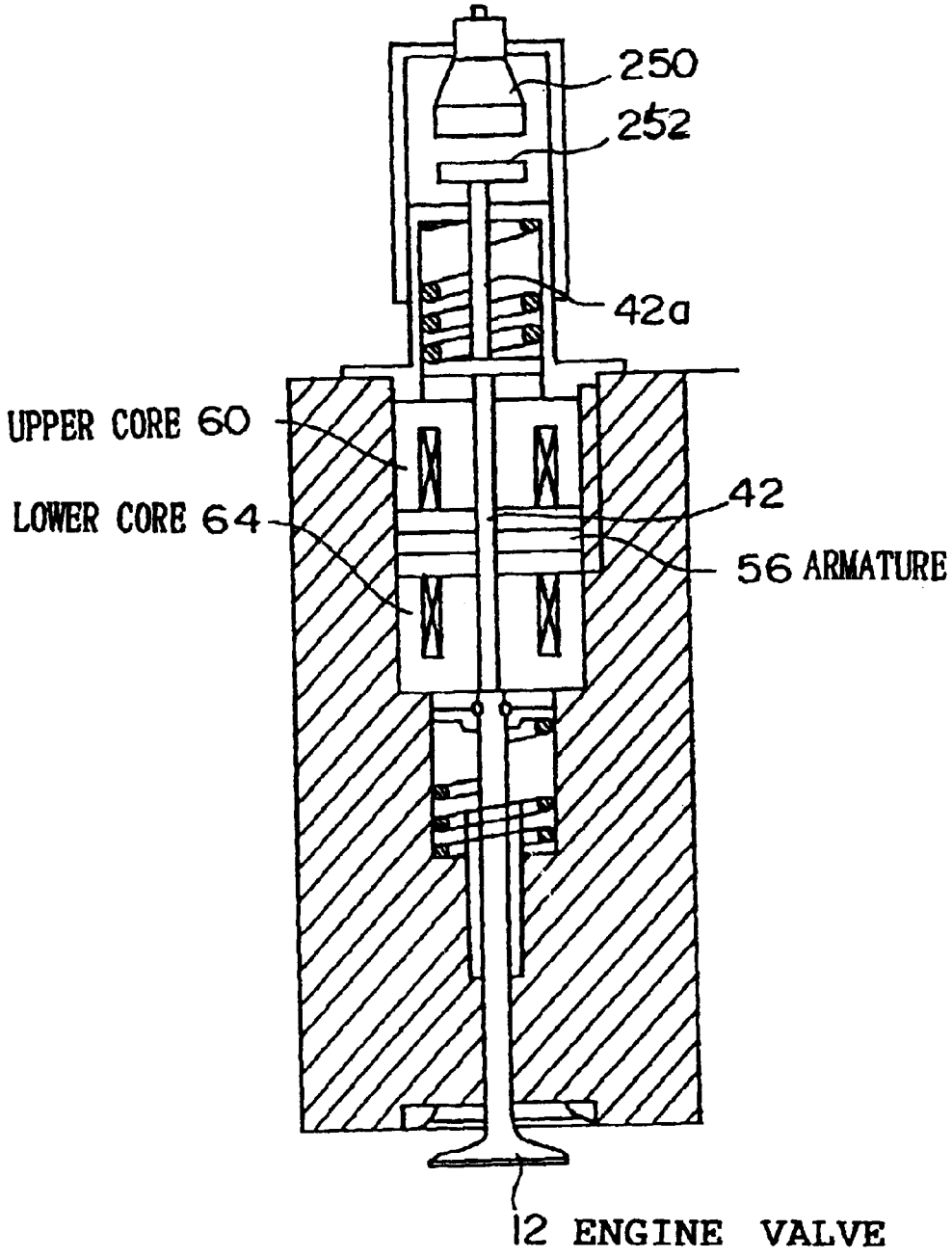
FIG. 21 is a diagram showing an example of an arrangement for directly detecting a position of the armature using a gap sensor.

FIG. 21 is a diagram showing an example of an arrangement for directly detecting a position of the armature 56 by using a gap sensor 250. In the arrangement shown in FIG. 21, the armature shaft 42 is provided with an extended part 42*a* upwardly extending through the adjuster bolt 52. A measurement target 252 is fixed to an end face of the extended part 42*a*. The gap sensor 250, which can be an eddy-current gap sensor for example, is supported above the measurement target 252. The gap sensor 250 delivers an electric signal to the ECU 11 in accordance with a distance to the measurement target 252. Thus, according to the arrangement shown in FIG. 11, a position of the armature 56 can be directly detected.

Figure 22:
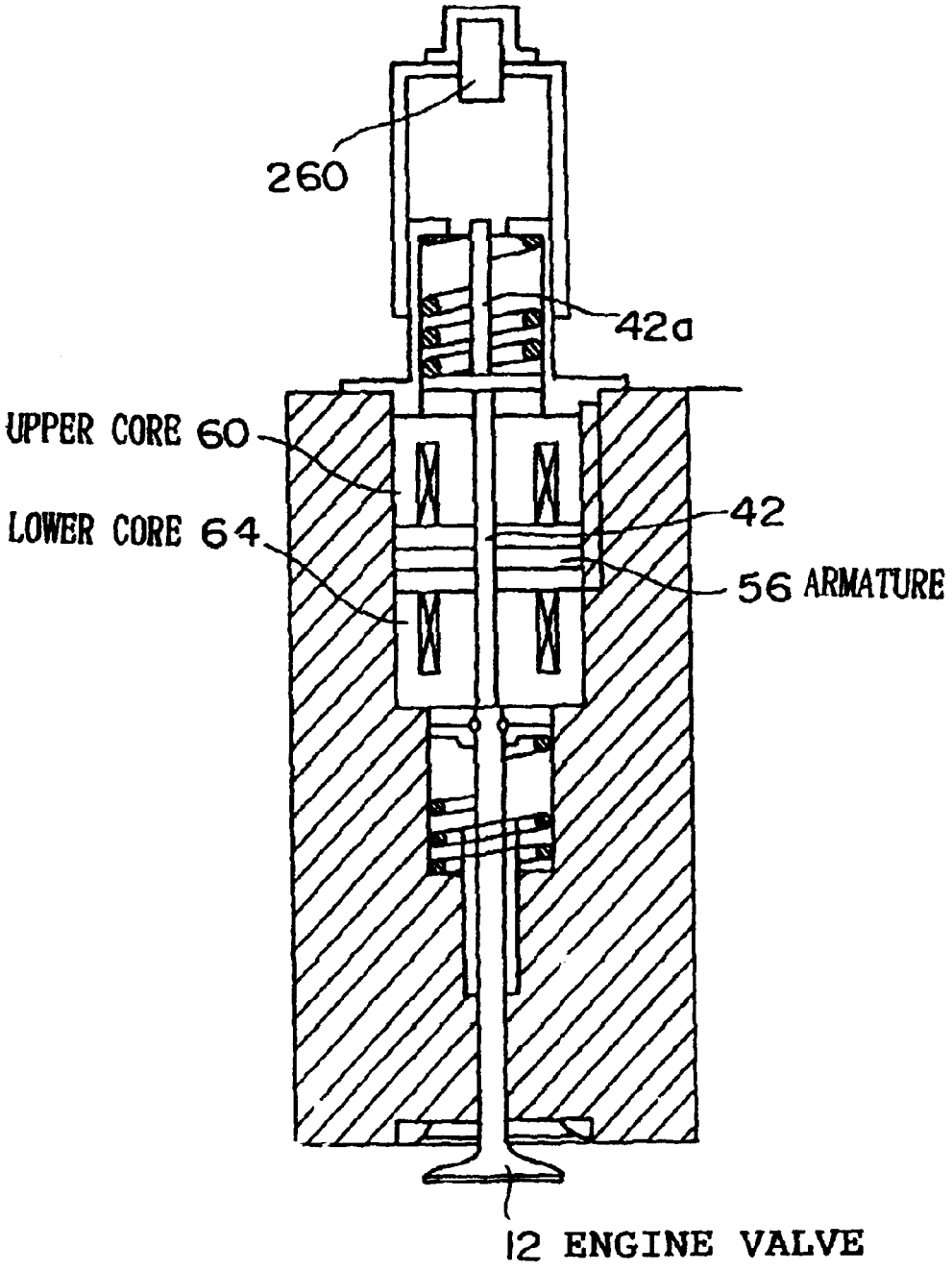
FIG. 22 is a diagram showing an example of an arrangement for directly detecting a position of the armature using a laser distance sensor.

FIG. 22 shows an example of an arrangement for directly measuring a position of the armature 56 by using a laser distance sensor 260. The laser distance sensor 260 projects a laser light emitted by a laser diode on a target to be measured, and detects a distance to the target based on a position of the reflected light from the target using a principle of triangulation. The armature shaft 42 is provided with the extended part 42*a* upwardly extending through the adjuster bolt 52 as the arrangement shown in FIG. 21. A laser light from the laser distance sensor 260 is projected on an end face of the extended part 42*a*. Since the laser light has a small diameter, only a small surface is required for the measurement as compared to a case of an eddy-current gap sensor. Thus, in the arrangement shown in FIG. 22, the measured target 252 of the arrangement shown in FIG. 21 need not be provided.

Next, a description will be given of a sixth embodiment of the present invention. In the present embodiment, if the zero-lash state is not achieved at a time when the initial actuation is completed, the instruction currents to the upper coil 58 and the lower coil 62 are changed as compared to a regular situation for a predetermined period after start of the actuating period.

Figure 23A:
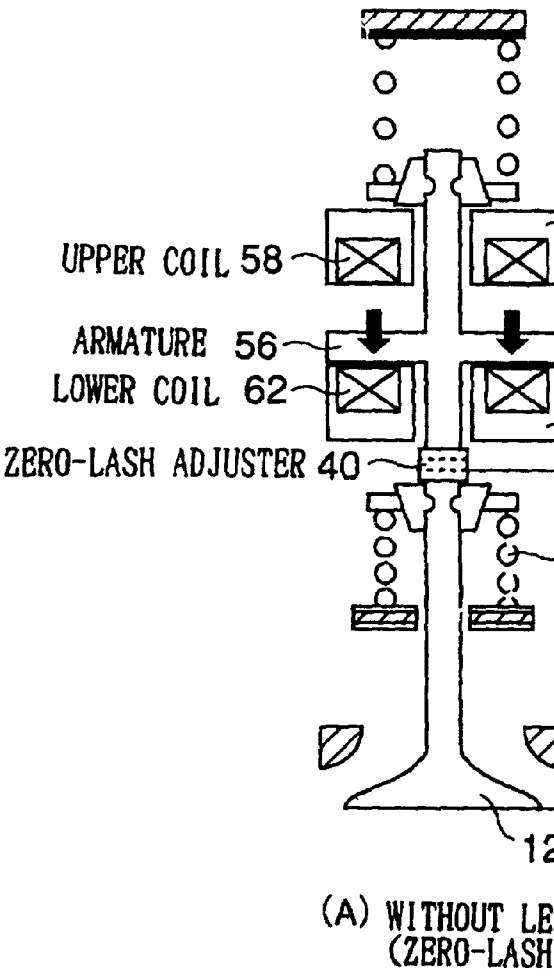
FIGS. 23A and 23B are diagrams schematically showing the solenoid valve device when the armature is in the fully opened position in a case where leak-down of the zero-lash adjuster has not occurred and in a case where leak-down of the zero-lash adjuster has occurred, respectively.
Figure 23B:
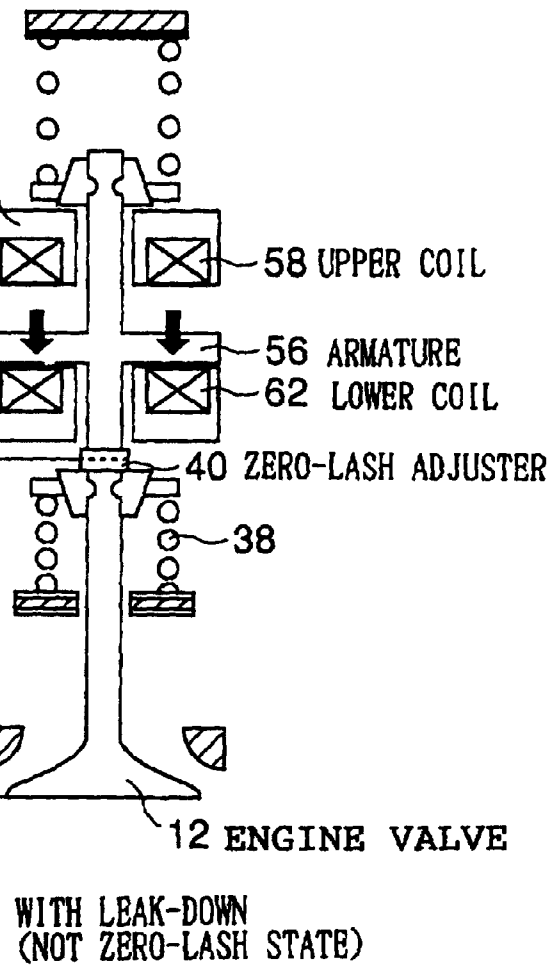

FIGS. 23A and 23B are diagrams schematically showing the solenoid valve device 10 when the armature 56 is in the fully opened position in a case where the leak-down of the zero-lash adjuster 40 has not occurred and in a case where leak-down of the zero-lash adjuster 40 has occurred, respectively.

In a case where the leak-down has occurred as shown in FIG. 23B, the engine valve 12 shifts toward the armature 56 as compared to a case where the leak-down has not occurred as shown in FIG. 23A. Thus, an amount of contraction of the lower spring 38 decreases in accordance with an extent of the leak-down. In this case, since a resilient force acting on the engine valve 12 in the valve-closing direction decreases, a current to be supplied to the upper coil 58 for actuating the engine valve 12 in the valve-closing direction increases. Additionally, in a case where the leak-down has occurred, a distance for which the armature 56 must actuate the engine valve 12 becomes smaller by an amount of the tappet clearance when the engine valve 12 is actuated from the fully closed position in the valve-opening direction. Thus, a current to be supplied to the lower coil 62 for opening the engine valve 12 is smaller as compared to a case where no leak-down has occurred.

As mentioned above, when the leak-down of the zero-lash adjuster 40 has occurred, a current to be supplied to the upper coil 58 increases and a current to be supplied to the lower coil 62 decreases, as compared to a case where no leak-down has occurred. Thus, in the present embodiment, an instruction current to the lower coil 62 is set to be smaller than an instruction current to the upper coil 58 for a predetermined period after the initial actuation is completed, so that the engine valve 12 can be positively actuated between the fully closed position and the fully opened position while suppressing power consumption of the solenoid valve device 10.

FIGS. 24A and 24B are diagrams showing the instruction currents supplied to the upper coil 58 and the lower coil 62, respectively. In FIGS. 24A and 24B, instruction currents used in a regular situation (that is, when the zero-lash state is being achieved) is indicated by dotted lines.

As shown in FIGS. 24A and 24B, for predetermined N cycles after the operating period is started, the attracting current $I_A$ and the holding current $I_H$ to the lower coil 62 are set to be values $I_{A1}$ and $I_{H1}$, respectively, which are smaller than the respective base values $I_{A0}$ and $I_{H0}$ used in the regular situation, and the attracting current $I_A$ and the holding current $I_H$ to the upper coil 58 are set to be values $I_{A2}$ and $I_{H2}$, respectively, which are larger than the respective base values $I_{A0}$ and $I_{H0}$. Here, one cycle means a process in which the engine valve 12 moves back and forth between the fully closed position and the fully opened position. The predetermined number N is set to be a number of the cycles required to supply a sufficient oil pressure to the zero-lash adjuster 40 for achieving the zero-lash state.

After the N cycles have finished after start of the actuating period, the attracting current $I_A$ and the holding current $I_H$ to the upper coil 58 are gradually decreased from $I_{A2}$ and $I_{H2}$ to $I_{A0}$ and $I_{H0}$, respectively, and the attracting current $I_A$ and the holding current $I_H$ to the lower coil 62 are increased from $I_{A1}$ and $I_{H1}$ to $I_{A0}$ and $I_{H0}$, respectively, for a predetermined $N_1$ cycles.

It should be noted that each of the base values $I_{A0}$ and $I_{H0}$ may be different for the upper coil 58 and the lower coil 62.

Figure 25:
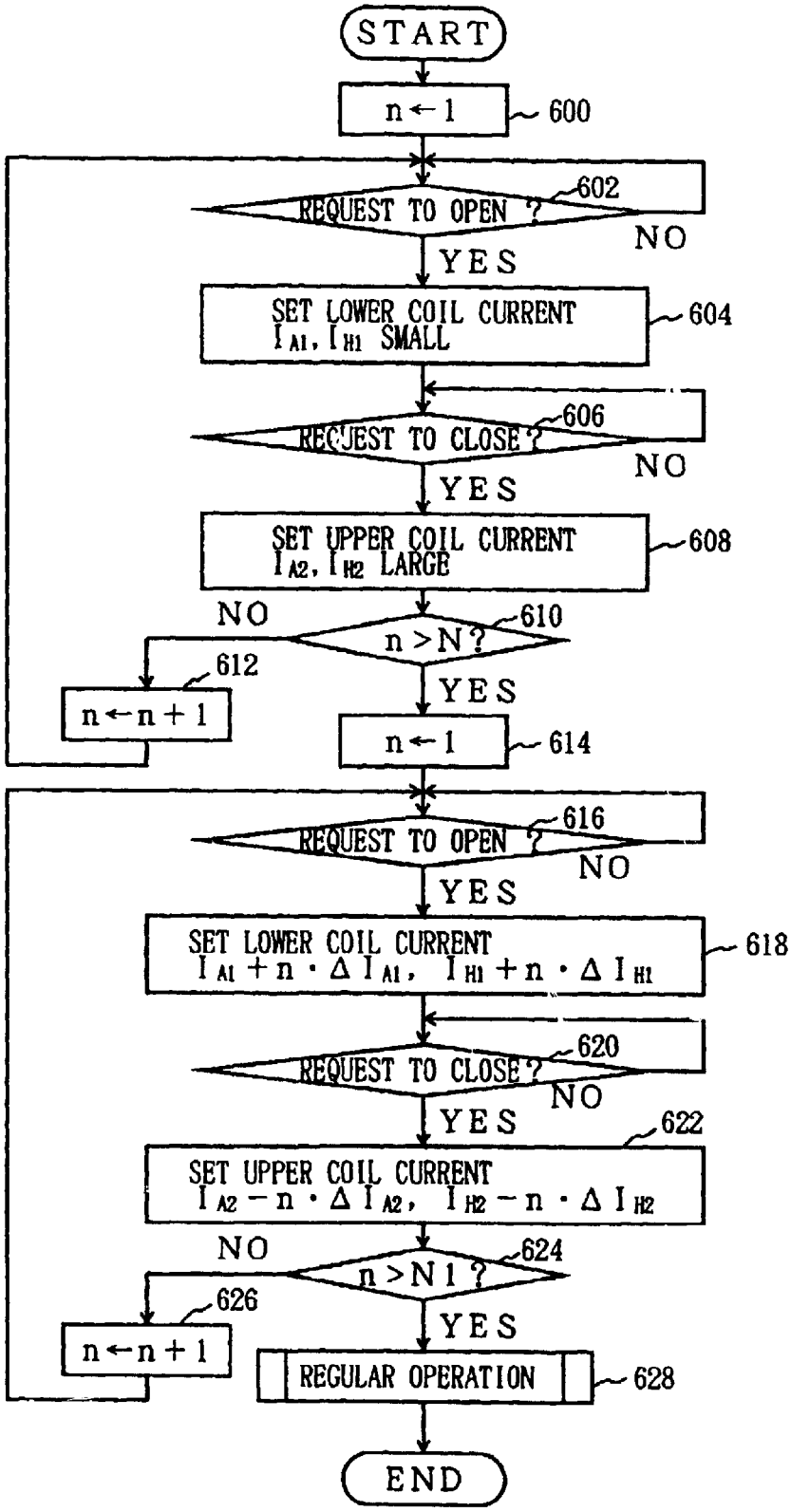
FIG. 25 is a diagram showing a flowchart of a routine performed by the ECU in the present embodiment.

FIG. 25 is a diagram showing a flowchart of a routine performed by the ECU 11 so as to achieve the above-mentioned operation. The routine shown in FIG. 25 is performed once at a time when the initial actuation is completed. When the routine shown in FIG. 25 is started, the process of step 500 is performed first.

In step 600, a variable n indicating a number of the cycles is initialized to be "1".

In step 602, it is determined whether or not a request to open the engine valve 12 is generated. The process of step 602 is repeatedly performed until the request is generated. If the request to open the engine valve 12 is generated, then the process of step 604 is performed.

In step 604, a process for supplying a smaller current to the lower coil 62 as compared to the regular situation, that is, a process for supplying an instruction current to the lower coil 62 with the attracting current $I_A$ being $I_{A1}$ and the holding current $I_H$ being $I_{H1}$, is performed.

In step 606, it is determined whether or not a request to close the engine valve 12 is generated. The process of step 606 is repeatedly performed until the request is generated. If the request to close the engine valve 12 is generated in step 606, then the process of step 608 is performed.

In step 608, a process for supplying a larger current to the upper coil 58 as compared to the regular situation, that is, a process for supplying an instruction current to the upper coil 58 with the attracting current $I_A$ being $I_{A2}$ and the holding current $I_H$ being $I_{H2}$, is performed.

In step 610, it is determined whether or not a relationship n>N is established. If n>N is not established, the valuable n is increased by one in step 612 and then the process of step 602 is performed again. On the other hand, if n>N is established in step 610, then the process of step 614 is performed.

In step 614, the variable n is initialized to be "1" again.

In step 616, it is determined whether or not a request to open the engine valve 12 is generated. The process of step 616 is repeatedly performed until the request is generated. If the request to open the engine valve 12 is generated in step 616, then the process of step 618 is performed.

In step 618, an instruction current is supplied to the lower coil 62 with the attracting current $I_A$ being $I_{A1}+n\cdot\Delta I_{A1}$ and the holding current $I_H$ being $I_{H1}+n\cdot\Delta I_{H1}$. The values $\Delta I_{A1}$ and $\Delta I_{H1}$ are set to be $(I_{A0}-I_{A1})/N_1$ and $(I_{H0}-I_{H1})/N_1$, respectively. According to the process of step 618, the attracting current $I_A$ and the holding current $I_H$ to the lower coil 62 are gradually increased to the base values $I_{A0}$ and $I_{H0}$, respectively.

In step 620, it is determined whether or not a request to close the engine valve 12 is generated. The process of step 620 is repeatedly performed until the request is generated. If the request to close the engine valve 12 is generated in step 620, then the process of step 622 is performed.

In step 622, an instruction current is supplied to the upper coil 58 with the attracting current $I_A$ being $I_{A2}-n\cdot\Delta I_{A2}$ and the holding current $I_H$ being $I_{H2}-n\cdot\Delta I_{H2}$. The values $\Delta I_{A2}$ and $\Delta I_{H2}$ are set to be $(I_{A2}-I_{A0})/N_1$ and $(I_{H2}-I_{H0})/N_1$, respectively. According to the process of step 622, the attracting current $I_A$ and the holding current $I_H$ to the lower coil 62 are gradually decreased to the base values $I_{A0}$ and $I_{H0}$, respectively.

In step 624, it is determined whether a relationship $n>N_1$ is established. If $n>N_1$ is not established, the variable n is increased by one in step 626 and then the process of step 616 is performed again. On the other hand, if $n>N_1$ is established in step 624, then a process for achieving a regular operation of the engine valve 12 is performed in step 628. Specifically, in step 628, instruction currents are supplied to the lower coil 62 and the upper coil 58 with the attracting current $I_A$ being $I_{A0}$ and the holding current $I_H$ being $I_{H0}$ each time when requests to open and close the engine valve 12, respectively, are generated.

As mentioned above, in the present embodiment, since the attracting current $I_A$ and the holding current $I^H$ which are larger than the respective values in the regular situation are supplied to the upper coil 58 for the predetermined N cycles after the initial actuation is completed, the armature 56 can be moved until the armature 56 is in contact with the upper core 60 in a situation where the leak-down of the zero-lash adjuster 40 has occurred. Thus, according the present embodiment, it is possible to positively actuate the engine valve 12 between the fully closed position and the fully opened position.

Additionally, if the armature 56 is not attracted to be in contact with the upper core 60 by the attracting current $I_A$ and the armature 56 is re-attracted to the upper core 60 by the transition current $I_T$ or the holding current $I_H$, a large impact sound may be generated by the armature 56 impacting on the upper core 60 with a high speed. According to the present embodiment, since the armature 56 can be positively attracted by the attracting current $I_A$ until the armature 56 comes into contact with the upper core 56, it is possible to prevent generation of the above-mentioned large impact sound.

Further, since the attracting current $I_A$ and the holding current $I_H$ which are smaller than the respective values in the regular situation are supplied to the lower coil 62 for the N cycles, it is possible to prevent an excessive electromagnetic force from acting on the armature 56 in the valve-opening direction. Thus, according to the present embodiment, it is possible to prevent a generation of a large impact sound due to a high-speed impact of the armature 56 and the lower core 64 while suppressing power consumption in the lower coil 62.

In the present embodiment, the instruction currents to the respective coils are changed after the initial actuation which is performed when the engine is started. However, when a desynchronization (a phenomenon in which the armature 56 cannot be attracted to the upper core 60 or the lower core 64 and the armature 56 is held in the neutral position) of the solenoid vale 10 has occurred, a process similar to the initial actuation is performed for actuating the armature 56 to the fully closed position so that the solenoid valve device 10 can be recovered from the desynchronization. Thus, the instruction currents to the respective coils may be changed for a predetermined cycles after the process for recovering the solenoid valve device 10 from the desynchronization is finished.

Additionally, in the present embodiment, both the attraction current $I_A$ and the holding current $I_H$ are changed. However, it is also possible to change only the attracting current $I_A$ while always using the base value $I^{H0}$ as the holding current $I_H$.

Further, in the present embodiment, the attracting current $I_A$ and the holding current $I_H$ are fixed to be $I_{A1}$ or $I_{A2}$ and $I_{H1}$ or $I_{H2}$, respectively, for the N cycles, and gradually changed toward the base values $I_{A0}$ and $I_{H0}$, respectively, in the next $N_1$ cycles. However, it is also possible to gradually change the attracting current $I_A$ and the holding current $I_H$ toward the base values $I_{A0}$ and $I_{H0}$, respectively, immediately after start of the operating period.

Next, a description will be given of a seventh embodiment of the present invention. In the present embodiment, the values $I_{A1}$ and $I_{A2}$ of the attracting current $I_A$ and the values $I_{H1}$ and $I_{H2}$ of the holding current are set in accordance with an elapsed time for which the actuation of the engine valve 12 has been stopped, in view of a fact that an amount of the leak-down of the zero-lash adjuster 40 changes in accordance with the above-mentioned elapsed time.

As mentioned above, the leak-down of the zero-lash adjuster 40 is a phenomenon in which oil gradually leaks out from the zero-lash adjuster 40 in a state where the armature 56 is held near the neutral position, that is, in a state where the zero-lash adjuster 40 cannot be supplied with an oil pressure. Accordingly, an amount of the leak-down of the zero-lash adjuster 40 becomes larger as the armature 56 is held near the neutral position (that is, the ignition switch is maintained to be turned off, for example) for a longer time. Thus, in the present embodiment, the values $I_{A1}$ and $I_{A2}$ of the attracting current $I_A$ and the values $I_{H1}$ and $I_{H2}$ of the holding current to the upper coil 58 and the lower coil 62 are set in accordance with an elapsed time after the zero-lash adjuster 40 was stopped being supplied with an oil pressure. Hereinafter, this elapsed time is referred to as a valve stopping time $T_s$.

Figure 26:
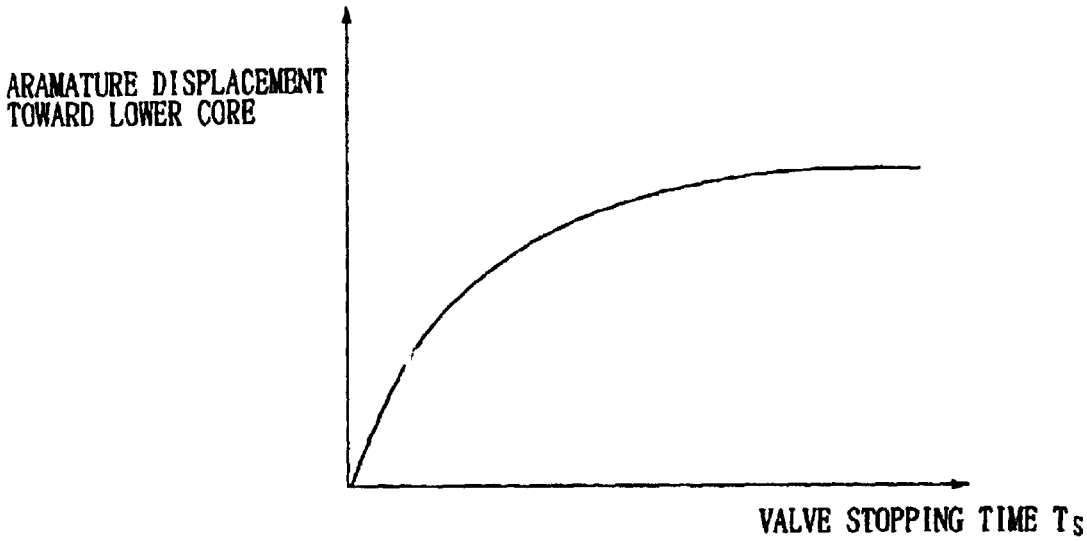
FIG. 26 is a diagram showing an example of a relationship between a valve stopping time $T_S$ and a displacement of the armature toward the lower core from a reference neutral position.

FIG. 26 is a diagram showing an example of a relationship between the valve stopping time $T_s$ and a displacement of the armature 56 toward the lower core 64 from the reference neutral position. The relationship shown in FIG. 26 can be experimentally obtained by measuring positions of the armature 56 for various values of valve stopping time $T_s$.

Figure 27:
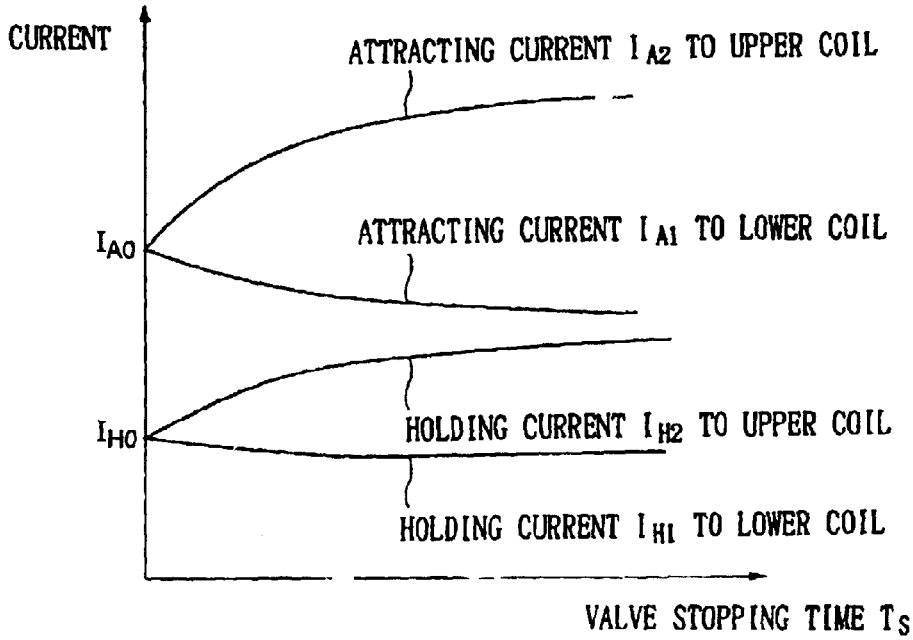
FIG. 27 is a map which is referred to so as to determine the values $I_{A1}$, $I_{A2}$ of the attracting current $I_A$ and the values $I_{H1}$, $I_{H2}$ of the holding current $I_H$ based on the valve stopping time $T_s$ in a seventh embodiment of the present invention.

FIG. 27 is a map which is referred to so as to determine the values $I_{A1}$, $I_{A2}$ of the attracting current $I_A$ and the values $I_{H1}$, $I_{H2}$ of the holding current $I_H$ based on the valve stopping time $T_s$.

As shown in FIG. 26, a displacement of the armature 56 toward the lower core 64 from the reference neutral position becomes larger for a longer valve stopping time $T_s$. In accordance with this, the value $I_{A2}$ of the attracting current $I_A$ and the value $I_{H2}$ of the holding current $I_H$ to the upper coil 58 are set to be larger and the value $I_{A1}$ of the attracting current $I_A$ and the value $I_{H1}$ of the holding current $I_H$ to the lower coil 62 are set to be smaller for a longer valve stopping time $T_s$, as shown in FIG. 27. Thus, according to the present embodiment, it is possible to more properly set the instruction currents to the respective coils in accordance with a position of the armature 56.

Figure 28:
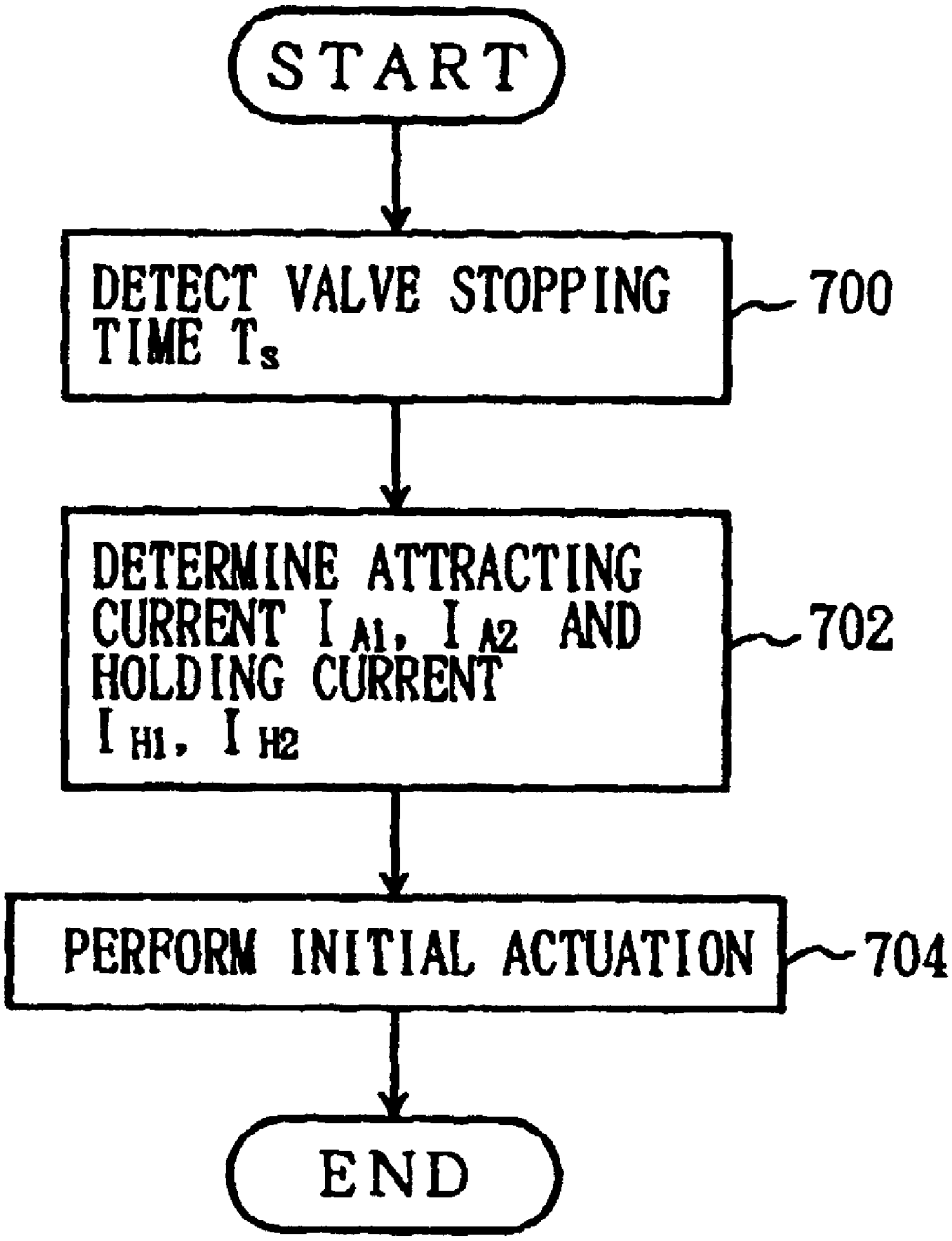
FIG. 28 is diagram showing a flowchart of a routine performed by the ECU in the present embodiment.

FIG. 28 is diagram showing a flowchart of a routine performed by the ECU 11 so as to determine the values $I_{A1}$, $I_{A2}$ and $I_{H1}$, $I_{H2}$ as mentioned above. The routine shown in FIG. 28 is performed once when the ignition switch is turned on. In the present embodiment, the above-mentioned routine shown in FIG. 25 is performed together with the routine shown in FIG. 28. When the routine shown in FIG. 28 is started, the process of step 700 is performed first.

In step 700, the valve stopping time Ts (that is, a time for which the ignition switch has been turned off) is detected. The ECU 11 includes a counter which counts an elapsed time. Thus, the ECU 11 can detect the valve stopping time $T_s$ based on the counter value by resetting the counter when the ignition switch is turned off.

In step 702, the values $I_{A1}$, $I_{A2}$ of the attracting current $I_A$ and the values $I_{H1}$, $I_{H2}$ of the holding current $I_H$ to the respective coils are determined based on the valve stopping time $T_s$ by referring to the map shown in FIG. 27.

In step 704, a process for achieving the initial actuation is performed. When the process of step 704 is finished, the present routine is ended and then the routine shown in FIG. 25 is performed using the values $I_{A1}$, $I_{A2}$, $I_{H1}$, $I_{H2}$ determined in step 702.

In the present embodiment, the attracting current $I_A$ and the holding current $I_H$ are changed in accordance with the valve stopping time $T_s$ when the operating period is started. However, it is also possible to change the instruction currents $I_U$ and $I_L$ supplied to the respective coils in the initial actuation in accordance with the valve stopping time $T_s$.

Additionally, in the present embodiment, the valve stopping time $T_s$ is set to be a time for which the ignition switch has been turned off in view of a fact that the leak-down of the zero-lash adjuster 40 is caused when the ignition switch is turned off. However, the leak-down of the zero-lash adjuster 40 is also caused when the desynchronization of the solenoid valve device 10 has occurred. Thus, the valve stopping time $T_s$ may be set to be an elapsed time after the desynchronization was detected.

The desynchronization can be detected by, for example, comparing an actual current flowing trough the upper coil 58 or the lower coil 62 with an instruction current to that coil. That is, when the desynchronization has occurred, an inductance of the upper coil 58 or the lower coil 62 becomes small since the armature 56 is not in contact with the corresponding core 60 or 64*a,* and thus the actual current to that coil is highly responsive to a change in the instruction current as compared to a case where the armature 56 is in contact with the corresponding core 60 or 64. Thus, the desynchronization can be detected based on a change in the actual current when, for example, the holding current $I_H$ is shut off.

Next, a description will be given of an eighth embodiment of the present invention. In the present embodiment, the instruction currents to the respective coils are set in accordance with the supplied oil pressure P detected by the pressure sensor 84.

As mentioned above, since the oil pump 83 is operated by using a rotation of the output shaft of the engine as a power source, it takes a certain time for a discharge pressure of the oil pump 83 to reach a desired value after the engine is started. Additionally, a time delay occurs in transmission of an oil pressure from the oil pump 83 to the zero-lash adjuster 40. Thus, a tappet clearance is generated for a certain period after the armature 56 has moved to the fully closed position by the initial actuation, since the zero-lash adjuster is not supplied with a sufficient oil pressure for that period.

FIGS. 29A to 29E are diagrams showing changes in the engine speed, the supplied oil pressure P, the tappet clearance, the attracting current $I_A$ to the upper coil 58, and the attracting current $I_A$ to the lower coil 62.

Figures 29A, 29B, 29C, 29D, 29E:
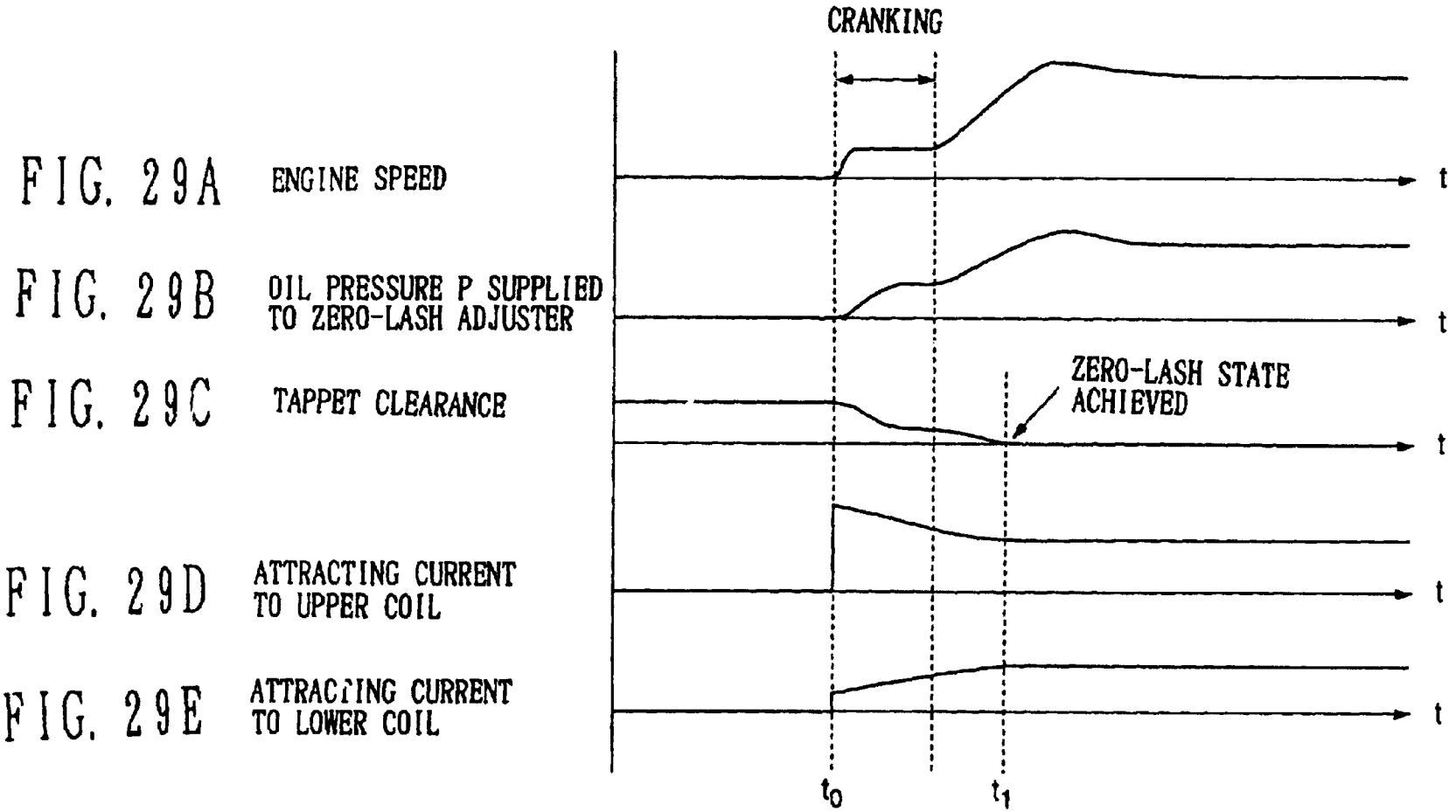
FIGS. 29A to 29E are diagrams showing changes in an engine speed, a supplied oil pressure P, a tappet clearance, an attracting current to the upper coil, and an attracting current to the lower coil 62 in an eighth embodiment of the present invention.

As shown in FIG. 29A, the engine speed increases in response to start of combustion through a cranking after the ignition switch is turned on at a time $t_0$. Since the discharge pressure of the oil pump 83 increases in accordance with the increase in the engine speed, the supplied oil pressure P starts increasing as shown in FIG. 29B. The tappet clearance gradually decreases with the increase in the supplied oil pressure P and the zero-lash state is achieved at a time $t_1$, as shown in FIG. 29C.

In the present embodiment, the attracting current $I_A$ to the upper coil 58 is set to be larger and the attracting current $I_A$ to the lower coil 62 is set to be smaller as compared to the regular situation in accordance with the supplied oil pressure P as shown in FIGS. 29D and 29E, in view of the above-mentioned fact that the tappet clearance decreases as the supplied oil pressure P increases.

Figure 30:
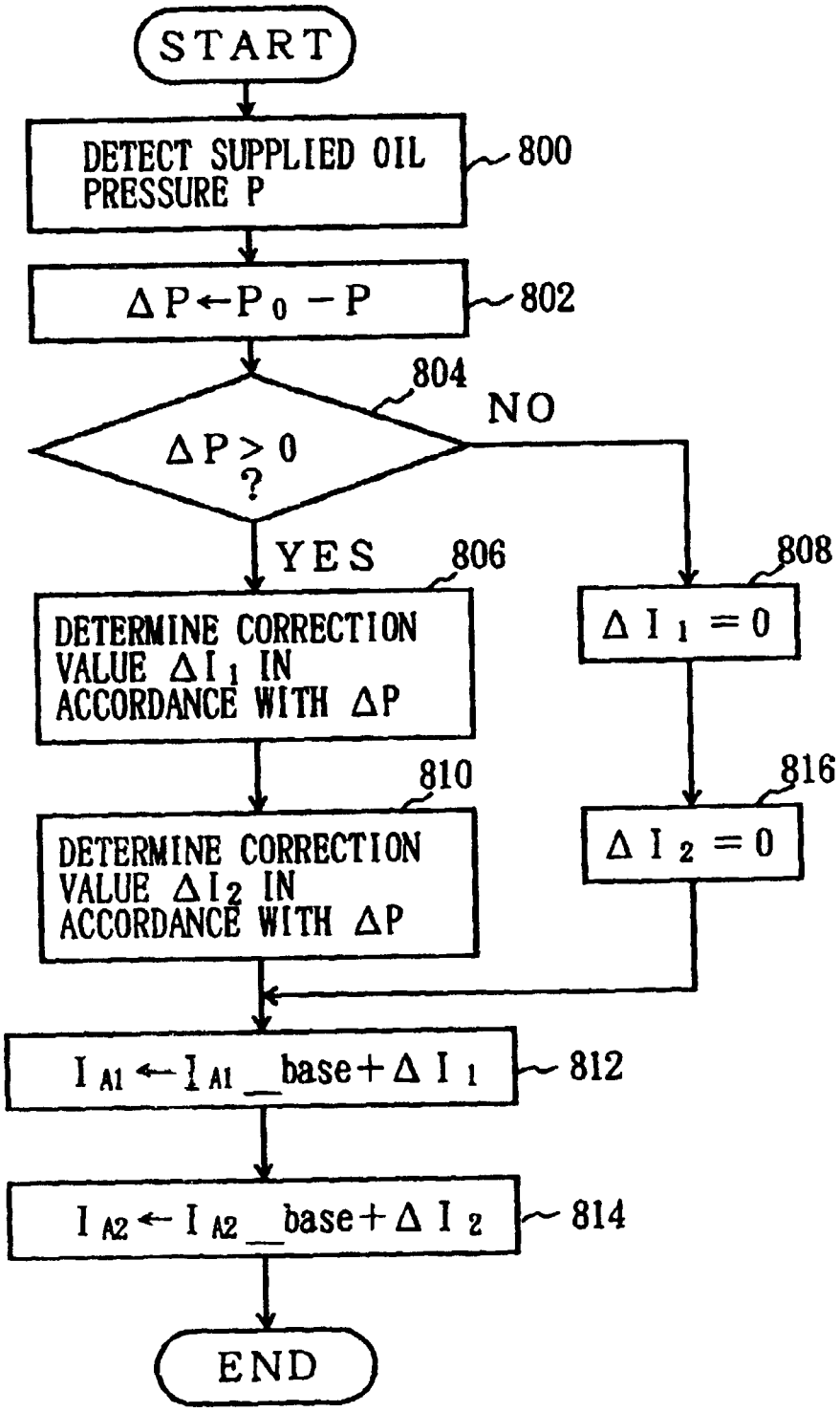
FIG. 30 is diagram showing a flowchart of a routine performed by the ECU in the present embodiment.

FIG. 30 is a diagram showing a flowchart of a routine performed by the ECU 11 so as to determined the values of attracting current $I_A$ to the upper coil 58 and the lower coil 62. The routine shown in FIG. 30 is started at predetermined time intervals after the initial actuation is finished. When the routine shown in FIG. 30 is started, the process of step 800 is performed first.

In step 800, the supplied oil pressure P is detected.

In step 802, a difference ΔP between the supplied oil pressure P and a predetermined reference pressure $P_0$ is calculated as $\Delta P=P-P_0$. The reference pressure $P_0$ is set to be a value of the supplied oil pressure P required to achieve the zero-lash state.

In step 804, it is determined whether or not the difference ΔP is a positive value. If $\Delta P>0$ is established, then the process of step 806 is performed. On the other hand, if $\Delta P>0$ is not established in step 804, then the process of step 808 is performed.

In step 806, a correction value $\Delta I_1(<0)$ for the attracting current $I_A$ to the lower coil 62 is determined based on the difference ΔP, and, in the subsequent step 810, a correction value $\Delta I_2(>0)$ for the attracting current $I_A$ to the upper coil 58 is determined based on the difference ΔP.

Figure 31:
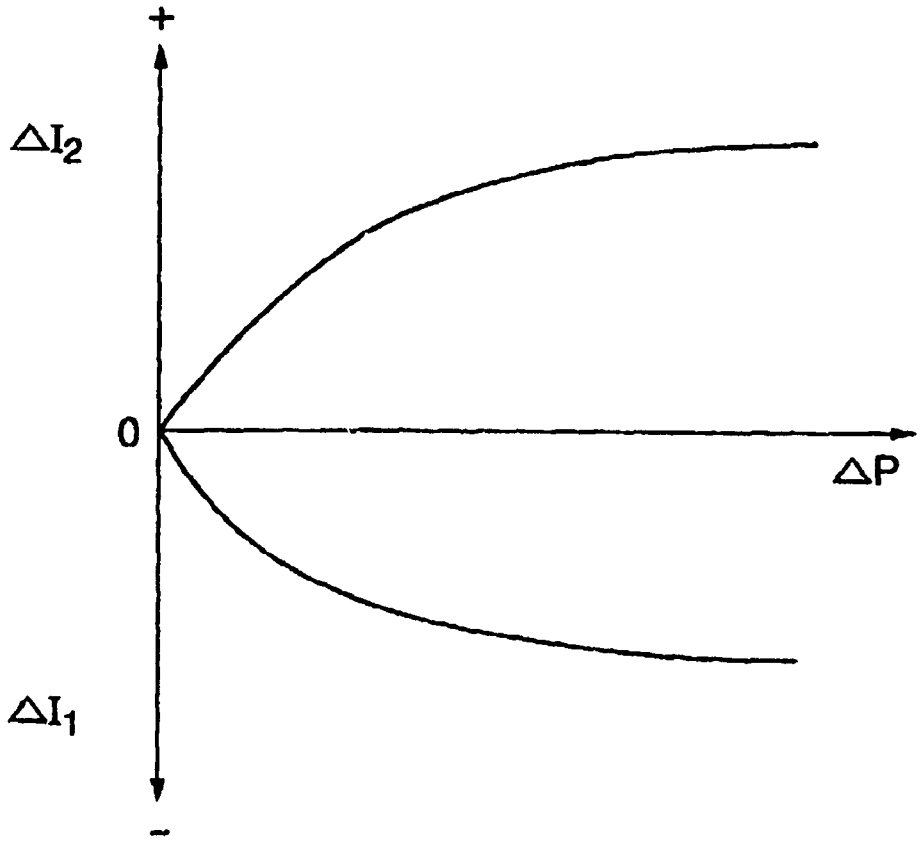
FIG. 31 is a diagram showing an example of a map which is referred to so as to determine correction values $\Delta I_1$ and $\Delta I_2$ in the routine shown in FIG. 30.

FIG. 31 is a diagram showing an example of a map which is referred to so as to determine the correction values $\Delta I_1$ and $\Delta I_2$ in the above-mentioned steps 506 and 510. The map shown in FIG. 31 can be obtained by experimentally determining optimal values of the attracting current $I_A$ to the respective coils for various values of the difference ΔP and calculating differences between the determined values and the base values $I_{A1_base}$, $I_{A2_base}$, respectively. As shown in FIG. 31, the correction value $\Delta I_2$ is set to be larger and the correction value $\Delta I_1$ is set to be smaller for a larger value of the difference ΔP.

In step 812, a value $I_{A1}$ of the attracting current $I_A$ to the lower coil 62 is calculated as $I_{A1}=I_{A1_base}+\Delta I_1$, and in the subsequent step 814, a value $I_{A2}$ of the attracting current $I_A$ to the upper coil 58 is calculated as $I_{A2}=I_{A2_base}+\Delta I_2$. The base values $I_{A1_base}$ and $I_{A2_base}$ base are set to be values of the attracting current $I_A$ to the lower coil 62 and the upper coil 58, respectively, in the zero-lash state, as mentioned in the sixth embodiment. When the process of step 814 is finished, the present routine is ended.

In step 808, the correction value $\Delta I_1$ is set to be "0", and in the subsequent step 816, the correction value $\Delta I_2$ is set to be "0". After the process of step 816 is finished, the process of the above-mentioned step 812 is performed. Thus, the base values $I_{A1_base}$ and $I_{A2_base}$ are used as values of the attracting current $I_A$ to the lower coil 62 and the upper coil 58, respectively, when $\Delta P \leqq 0$ is established, that is, when the supplied oil pressure P is equal to or larger than the reference pressure $P_0$.

As mentioned above, in the present embodiment, the attracting current $I_A$ to the lower coil 62 is set to be smaller and the attracting current to the upper coil 58 is set to be larger for a larger value of the difference ΔP, in view of the fact that the armature 56 shifts toward the lower core 64 as the supplied oil pressure P becomes lower (that is, as the difference ΔP becomes larger). Thus, according to the present embodiment, the optimal attracting currents $I_A$ can be supplied to the lower coil 62 and the upper coil 58 for actuating the armature 56 to the fully opened position and the fully closed position, respectively, so that the engine valve 12 can be positively actuated between the fully closed position and the fully opened position.

Next, a description will be given of a ninth embodiment of the present invention.

As shown in the above-mentioned FIGS. 29B and 29C, the supplied oil pressure P increases as a passage of time after the ignition switch is turned on, and the tappet clearance gradually decreases in accordance with the increase in the supplied oil pressure P. Thus, in the present embodiment, values of the attracting current $I_A$ to the respective coils are determined in accordance with an elapsed time Th after the ignition switch is turned on.

Figure 32:
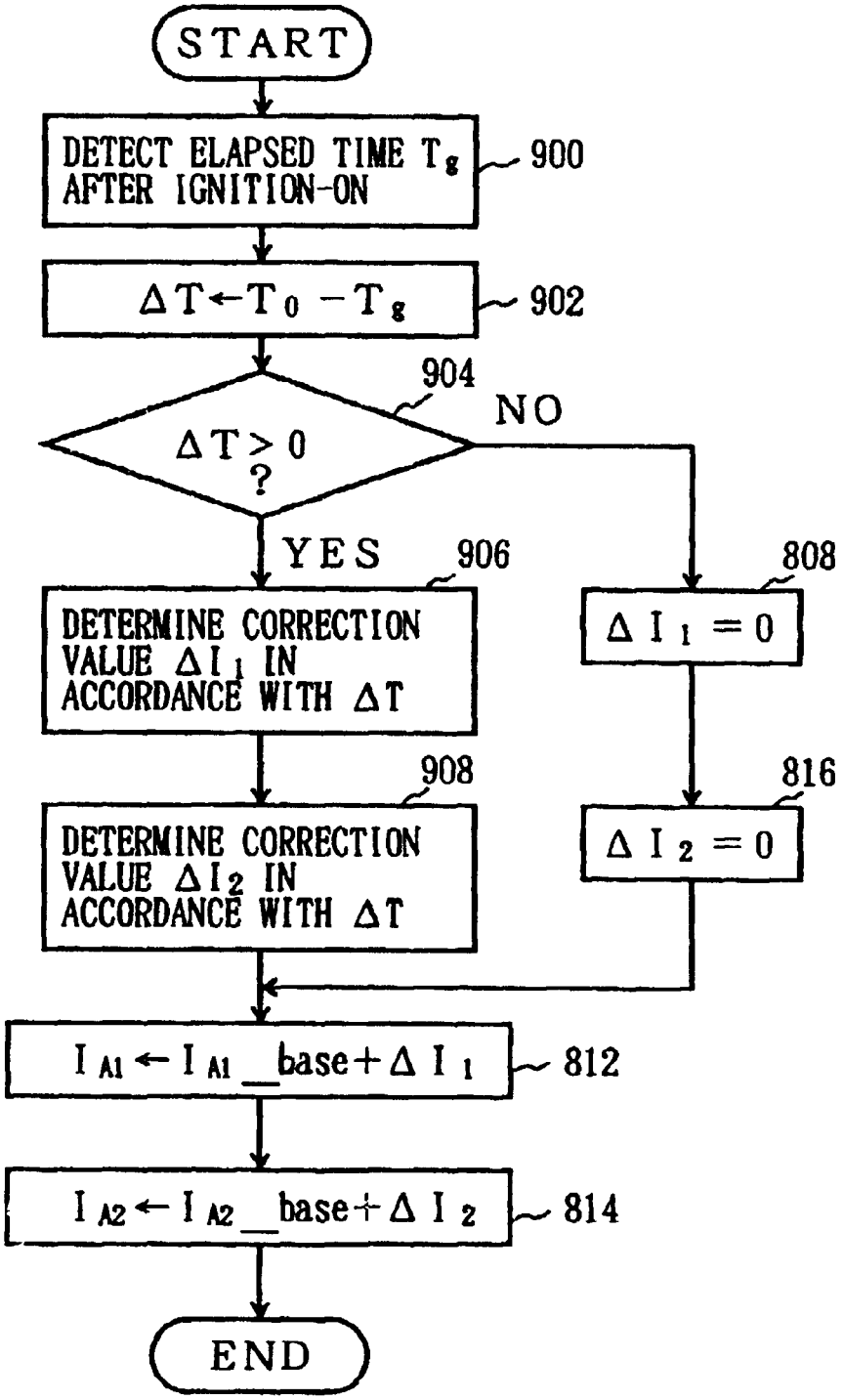
FIG. 32 is a diagram showing a flowchart of a routine performed by the ECU in a ninth embodiment of the present invention.

FIG. 32 is a diagram showing a flowchart of a routine performed by the ECU 11 so as to determine values of the attracting current $I_A$ to the upper coil 58 and the lower coil 62 in the present embodiment. In the routine shown in FIG. 32, steps which performs the same process as steps of the routine shown in FIG. 30 are given the same reference numerals and descriptions thereof will be omitted. The routine shown in FIG. 32 is started at predetermined time intervals. When the routine is started, the process of step 900 is performed first.

In step 900, the elapsed time $T_g$ after the ignition switch was turned on is detected.

In step 902, a difference ΔT between the elapsed time $T_g$ and a predetermined reference time $T_0$is calculated as $\Delta T=T_0-T_g$. The reference time T0 is set to be a time required to achieve the zero-lash state after the ignition switch is turned on.

In step 904, it is determined whether or not the difference ΔT is a positive value. If $\Delta T>0$ is established, then the process of step 906 is performed. On the other hand, if $\Delta T>0$ is not established, then the process of step 808 is performed.

In step 906, the correction value $\Delta I_1(<0)$ for the attracting current $I_A$ to the lower coil 62 is determined based on the difference ΔT, and in the subsequent step 908, the correction value $\Delta I_2(>0)$ for the attracting current $I_A$ to the upper coil 58 is determined based on the difference ΔP. When the process of step 908 is finished, the process of step 812 is performed.

Figure 33:
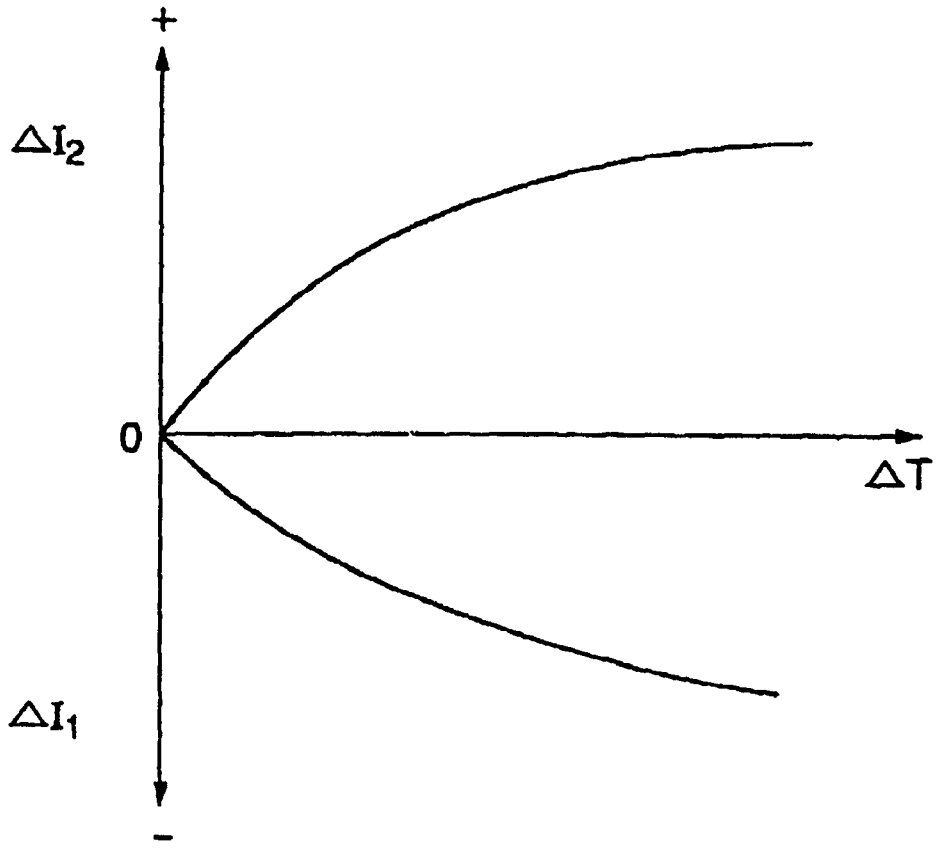
FIG. 33 is a diagram showing an example of a map which is referred to so as to determine the correction values $\Delta I_1$ and $\Delta I_2$ in the routine shown in FIG. 32.

FIG. 33 is a diagram showing an example of a map which is referred to so as to determine the correction values $\Delta I_1$ and $\Delta I_2$ in the above-mentioned steps 606 and 608. The map shown in FIG. 33 can be obtained by experimentally determining optimal values of the attracting current $I_A$ to the respective coils for various values of the difference ΔT and calculating differences between the determined values and the base values $I_{A1_base}$, $I_{A2_base}$, respectively. As shown in FIG. 33, the correction value $\Delta I_2$ is set to be larger and the correction value $\Delta I_1$ is set to be smaller for a larger value of the difference $\Delta P$.

As mentioned above, in the present embodiment, the attracting current $I_A$ to the lower coil 62 is set to be smaller and the attracting current to the upper coil 58 is set to be larger for a larger value of the difference $\Delta T$, in view of the fact that a displacement of the armature 56 toward the lower core 64 becomes smaller as the elapsed time Th becomes longer (that is, as the difference $\Delta T$ becomes larger). Thus, according to the present embodiment, the engine valve 12 can be positively actuated between the fully closed position and the fully opened position without a necessity of providing the pressure sensor for detecting the supplied oil pressure P.

In the above-mentioned eighth and ninth embodiments, only the attracting current $I_A$ is changed. However, it is also possible to change both the attracting current $I_A$ and the holding current $I_H$ as in the fifth to seventh embodiments.

Additionally, in the eighth and ninth embodiments, descriptions are given for a case where the oil pump 83 is operated by using a rotation of the engine as a power source. However, in a case where the oil pump 83 is an electric pump operated by using a battery as a power source, a discharge pressure of the oil pump 83 is not immediately increased after the ignition switch is turned on. Thus, in the case where the oil pump 83 is an electric pump, it is possible to positively actuate the engine valve 12 by changing the attracting current $I_A$ in accordance with the supplied oil pressure P or the elapsed time Th as in the eighth and ninth embodiments.

Further, although values of instruction currents to the respective coils are changed in the fifth to the ninth embodiments, a time for which the respective coils are supplied with instruction currents may be changed.

Next, a description will be given of a tenth embodiment of the present embodiment.

If a failure of a system for supplying an oil pressure to the zero-lash adjuster 40, such as a trouble of the oil pump 83 or a damage of the oil supply passages 80, 82, has occurred, it is possible that a sufficient oil pressure is not supplied to the zero-lash adjuster 40 or no oil pressure is supplied to the zero-lash adjuster 40. Hereinafter, such a failure is referred to as an oil-supply failure. The oil-supply failure may occur before the engine is started or after the operating period has started.

If the oil-supply failure has occurred before the engine is started, the zero-lash adjuster 40 is not supplied with a proper oil pressure when the armature 56 is moved to the fully closed position by the initial actuation and the zero-lash adjuster 40 communicates with the oil supply passage 82. In this case, the leak-down of the zero-lash adjuster 40 cannot be cancelled.

Similarly, if the oil-supply failure has occurred during the operating period, the leak-down of the zero-lash adjuster 40 starts being caused since the zero-lash adjuster 40 is not supplied with a proper oil pressure.

As mentioned above with reference to FIGS. 23A and 23B, when the leak-down of the zero-lash adjuster 40 has occurred, a current to be supplied to the upper coil 58 becomes larger and a current to be supplied to the lower coil 62 becomes smaller as compared to a case where no leak-down has occurred.

In the present embodiment, the solenoid valve device 10 can be operated in one of a regular operation mode and a compensating operation mode. The regular operation mode is achieved when the reference oil pressure P is supplied to the zero-lash adjuster 40 so that the zero-lash state is maintained. When the oil-supply failure is detected, an operation mode of the solenoid valve device 10 is switched from the regular operation mode to the compensating operation mode. In the compensating operation mode, an instruction current to the lower coil 62 is set to be a smaller value and an instruction current to the upper coil 58 is set to be a larger value as compared to a case of the regular operation mode. Thus, according to the compensating operation mode, it is possible to actuate the engine valve 12 between the fully closed position and the fully opened position while suppressing power consumption of the solenoid valve device 10 when the oil-supply failure has occurred. In the present embodiment, the oil-supply failure is detected when the supplied oil pressure P is lower than the reference oil pressure P.

Figure 34:
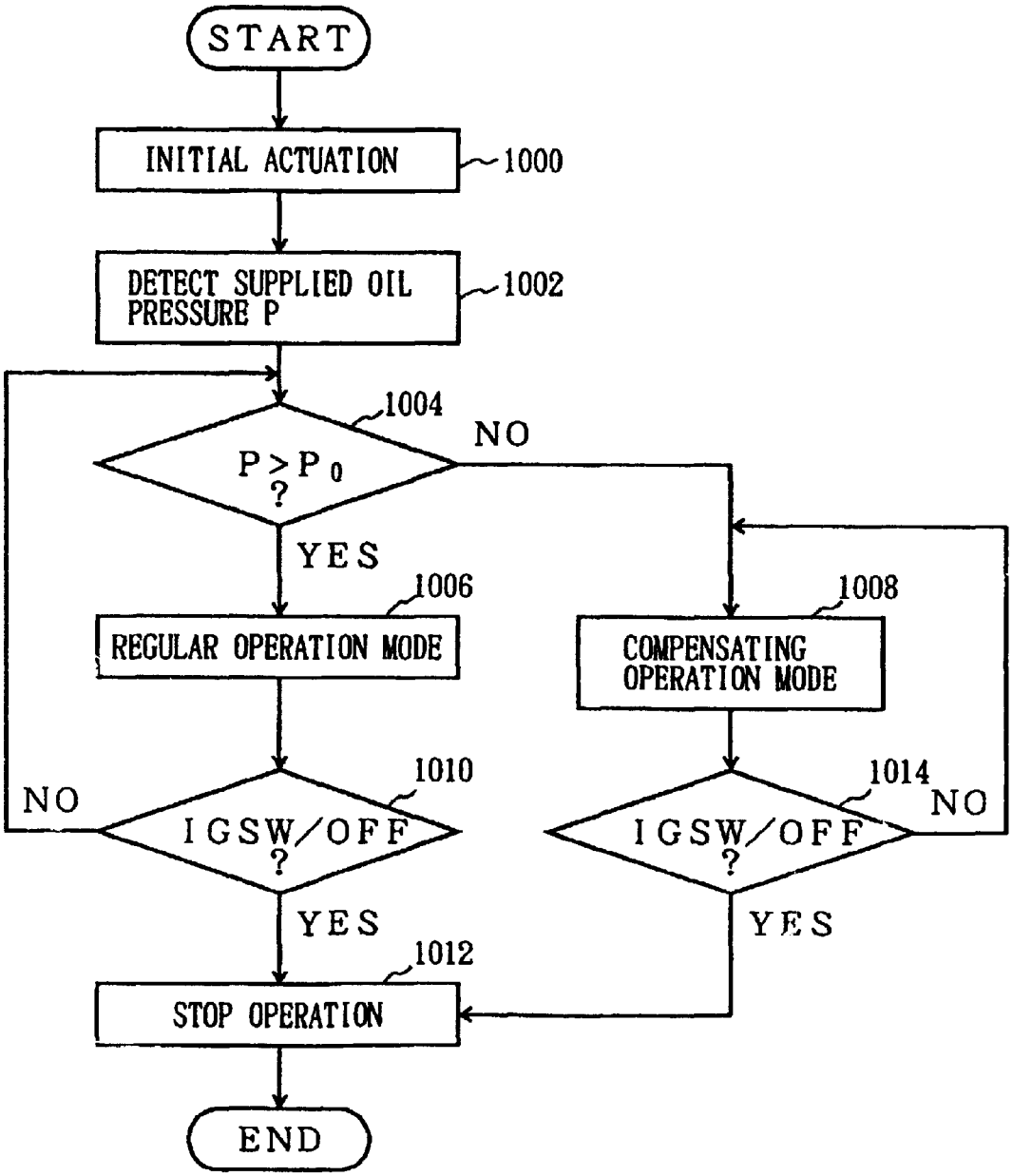
FIG. 34 is a routine performed by the ECU 11 in a tenth embodiment of the present invention.

FIG. 34 is a routine performed by the ECU 11 in the present embodiment. The routine shown in FIG. 34 is performed once when the ignition switch is turned on. When the routine is started, the process of step 1000 is performed first.

In step 1000, a process for achieving the initial actuation is performed.

In step 1002, the supplied oil pressure P is detected.

In step 1004, it is determined whether or not the supplied oil pressure P is equal to or larger than the reference oil pressure $P_0$. If $P \geqq P_0$ is established, then the process of step 1006 is performed. On the other hand, if $P \geqq P_0$ is not established, then the process of step 1008 is performed.

In step 1006, an operation mode of the solenoid valve device 10 is set to be the regular operation mode. Specifically, in step 1006, the attracting currents $I_A$ to the lower coil 62 and the upper coil 58 are set to be the base values $I_{A1_base}$ and $I_{A2_base}$, respectively, and the holding currents $I_H$ to the lower coil 62 and the upper coil 58 are set to be the base values $I_{H1_base}$ and $I_{H2_base}$, respectively, which base values were described in the above-mentioned eighth embodiment. When the process of step 1006 is finished, then the process of step 1010 is performed.

In step 1010, it is determined whether or not the ignition switch is turned off. If the ignition is not turned off, then the process of step 1004 is performed again. Thus, the oil-supply failure can be detected after the operating period is started. On the other hand, if the ignition switch is turned off, the operation of the solenoid valve device 10 is stopped in step 1012 and then the routine is ended.

In step 1008, the operation mode of the solenoid valve device 10 is set to be the compensating operation mode. Specifically, in step 1008, the attracting current $I_A$ and the holding current $I_H$ to the lower coil 62 are set to be values which are smaller than the base values $I_{A1_base}$ and $I_{H1_base}$, respectively, and the attracting current $I_A$ and the holding current $I_H$ to the upper coil 58 are set to be values which are larger than the base values $I_{A2_base}$ and $I_{H2_base}$, respectively. When the process of step 1008 is finished, then the process of step 1014 is performed.

In step 1014, it is determined whether or not the ignition switch is turned off. If the ignition switch is not turned off, then the process of step 1008 is performed again. On the other hand, if the ignition switch is turned off, the operation of the solenoid valve device 10 is stopped in step 1012 and then the routine is ended.

In the present embodiment, the oil-supply failure is detected based on the supplied oil pressure P. However, when an electric pump is used as the oil pump 83, it is possible to detect a trouble of the oil pump 83 when a rotation speed of a pump motor is smaller than a predetermined value or a cutoff of the pump motor is detected.

Additionally, in the present embodiment, the instruction currents to the respective coils are set to be constant values in the compensating operation mode. However, if oil gradually leaks out from the oil supply passage 80 or 82 due to a crack of the passage, for example, the supplied oil pressure P changes in accordance with an extent of the crack. The instruction currents to be supplied to the respective coils change in accordance with the supplied oil pressure P, as mentioned in the eighth embodiment. Thus, the instruction currents to the respective coils may be changed based on the supplied oil pressure P by the ECU 11 performing the abovementioned mentioned routine shown in FIG. 30.

In the above-mentioned fifth to tenth embodiments, descriptions were given of current controls with respect to the solenoid valve device 10. However, it should be noted that these current controls can be applied to the solenoid valve devices 200, 400.

Additionally, the present invention is not limited to these embodiments, but variations and modifications may be made without departing from the scope of the present invention.

The present application is based on japanese priority applications no. 10-331548 filed on Nov. 20, 1998, No. 11-54173 filed on Mar. 2, 1999, No. 11-84896 filed on Mar. 26, 1999, and No. 11-105555 file on Apr. 13, 1999, the entire contents of which are hereby incorporated by reference.

What is claimed is:

1. A valve device comprising:

an engine valve which can move in an axial direction thereof and being in operative engagement with an armature;

an electromagnet which attracts said armature so that said engine valve moves in the axial direction; and a zero-lash adjuster mechanism which is interposed between said engine valve and said armature, said zero-lash adjuster mechanism being connected between a valve shaft of said engine valve and an armature shaft of said armature, wherein at least a part of said zero-lash adjuster mechanism is disposed inside said electromagnet.

2. The solenoid valve device as claimed in claim 1, wherein said zero-lash adjuster mechanism is a displacement-compensating mechanism which expands in accordance with an increase in a spacing between said valve shaft and said armature shaft.

3. The solenoid valve device as claimed in claim 2, wherein said displacement-compensating mechanism expands when said engine valve is in a closed position.

4. The solenoid valve device as claimed in claim 2, wherein said displacement-compensating mechanism is a hydraulic zero-lash adjuster.

5. The solenoid valve device as claimed in claim 4, wherein said hydraulic zero-lash adjuster expands by being supplied with an oil pressure.

6. The solenoid valve device as claimed in claim 5, further comprising an oil pressure supplying mechanism for supplying an oil pressure to said hydraulic zero-lash adjuster when said engine valve is closed.

7. The solenoid valve device as claimed in claim 1, wherein said zero-lash adjuster mechanism includes a hydraulic zero-lash adjuster which expands in accordance with an increase in a spacing between said engine valve and said armature by being supplied with an oil pressure.

8. The solenoid valve device as claimed in claim 1, wherein said electromagnet includes an upper core and a lower core positioned closer to said engine valve than said upper core so that said armature moves between said upper core and said lower core, and said zero-lash adjuster mechanism is disposed inside said lower core of said electromagnet.

9. The solenoid valve device as claimed in claim 8, wherein said zero-lash adjuster mechanism is operated by an hydraulic pressure supplied through an oil supply passage provided in said lower core.

* * * * *